US008223978B2

(12) United States Patent
Yoshizawa et al.

(10) Patent No.: US 8,223,978 B2
(45) Date of Patent: Jul. 17, 2012

(54) TARGET SOUND ANALYSIS APPARATUS, TARGET SOUND ANALYSIS METHOD AND TARGET SOUND ANALYSIS PROGRAM

(75) Inventors: Shinichi Yoshizawa, Osaka (JP); Yoshihisa Nakatoh, Nara (JP); Tetsu Suzuki, Osaka (JP)

(73) Assignee: Panasonic Corporation, Osaka (JP)

( * ) Notice: Subject to any disclaimer, the term of this patent is extended or adjusted under 35 U.S.C. 154(b) by 1330 days.

(21) Appl. No.: 11/902,731

(22) Filed: Sep. 25, 2007

(65) Prior Publication Data

US 2008/0304672 A1 Dec. 11, 2008

Related U.S. Application Data

(63) Continuation of application No. PCT/JP2006/325548, filed on Dec. 21, 2006.

(30) Foreign Application Priority Data

Jan. 12, 2006 (JP) ..... 2006-005178

(51) Int. Cl.
*H04R 29/00* (2006.01)

(52) U.S. Cl. ..... 381/56; 381/97

(58) Field of Classification Search ..... 381/56, 381/61, 97, 98, 102, 104, 107, 109, 119, 381/94.1–94.3; 704/205, 270, 272, 278
See application file for complete search history.

(56) References Cited

U.S. PATENT DOCUMENTS 7,143,649 B2 * 12/2006 Yoshino ..... 73/579
7,260,226 B1 * 8/2007 Miura et al. ..... 381/56
7,974,420 B2 * 7/2011 Yoshizawa et al. ..... 381/98
8,073,157 B2 * 12/2011 Mao et al. ..... 381/92
(Continued)

FOREIGN PATENT DOCUMENTS

JP 61-128300 6/1986
(Continued)

OTHER PUBLICATIONS

International Search Report (in English language) issued Apr. 3, 2007.

(Continued)

*Primary Examiner* — Xu Mei
(74) *Attorney, Agent, or Firm* — Wenderoth, Lind & Ponack, LLP

(57) ABSTRACT

A target sound analysis apparatus capable of distinguishing between a sound having the same fundamental period as a target sound but which differs therefrom and the target sound and analyzing whether or not the target sound is contained in an evaluation sound is an target sound analysis apparatus that analyzes whether or not a target sound is included in an evaluation sound, and includes: a target sound preparation unit that prepares a target sound that is an analysis waveform to be used for analyzing a fundamental period; an evaluation sound preparation unit that prepares an evaluation sound that is an analyzed waveform in which its fundamental period will be analyzed; and an analysis unit that temporally shifts the target sound with respect to the evaluation sound to sequentially calculate differential values of the evaluation sound and the target sound at corresponding points in time, calculate an iterative interval between the points in time where the differential value is equal to or lower than a predetermined threshold value, and judge whether or not the target sound exists in the evaluation sound based on a period of the iterative interval and the fundamental period of the target sound.

12 Claims, 37 Drawing Sheets

U.S. PATENT DOCUMENTS

| | | | | |
|---|---|---|---|---|
| 8,165,306 | B2 * | 4/2012 | Miura et al. | 381/56 |
| 2007/0233489 | A1 * | 10/2007 | Hirose et al. | 704/258 |
| 2011/0228951 | A1 * | 9/2011 | Sekiya et al. | 381/94.1 |

FOREIGN PATENT DOCUMENTS

| | | |
|---|---|---|
| JP | 63-5398 | 1/1988 |
| JP | 9-258762 | 10/1997 |
| JP | 2000-200100 | 7/2000 |
| JP | 2003-317368 | 11/2003 |
| JP | 2004-126855 | 4/2004 |

OTHER PUBLICATIONS

Malcolm Slaney et al., "*A Perceptual Pitch Detector*", International Conference on Acoustics, Speech, and Signal Processing, IEEE, 1990, pp. 357-360.

* cited by examiner

Example of motorcycle sound $$E(m)=\sum_{n=0}^{n=W}\sqrt{(BH(m+n)-BT(n))^2}\quad (m=0,1,\cdots,L-W)$$

Amplitude BH(n)
(n=0,1,···,L)
Evaluation sound
Time (n)
0
L
9ms
Peripheral sound of user
9ms
Amplitude
Time
Present point in time
Evaluation sound
Target sound Amplitude BT(n)
(n=0,1,···,W)
Time (n)
0
W
3ms E(m)= Σ n=0 n=W √(BH(m+n)-BT(n))² (m=0,1,···,L-W)
Differential value E(m)
Threshold value Θ
0
Time (m)
L-W
No target sound
Same interval as fundamental period of target sound W=3ms Example of siren sound of emergency vehicle

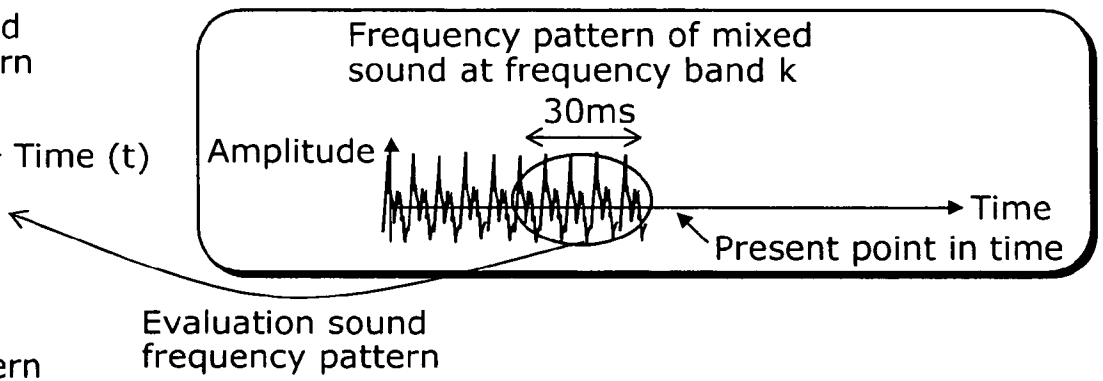
FIG. 24A
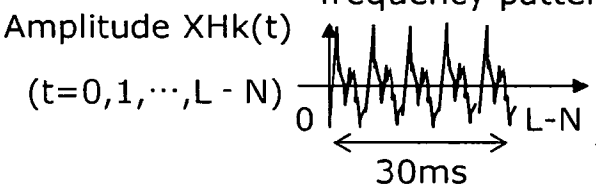
FIG. 24B
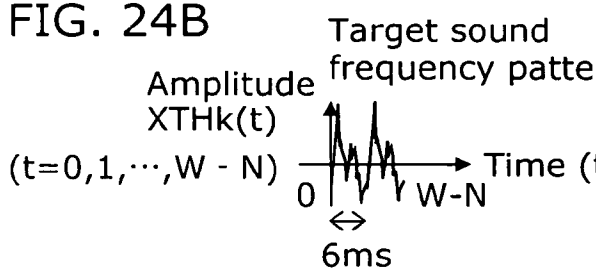
FIG. 24C
$$E_k(m)=\sum_{t=0}^{t=W-N}\sqrt{(XH_k(m+t)-XT_k(t))^2}\ (m=0,1,\cdots,L-W-N)$$
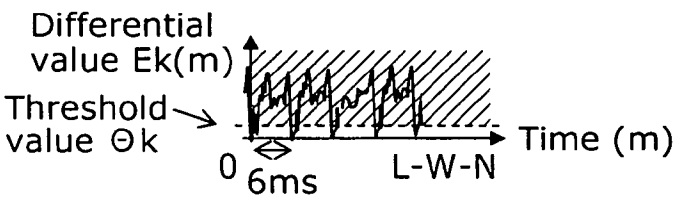

TARGET SOUND ANALYSIS APPARATUS, TARGET SOUND ANALYSIS METHOD AND TARGET SOUND ANALYSIS PROGRAM

CROSS REFERENCE TO RELATED APPLICATION(S)

This is a continuation application of PCT application No. PCT/JP2006/325548 filed Dec. 21, 2006, designating the United States of America.

BACKGROUND OF THE INVENTION (1) Field of the Invention

The present invention relates to an apparatus, a method and a program for distinguishing between a sound having the same fundamental period as a target sound but which differs therefrom and the target sound, and analyzing whether or not the target sound is contained in an evaluation sound. In particular, the present invention relates to an apparatus, a method and a program for analyzing whether or not a target sound is contained in an evaluation sound by determining a time period or a frequency band of the existence of a fundamental period of the target sound in the evaluation sound.

(2) Description of the Related Art

Techniques for analyzing fundamental periods are utilized and perform important roles in a wide range of fields including mixed sound separation, sound discrimination and voice synthesis. For instance, a technique used in the field of mixed sound separation uses pitch that is the fundamental period of voice to extract voice from mixed sound containing aperiodic noise. In addition, there is a technique that uses fundamental periods of musical sounds to separate a performance of an orchestra into its respective instruments. Furthermore, a technique used in the field of voice synthesis creates synthetic voice by extracting pitch, which is a fundamental period of voice, as a parameter.

In a first conventional technique for analyzing fundamental periods, a fundamental period is extracted by calculating autocorrelation using a time-frequency structure (spectrogram) created using an auditory filter or through Fourier transform (for instance, refer to Slaney, Malcolm, et al., "A Perceptual Pitch Detector", 1990, ICASSP (International Conference on Acoustics, Speech, and Signal Processing), IEEE, Chapter 3).

The first conventional technique performs Fourier transform on signals inputted at predetermined time intervals to calculate a time-frequency structure (spectrogram). Then, for a predetermined frequency, a fundamental period is extracted by calculating an autocorrelation of a power spectrum in the direction of the temporal axis.

FIGS. 35A and 35B are diagrams explaining a method for determining a fundamental period using a time-frequency structure.

FIG. 35A shows a power spectrum of a given frequency. The ordinate represents sizes of the power spectrum while the abscissa represents sample numbers. FIG. 35B shows an autocorrelation of the power spectrum shown in FIG. 35A. The ordinate represents autocorrelation while the abscissa represents candidates of the fundamental period.

Methods of determining autocorrelation and fundamental periods will now be described.

If a power spectrum at a given point in time (sample number)

$$n \qquad \text{[Formula 1]}$$

of a given frequency may be expressed as $$X(n) \qquad \text{[Formula 2]}$$

autocorrelation $$R(\tau) \qquad \text{[Formula 3]}$$

may be calculated using Formula 4, $$R(\tau) = \sum_{n=\tau}^{\tau+N} (X(n) \times X(n-\tau)), \qquad \text{[Formula 4]}$$

where $$\tau \qquad \text{[Formula 5]}$$

represents a candidate of the fundamental period (fundamental period candidate) and $$N \qquad \text{[Formula 6]}$$

represents the number of samples in an area of analysis.

A fundamental frequency $$tp \qquad \text{[Formula 7]}$$

is determined as a fundamental period candidate having the maximum autocorrelation (Formula 3), as expressed by Formula 8.

$$tp = \arg_\tau \max R(\tau). \qquad \text{[Formula 8]}$$

In the example shown in FIG. 35B, the fundamental period is (the time period corresponding to) 110 samples.

A second conventional technique for analyzing fundamental periods extracts a fundamental period by obtaining a time interval in which the size of a power spectrum equals or exceeds a predetermined threshold value using a temporal structure of a power spectrum at a given frequency, which is created through wavelet transform (for instance, refer to Japanese Unexamined Patent Application Publication No. 2004-126855 (claim 1, FIGS. 3 and 4)).

The second conventional technique performs wavelet transform on signals inputted at predetermined time intervals to calculate a temporal structure of a power spectrum. For instance, a binary wavelet transformed value $$D_yWT \qquad \text{[Formula 9]}$$

of an inputted signal $$x(t) \qquad \text{[Formula 10]}$$

may be calculating using a scale parameter $$a = 2^j \qquad \text{[Formula 11]}$$

quantized by a binary sequence and a shift parameter $$b \qquad \text{[Formula 12]}$$

according to Formula 13, which is expressed as $$D_yWT_x(b, 2^j) = \frac{1}{2^j}\int_{-\infty}^{\infty} x(t) g^*\left(\frac{t-b}{2^j}\right) dt. \qquad \text{[Formula 13]}$$

In this case, a frequency band to be analyzed is determined by the scale parameter (Formula 11). The shift parameter (Formula 12) corresponds to the number of samples.

In Formula 13, $$g(x) \qquad \text{[Formula 14]}$$

is a wavelet function, while $$g^*(x) \qquad \text{[Formula 15]}$$

is a complex conjugate of the wavelet function (Formula 14).

FIG. 36 shows a temporal structure of a power spectrum when a voice signal is wavelet-transformed by a frequency corresponding to a scale parameter $$a=2^4. \quad \text{[Formula 16]}$$

The ordinate represents the power spectrum (Formula 13) while the abscissa represents sample numbers (Formula 12).

As shown in FIG. 36, when a voice signal is wavelet-transformed, the temporal structure of a power spectrum takes a form in which the power spectrum has a large value at a given sample number. In this conventional technique, a threshold value $$A0 \quad \text{[Formula 17]}$$

for detecting peaks in the power spectrum has been set, whereby the size of the spectrum and the threshold value (Formula 17) are compared to determine a peak that equals or exceeds the threshold value. The time interval of a peak that exceeds the threshold value is considered to be the fundamental period $$tp. \quad \text{[Formula 18]}$$

In the example shown in FIG. 36, the fundamental period is (the time period corresponding to) 110 samples.

A third conventional technique for analyzing fundamental periods determines a fundamental period (pitch) using a residual waveform pattern obtained by passing an original voice through a filter set to an inverse filter characteristic of a vocal tract articulatory equivalent filter. In this case, a cross-correlation between a residual waveform pattern at a given time interval and a single pitch waveform pattern (basic waveform pattern) used when synthesizing a voiced voice is determined, whereby the time interval of the peak of the cross-correlation is considered to be the fundamental period (pitch) (for instance, refer to Japanese Unexamined Patent Application Publication No. 63-5398 (claim 1, FIG. 3)).

FIGS. 37A to 37C show a relationship between residual waveform patterns and cross-correlations.

The residual waveform pattern depicted in FIG. 37A is extracted through inverse filtering. Next, a cross-correlation shown in FIG. 37B between a single pitch waveform pattern used when synthesizing a voiced sound and the residual waveform pattern is determined. FIG. 37C shows a temporal structure of the cross-correlation between the residual waveform pattern and a single pitch waveform pattern. The temporal structure arranges, on a per-time basis along the abscissa, cross-correlations determined by temporally shifting single pitch waveform patterns by a given time interval with respect to the residual waveform pattern. In the example shown in FIG. 37C, the fundamental period is determined to be 2 ms.

However, with the first conventional technique, there is a problem in that, even for a sound having the same fundamental period as a target sound but which differs therefrom, since the same fundamental period value as the target sound is outputted, it is difficult to analyze fundamental periods while distinguishing between the sound having the same fundamental period as a target sound but which differs therefrom and the target sound. For instance, it is difficult to analyze fundamental periods while distinguishing between the voices of two male speakers with similar fundamental periods (pitches). As a result, it is difficult to analyze whether or not an evaluation sound contains the target sound.

In addition, the second conventional technique also has the problem in that, even for a sound having the same fundamental period as a target sound but which differs therefrom, since the same fundamental period value as the target sound is outputted, it is difficult to analyze fundamental periods while distinguishing between the sound having the same fundamental period as a target sound but which differs therefrom and the target sound. Therefore, it is difficult to analyze whether or not an evaluation sound contains the target sound. For instance, when analyzing fundamental periods while distinguishing between the voices of two male speakers with similar fundamental periods, since the maximum value of a power spectrum fluctuates according to the volume of a voice, it is difficult to set a threshold value when the maximum value of the power spectrum of the speaker that is not the target is greater than the maximum value of the power spectrum of the speaker that is the target.

Furthermore, the third conventional technique also has the problem in that, even for a sound having the same fundamental period as a target sound but which differs therefrom, since the same fundamental period value as the target sound is outputted, it is difficult to analyze fundamental periods while distinguishing between the sound having the same fundamental period as a target sound but which differs therefrom and the target sound. Therefore, it is difficult to analyze whether or not an evaluation sound contains the target sound.

The present invention has been made in consideration of the above problems, and an object thereof is to provide a target sound analysis apparatus and the like capable of distinguishing between an "target sound" and a "sound having the same fundamental period as a target sound but which differs therefrom", and to analyze whether or not the target sound is contained in an evaluation sound. In particular, the present invention is aimed at providing a target sound analysis apparatus and the like that determines a time period or a frequency band of an existence of a fundamental period of the target sound in the evaluation sound.

SUMMARY OF THE INVENTION

In order to achieve the object, the target sound analysis apparatus according to the present invention analyzes whether or not an evaluation sound contains a target sound. The target sound analysis apparatus includes: a target sound preparation unit operable to prepare the target sound that is an analysis waveform to be used for analyzing a fundamental period; an evaluation sound preparation unit operable to prepare the evaluation sound that is a to-be-analyzed waveform in which a fundamental period is to be analyzed; and an analysis unit operable to (i) sequentially calculate differential values between the evaluation sound and the target sound at corresponding points in time, by temporally shifting the target sound with respect to the evaluation sound, (ii) calculate an iterative interval between the points in time where the differential value is equal to or lower than a predetermined threshold value, and (iii) judge whether or not the target sound exists in the evaluation sound, based on a period of the iterative interval and the fundamental period of the target sound.

Thus, since a differential value between an evaluation sound and a target sound is calculated and whether or not the target sound exists in the evaluation sound is judged based on a period of an iterative interval when the differential value is equal to or lower than a predetermined threshold value and a fundamental period of the target sound, it is now possible to distinguish between a sound having the same fundamental period as a target sound but which differs therefrom and the target sound and analyze the presence or absence of the target sound. This is due to the fact that the minimum value of the differential values approximately becomes zero when the evaluation sound is the target sound, and minimum value of the differential values takes a large value that is distanced from zero when the evaluation sound has the same fundamental period as the target sound but differs from the target sound.

It is preferable that the target sound preparation unit is operable to prepare a target sound frequency pattern obtained by performing a frequency analysis on the target sound, that the evaluation sound preparation unit is operable to prepare an evaluation sound frequency pattern obtained by performing a frequency analysis on the evaluation sound, and that the analysis unit is operable to (i) sequentially calculate differential values between the evaluation sound frequency pattern and the target sound frequency pattern at corresponding points in time, by temporally shifting the target sound frequency pattern with respect to the evaluation sound frequency pattern, (ii) calculate an iterative interval between the points in time where the differential value is equal to or lower than a predetermined threshold value, and (iii) judge whether or not the target sound exists in the evaluation sound, based on a period of the iterative interval and the fundamental period of the target sound.

Thus, since a differential value between an evaluation sound frequency pattern and a target sound frequency pattern is calculated and whether or not the target sound exists in the evaluation sound is judged based on a period of an iterative internal when the differential value is equal to or lower than a predetermined threshold value and a fundamental period of the target sound, it is now possible to distinguish between a sound having the same fundamental period as a target sound but which differs therefrom and the target sound and analyze the presence or absence of the target sound. In this case, since the evaluation sound frequency pattern resulting from a frequency analysis of the evaluation sound and the target sound frequency pattern resulting from a frequency analysis of the target sound are used, it is now possible to analyze the presence or absence of the target sound on a per-frequency band basis. For instance, when analyzing an evaluation sound in which the target sound and noise are mixed, the presence or absence of the target sound may be analyzed by selecting a frequency band that is free of noise.

It is preferable that the target sound analysis apparatus further includes a sound information setting unit operable to set sound information regarding the target sound, wherein the target sound preparation unit is operable to prepare the target sound or the target sound frequency pattern, based on the set sound information.

Thus, since the target sound preparation unit prepares a target sound based on sound information set by the sound information setting unit, the target sound analysis apparatus is now capable of controlling a target sound to be prepared by the target sound preparation unit. In addition, since the target sound preparation unit prepares a target sound frequency pattern based on target sound-related sound information set by the sound information setting unit, the target sound analysis apparatus is now capable of controlling a target sound frequency pattern to be prepared by the target sound preparation unit. As a result, a user is now capable of setting a target sound using the sound information setting unit.

It is preferable that the sound information setting unit is operable to receive input of the target sound and set the inputted target sound as to the sound information, and that the target sound preparation unit is operable to either set the inputted target sound as to the target sound to be prepared or prepare the target sound frequency pattern by performing a frequency analysis on the target sound.

Thus, since the target sound preparation unit uses a target sound inputted by the sound information setting unit as the target sound to be prepared, the target sound preparation unit is no longer required to prepare in advance a plurality of sounds to be used as candidates for the target sound (target sound candidates), and a reduction of storage capacity may be achieved. In addition, since the target sound preparation unit uses a target sound inputted by the sound information setting unit to create a target sound frequency pattern, the target sound preparation unit is no longer required to prepare in advance a plurality of target sound frequency patterns corresponding to the target sound candidates, and a reduction of storage capacity may be achieved.

It is further preferable that the target sound analysis apparatus further includes a sound information setting unit is operable to receive a selection signal for selecting one of the plurality of the candidates for the target sound or one of the plurality of the candidates for the target sound frequency pattern, wherein the target sound preparation unit is operable to store a plurality of candidates for the target sound or a plurality of candidates for the target sound frequency pattern, and the target sound preparation unit is operable to set the candidate for the target sound selected by the selection signal or the candidate of the target sound frequency pattern selected by the selection signal, as to the target sound to be prepared or the target sound frequency pattern to be prepared, respectively.

Thus, since a target sound may be prepared using target sound candidates stored in the target sound preparation unit, there is no need to input a target sound. As a result, the presence or absence of a target sound may be analyzed even when a target sound cannot be inputted. For instance, when analyzing the presence or absence of a male voice in ambient noise, while it is impossible to pick up a male voice in a quiet environment in ambient noise, the presence or absence of the male voice may be analyzed by using the male voice in a quiet environment stored in the target sound preparation unit. In addition, since the time required for inputting a target sound may be omitted, real time processing may be achieved.

Furthermore, since a target sound frequency pattern may now be prepared using candidates for the target sound frequency pattern (target sound frequency pattern candidates) stored in the target sound preparation unit, there is no need to input a target sound, perform frequency analysis, and create a target sound frequency pattern. As a result, a target sound may be analyzed even when the target sound cannot be inputted. For instance, when analyzing the presence or absence of a male voice in ambient noise, while it will be impossible to pick up a male voice in a quiet environment in ambient noise, the presence or absence of the male voice may be analyzed by using a target sound frequency pattern created by performing frequency analysis on the male voice in a quiet environment stored in the target sound preparation unit. In addition, since the time required for inputting a target sound or performing frequency analysis on the inputted target sound may be omitted, real time processing may be achieved.

It is still further preferable that the target sound analysis apparatus further includes a threshold value setting unit operable to (i) sequentially calculate differential values between the evaluation sound and the target sound at corresponding points in time, by temporally shifting the target sound with respect to a plurality of the evaluation sounds, (ii) calculate a minimum value among the differential values, and (iii) set the predetermined threshold value based on a maximum value of the plurality of the minimum values corresponding to the plurality of the evaluation sounds.

As a result, it is now possible to set a threshold value that is shared by a plurality of evaluation sounds. For instance, even for the same motorcycle sound, when a motorcycle sound collected in ambient noise and a motorcycle sound collected in an environment without ambient noise are respectively set as evaluation sounds, a threshold value shared by the two motorcycle sounds may be set. Therefore, an appropriate threshold value with respect to a plurality of target sounds may be set and the presence or absence of target sounds may be analyzed with respect to a plurality of target sounds. In addition, analytical errors on the presence or absence of a target sound may be reduced by appropriately controlling the threshold value.

It is still further preferable that the target sound preparation unit is operable to prepare the target sound frequency pattern that includes at least one of an amplitude spectrum and a phase spectrum, the included spectrum being calculated from a cross correlation between the target sound and an aperiodic analysis waveform consisting of a predetermined frequency component, and the evaluation sound preparation unit is operable to prepare the evaluation sound frequency pattern that includes at least one of an amplitude spectrum and a phase spectrum, the included spectrum being calculated from a cross correlation between the evaluation sound and the aperiodic analysis waveform.

Thus, since a fundamental period of a target sound is analyzed using a target sound frequency pattern and an evaluation sound frequency pattern created using an aperiodic analysis waveform, periodic characteristics of the target sound and the evaluation sound appear. As a result, the presence or absence of the target sound may be analyzed. For instance, since the fundamental period of the target sound will even appear in a target sound frequency pattern of a frequency band that is higher than the fundamental period of the target sound, the presence or absence of the target sound may be analyzed even when noise is superimposed on a frequency band corresponding to the fundamental period of the target sound. In addition, since the fundamental period of the target sound appears in target sound frequency patterns across all frequency bands, fundamental periods may be analyzed on a per-frequency band basis to be used for target sound extraction.

It is still further preferable that the target sound preparation unit is operable to prepare the target sound frequency pattern that includes at least one of an amplitude spectrum and a phase spectrum, the included spectrum being calculated from respective cross correlations between the target sound and a plurality of local analysis waveforms that forms a portion of an analysis waveform consisting of a predetermined frequency component and that has predetermined temporal resolution, the evaluation sound preparation unit is operable to prepare the evaluation sound frequency pattern that includes at least one of an amplitude spectrum and a phase spectrum, the included spectrum being calculated from respective cross correlations between the evaluation sound and the plurality of the local analysis waveforms, and the analysis unit is operable to analyze the fundamental period of the target sound, by using, as a single group of data, the target sound frequency pattern prepared using the plurality of the local analysis waveforms and the evaluation sound frequency pattern prepared using the plurality of the local analysis waveforms, respectively.

Thus, since target sound frequency patterns prepared using a plurality of local analysis waveforms and evaluation sound frequency patterns prepared using a plurality of local analysis waveforms are respectively used as a single group of data to analyze a fundamental period, changes in temporal frequency structures at the frequency resolution of the analysis waveforms may be accommodated, and a fundamental period may be analyzed by seemingly increasing the frequency resolution. For instance, for a mixed sound, a fundamental period may be analyzed in a narrow frequency band with a low noise level. As a result, the presence or absence of a target sound in a mixed sound (evaluation sound) may be judged with greater accuracy.

It is still further preferable that the target sound analysis apparatus further include a frequency setting unit operable to set each frequency band of the target sound frequency pattern and the evaluation sound frequency pattern which are used by the analysis unit, wherein the analysis unit is operable to analyze the fundamental period of the target sound, by using the target sound frequency pattern and the evaluation sound frequency pattern whose frequency band is set by the frequency setting unit.

Thus, frequency bands of target sound frequency patterns and evaluation sound frequency patterns used by the analysis unit may be controlled using the frequency setting unit. As a result, it is now possible to change a frequency band to be analyzed or the bandwidth of a frequency band to be analyzed. For instance, when analyzing the presence or absence of a target sound from an evaluation sound in which the target sound and noise are mixed, the fundamental period may be analyzed by selecting a frequency band that is free of noise.

The present invention may be achieved not only as a target sound analysis apparatus provided with such characteristic units, but also as a target sound analysis method that includes, as steps, the characteristic units included in the target sound analysis apparatus, as well as a program that enables a computer to function as the characteristic units included in the target sound analysis apparatus. It is needless to say that such programs may be distributed via a recording medium such as a CD-ROM (Compact Disc-Read Only Memory) or a communication network such as the Internet.

As seen, when a differential value of an evaluation sound and a target sound is calculated by temporally shifting the target sound with respect to the evaluation sound, the present invention is capable of distinguishing between an "target sound" and a "sound having the same fundamental period as a target sound but which differs therefrom" and analyzing whether or not the target sound is contained in the evaluation sound by judging whether or not the target sound exists in the evaluation sound based on a period of an iterative interval when the differential value is equal to or lower than a predetermined threshold value and the fundamental period of the target sound. In addition, even when the evaluation sound contains a noise or the like having a waveform pattern that suddenly resembles that of the target sound, accurate analysis may be performed on whether the evaluation sound is really a sudden noise or is the target sound.

Further Information about Technical Background to this Application

The disclosure of Japanese Patent Application No. 2006-005178 filed on Jan. 12, 2006 including specification, drawings and claims is incorporated herein by reference in its entirety.

The disclosure of PCT application No. PCT/JP2006/325548 filed Dec. 21, 2006, including specification, drawings and claims is incorporated herein by reference in its entirety.

BRIEF DESCRIPTION OF THE DRAWINGS

These and other objects, advantages and features of the present invention will become apparent from the following description thereof taken in conjunction with the accompanying drawings that illustrate a specific embodiment of the invention. In the Drawings:

FIG. 24A is a diagram showing an example of a method of calculating a differential value using an evaluation sound frequency pattern and a target sound frequency pattern;

FIG. 24B is a diagram showing an example of a method of calculating a differential value using an evaluation sound frequency pattern and a target sound frequency pattern;

FIG. 24C is a diagram showing an example of a method of calculating a differential value using an evaluation sound frequency pattern and a target sound frequency pattern;

DESCRIPTION OF THE PREFERRED EMBODIMENT(S)

First, the concept of a target sound analysis method according to the present invention will be described.

FIGS. 1A to 1G show schematic diagrams of a target sound analysis method according to the present invention.

Figure 1A:
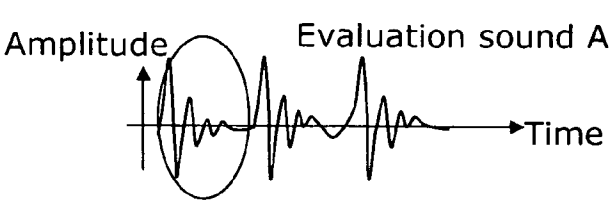
FIG. 1A is a conceptual diagram of a target sound analysis method according to the present invention.
Figure 1B:
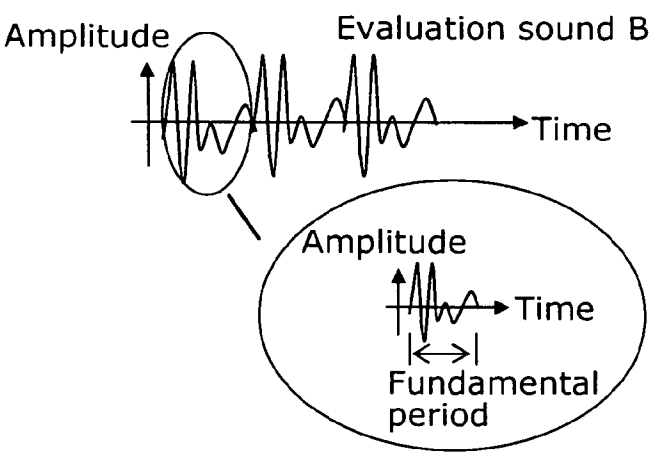
FIG. 1B is a conceptual diagram of a target sound analysis method according to the present invention.
Figure 1C:
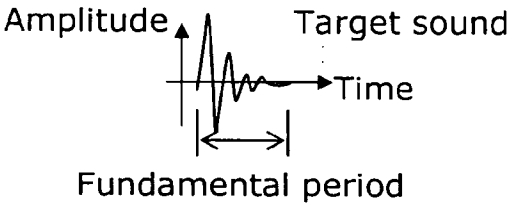
FIG. 1C is a conceptual diagram of a target sound analysis method according to the present invention.
Figure 1E:
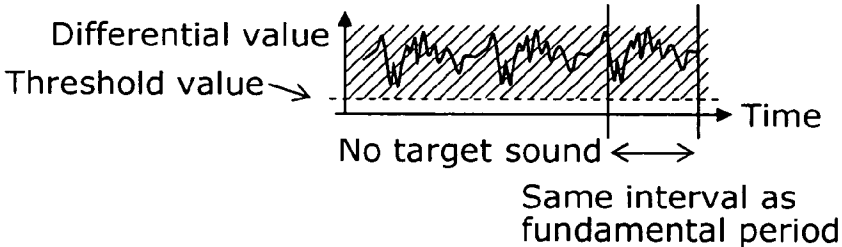
FIG. 1E is a conceptual diagram of a target sound analysis method according to the present invention.
Figure 1D:
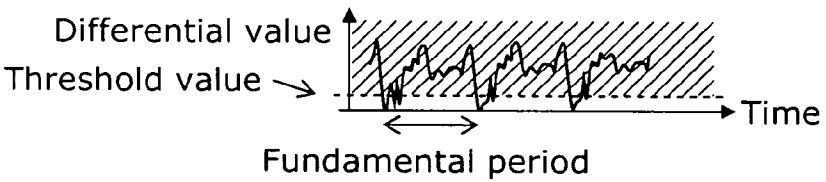
FIG. 1D is a conceptual diagram of a target sound analysis method according to the present invention.

The description will now start with a case where an evaluation sound is a target sound. By temporally shifting the target sound shown in FIG. 1C (herein, a fundamental waveform pattern is used) with respect to the evaluation sound A shown in FIG. 1A (waveform patterns corresponding to three periods of the target sound shown in FIG. 1C), differential values between the evaluation sound A and the target sound at corresponding points in time are sequentially calculated. A result of the differential value calculation is shown in FIG. 1D. Since the evaluation sound A is identical with the target sound, there are portions where the minimum value of the differential values is zero. A time interval in which the differential value is zero matches the fundamental period of the target sound. Therefore, when the target sound exists in an evaluation sound, it is apparent that the period of a time interval in which the differential value is zero matches the fundamental period of the target sound. Note that an iterative time interval between differential values that are equal to or lower than a predetermined threshold value is set as the iterative time interval. In this example, the threshold value is set to a value that is slightly greater than zero. As shown in FIG. 1D, the iterative interval between differential values that are equal to or lower than a threshold value that is slightly larger than zero is identical to the time interval in which the differential value is zero.

Next, a case will be described where the evaluation sound has the same fundamental period as the target sound, but is a sound that differs from the target sound. By temporally shifting the target sound shown in FIG. 1C with respect to an evaluation sound B shown in FIG. 1B (the waveform patterns corresponding to three periods of a sound having the same fundamental period as the target sound shown in FIG. 1C but differs from the target sound), differential values between the evaluation sound B and the target sound at corresponding points in time are sequentially calculated. A result of differential value calculation is shown in FIG. 1E. Since the sound contained in evaluation sound B has the same fundamental period as the target sound but a waveform pattern thereof differs from the waveform pattern of the target sound, the minimum value of the differential values will not equal zero but will instead take a large value. At this point, since the evaluation sound B is a waveform pattern having the same fundamental period as the target sound, the time interval of the minimum value of the differential values is identical to the fundamental period of the target sound. Accordingly, a threshold value is introduced to analyze whether or not the target sound exists in the evaluation sound based on an iterative time interval between differential values that are equal to or lower than the predetermined threshold value. This threshold value is the same value (a value slightly greater than zero) as the threshold value shown in FIG. 1D. As shown in FIG. 1E, since the same waveform pattern as the target sound does not exist in the evaluation sound, the differential value does not equal zero, and no iterations of differential values equal to or lower than the threshold value exist. Therefore, the present method is capable of judging that the evaluation sound B differs from the target sound.

As described above, differential values between an evaluation sound and a target sound are calculated, and an analysis is performed on whether or not the target sound exists in an evaluation sound based on an iterative interval of a differential value that is equal to or lower than the predetermined threshold value. In other words, analysis is performed such that the target sound is judged to exist in the evaluation sound when the period of the iterative time interval is approximately equal to the fundamental period of the target sound, and the target sound is judged not to exist in the evaluation sound when the period of the iterative time interval is not approximately equal to the fundamental period of the target sound. This configuration enables analysis to be performed on whether or not a target sound exists in an evaluation sound while distinguishing between a sound that has the same fundamental period as the target sound but differs therefrom and the target sound.

In addition, by analyzing, based on iterative intervals, whether or not a target sound exists in an evaluation sound, even when the evaluation sound contains a noise or the like having a waveform pattern that partially resembles that of the target sound, accurate analysis may be performed on whether the evaluation sound is really a sudden noise or is the target sound (the details are described in the first embodiment).

The threshold value introduced in the present invention may be set as a value that is slightly greater than zero when the fundamental waveform pattern of the target sound does not fluctuate. In addition, when the fundamental waveform pattern of the target sound fluctuates, the threshold value may be set, by taking into consideration the fluctuation width of the fundamental waveform pattern of the target sound, to a value that is slightly larger than the maximum value of variation due to the fluctuation of the minimum value of the differential values. Furthermore, the threshold value may be adjusted through feedback of analysis error results. Moreover, when handling a plurality of target sounds, it is also possible to set a value for each target sound.

Figure 1G:
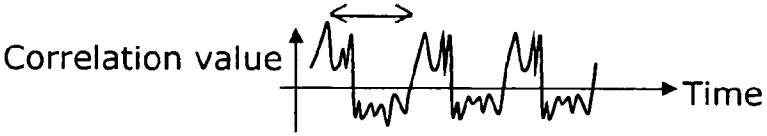
FIG. 1G is a conceptual diagram of a target sound analysis method according to the present invention.
Figure 1F:
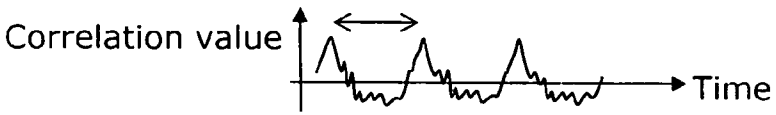
FIG. 1F is a conceptual diagram of a target sound analysis method according to the present invention.

To provide a comparison with the present invention, results from a case where the third conventional technique is used are schematically shown in FIGS. 1F and 1G. Recall that the third conventional technique determines a fundamental period using a time interval of a cross correlation between a residual waveform pattern (corresponding to an evaluation sound) obtained by passing an original voice through a filter set to an inverse filter characteristic of an vocal tract articulatory equivalent filter and a single pitch waveform pattern (corresponding to a target sound) used when synthesizing voiced voice. FIG. 1F shows an example of results of sequential calculating of cross correlations of the evaluation sound A and the target sound at corresponding points in time, by temporally shifting the target sound shown in FIG. 1C with respect to the evaluation sound A shown in FIG. 1A. FIG. 1G shows an example of results of sequential calculating of cross correlations of the evaluation sound B and the target sound at corresponding points in time, by temporally shifting the target sound shown in FIG. 1C with respect to the evaluation sound B shown in FIG. 1B. Unlike the differential values according to the present invention, since the third conventional technique uses cross correlation, a differential value may take a large value even with respect to a sound that is not the target sound. Thus, it is difficult to introduce a threshold value. This is due to the fact that, unlike a differential value, a correlation value is for judging whether or not signs match, and when the value of a waveform pattern of a portion in which the signs of the two waveform patterns for calculating a correlation value match is significant, a correlation value will take a large value regardless of whether or not the signs of the two waveform patterns match. As seen, with a conventional technique using correlation values, it is difficult to introduce threshold values. In addition, the present inventors have considered using a threshold value after introducing a normalized cross correlation obtained by normalizing cross correlation with the sizes of a target sound (target sound frequency pattern) and a corresponding evaluation sound (evaluation sound frequency pattern). However, it was discovered that the lack of information on the size of sounds (frequency patterns) caused sounds (frequency patterns) significantly greater or lower than the target sound (target sound frequency pattern) to be erroneously judged as the target sound as long as their shapes were similar to that of the target sound. In particular, when analyzing an evaluation sound (evaluation sound frequency pattern) in a noise segment where the target sound (target sound frequency pattern) that has a simple shape such as a sine wave and which has an extremely small amplitude, analysis error increases due to the added influence of quantization errors. Furthermore, when performing analysis while segmenting a target sound into respective frequency bands, since the relationship in size (spectrum structure of the target sound) of the target sound frequency pattern between frequency bands become important, information regarding the sizes of frequency patterns will be required. In comparison, the differential values according to the present invention are capable of using information regarding the size of sounds and are therefore capable of solving the above problems.

The embodiments of the present invention will now be described with reference to the drawings.

First Embodiment

Figure 2:
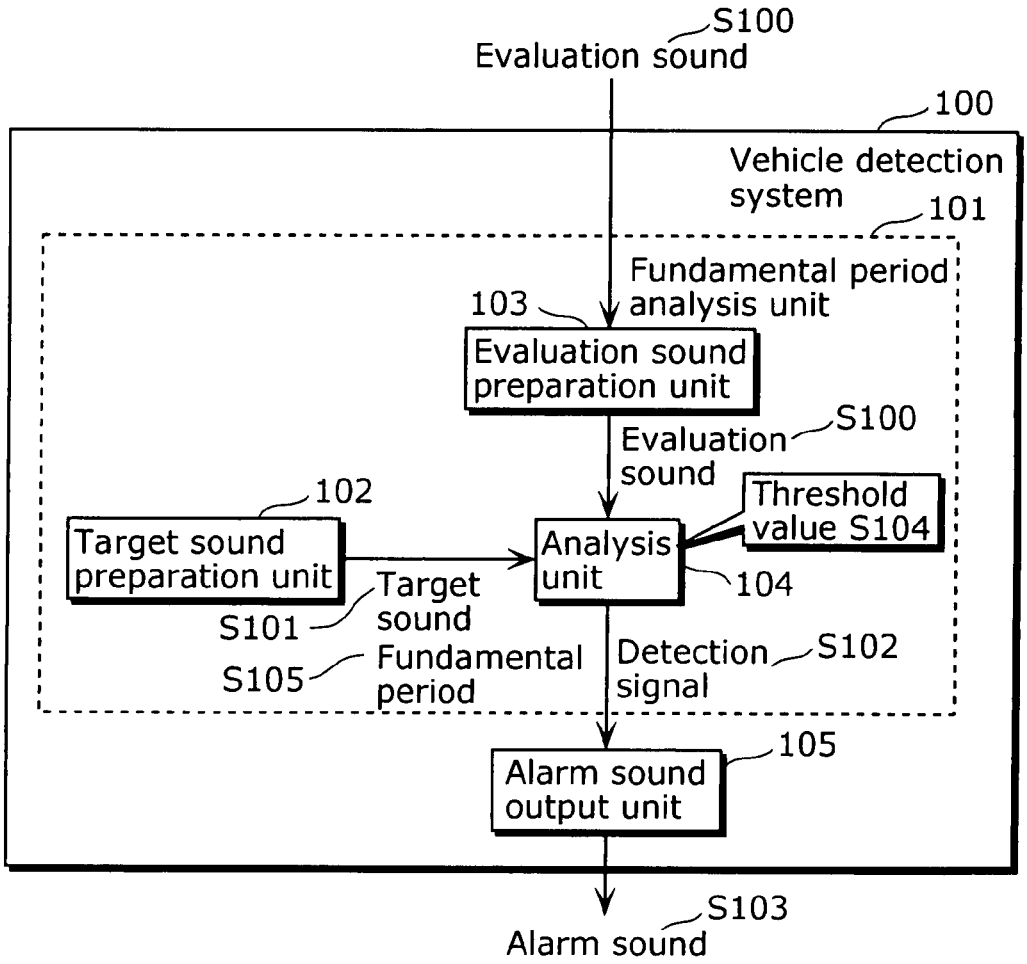
FIG. 2 is a block diagram showing an overall configuration of a target sound analysis apparatus according to a first embodiment.

FIG. 2 is a block diagram showing an overall configuration of a target sound analysis apparatus according to a first embodiment of the present invention. In this case, an example is shown in which the target sound analysis apparatus according to the present invention is incorporated into a vehicle detection system. The present embodiment will now be explained using as an example a case where a user is notified of an approaching motorcycle by judging the existence of a motorcycle sound in the proximity of the user through analysis of a fundamental period of the motorcycle sound.

A vehicle detection system 100 is a system that detects whether or not an evaluation sound S100 is a motorcycle sound, and if so, outputs an alarm sound S103. The vehicle detection system 100 includes a fundamental period analysis unit 101 and an alarm sound output unit 105.

The fundamental period analysis unit 101 is a processing unit that analyzes a fundamental period of the evaluation sound S100, and includes a target sound preparation unit 102, an evaluation sound preparation unit 103 and an analysis unit 104.

The target sound preparation unit 102 stores a target sound S101 and a fundamental period S105 of the target sound S101. The analysis unit 104 stores a threshold value S104. The target sound preparation unit 102 outputs the target sound S101 and the fundamental period S105 to the analysis unit 104. The evaluation sound preparation unit 103 inputs the evaluation sound S100, and outputs the same to the analysis unit 104. The analysis unit 104 temporally shifts the target sound S101 with respect to the evaluation sound S100 in order to sequentially calculate differential values of the evaluation sound S100 and the target sound S101 at corresponding points in time, analyzes whether or not the target sound S101 exists in the evaluation sound S100 based on a period of an iterative time interval between differential values that are equal to or lower than the threshold value S104 and the fundamental period S105 of the target sound S100, and using the fundamental period S105, outputs a detection signal S102 to the alarm sound output unit 105 when the target sound S101 exists in the evaluation sound S100.

The target sound preparation unit 102 is an example of a target sound preparation unit that prepares a target sound that is an analysis waveform pattern to be used for analyzing a fundamental period.

The evaluation sound preparation unit 103 is an example of an evaluation sound preparation unit that prepares an evaluation sound that is a to-be-analyzed waveform pattern in which a fundamental period will be analyzed.

The analysis unit 104 is an example of an analysis unit that temporally shifts the target sound with respect to the evaluation sound in order to sequentially calculate differential values of the evaluation sound and the target sound at corresponding points in time, calculates an iterative interval between the points in time where the differential value is equal to or lower than a predetermined threshold value, and judges whether or not the target sound exists in the evaluation sound based on a period of the iterative interval and the fundamental period of the target sound.

The alarm sound output unit 105 presents the alarm sound S103 to the user when the detection signal S102 is inputted.

Next, operations of the vehicle detection system 100 configured as above will be described.

Figure 3:
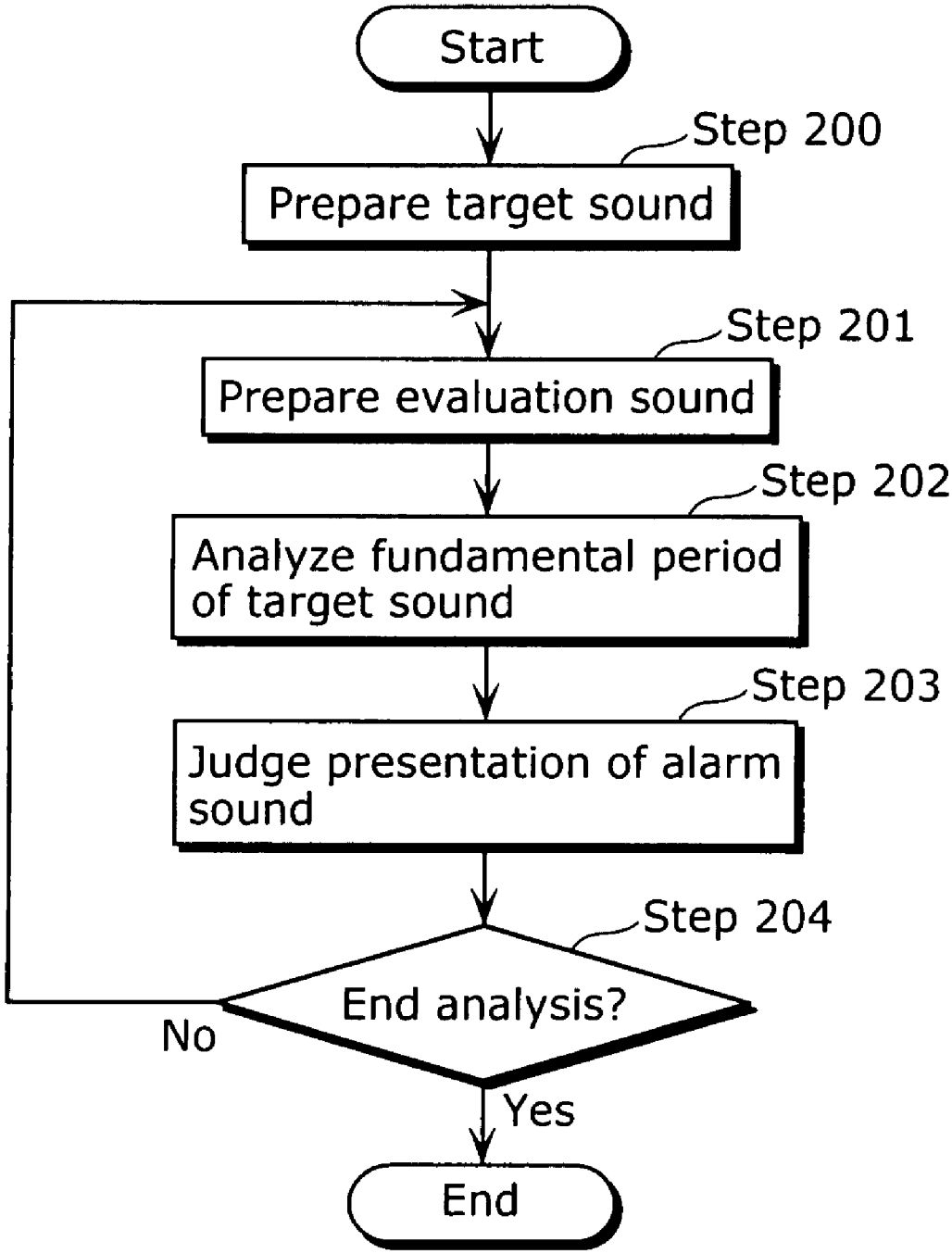
FIG. 3 is a flowchart showing an operational procedure of a vehicle detection system.

FIG. 3 is a flowchart showing an operational procedure of the vehicle detection system 100.

In this example, prior to the shipment of the vehicle detection system 100, a motorcycle sound is stored as the target sound S101 in the target sound preparation unit 102 (step 200), and the fundamental period S105 of the motorcycle sound that is the target sound S101 is also stored. In addition, the threshold value S104 is stored in the analysis unit 104.

Figure 4:
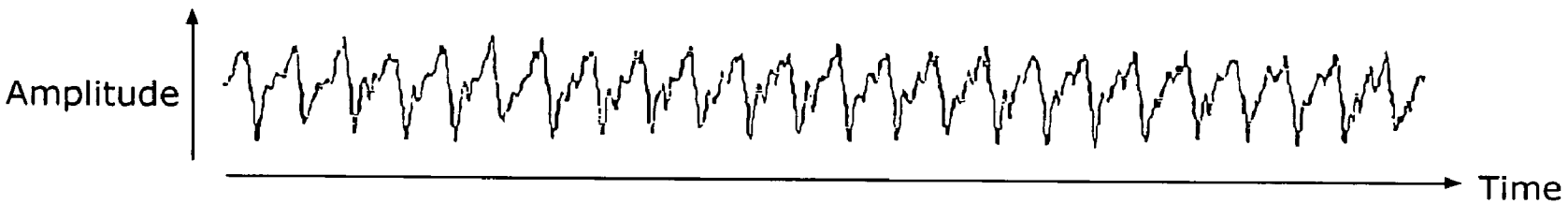
FIG. 4 is a diagram showing an example of a motorcycle sound.
Figure 5A:
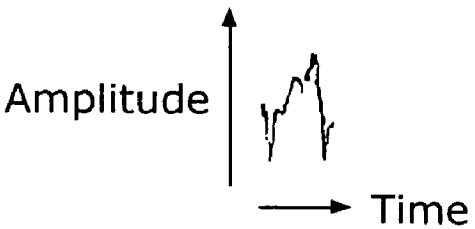
FIG. 5A is a diagram showing an example of a target sound in the case of a motorcycle sound.
Figure 5B:
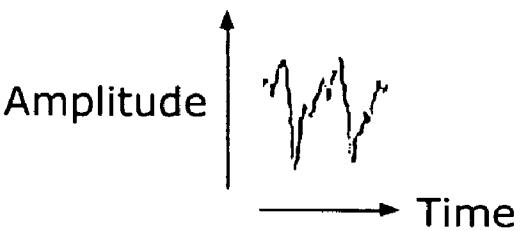
FIG. 5B is a diagram showing an example of a target sound in the case of a motorcycle sound.
Figure 5C:
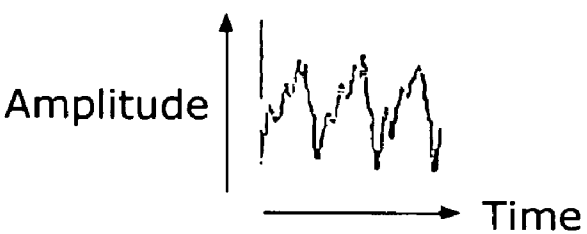
FIG. 5C is a diagram showing an example of a target sound in the case of a motorcycle sound.

An example of a motorcycle sound is shown in FIG. 4. It is obvious from the diagram that the motorcycle sound is periodic. In addition, examples of the target sound S101 are shown in FIGS. 5A to 5C. The target sound may either be a motorcycle sound corresponding to one period as shown in FIG. 5A, a motorcycle sound corresponding to two periods as shown in FIG. 5B, or a motorcycle sound corresponding to three periods as shown in FIG. 5C. No limitations on temporal length are placed on the target sound. For this example, the motorcycle sound corresponding to one period which is shown in FIG. 5A is set as the target sound S101. In addition, the fundamental period S105 of the target sound S101 is 2.9-3.2 ms.

First, activation of the vehicle detection system 100 causes the evaluation sound preparation unit 103 to start retrieving peripheral sounds of the user, which is an evaluation sound S100, using a microphone (step 201). In this example, the evaluation sound is retrieved from peripheral sounds of the user in 9 ms intervals which include several fundamental periods of the motorcycle sound. In other words, the peripheral sounds of the user are segmented every 9 ms and inputted for analysis of the fundamental period of the motorcycle sound.

Next, analysis is performed on whether or not the fundamental period of the motorcycle sound that is the target sound S101 stored in the target sound preparation unit 102 is included in the evaluation sound S100 which includes peripheral sounds of the user (step 202). More specifically, the analysis unit 104 temporally shifts the target sound S101 with respect to the evaluation sound S100 in order to sequentially calculate differential values of the evaluation sound S100 and the target sound S101 at corresponding points in time, and analyzes the fundamental period of the target sound S101 based on a period of an iterative time interval between differential values that are equal to or lower than the threshold value S104. Then, using the fundamental period S105, the analysis unit 104 outputs a detection signal S102 to the alarm sound output unit 105 when the target sound S101 exists in the evaluation sound S100.

Figure 6A:
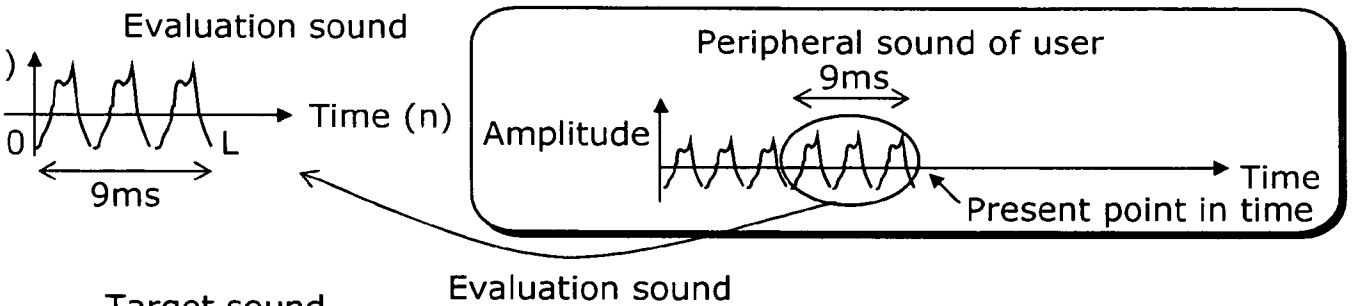
FIG. 6A is a diagram showing an example of a method of calculating a differential value using an evaluation sound and a target sound.
Figure 6B:
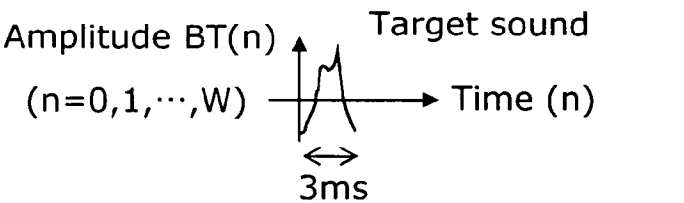
FIG. 6B is a diagram showing an example of a method of calculating a differential value using an evaluation sound and a target sound.
Figure 6C:
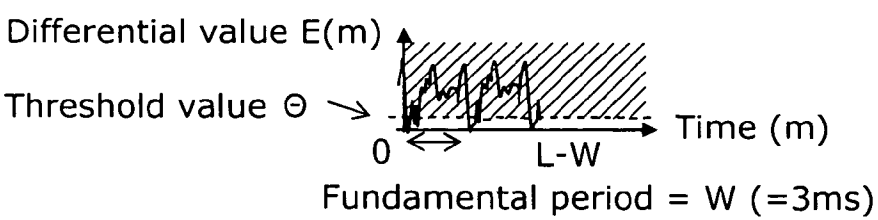
FIG. 6C is a diagram showing an example of a method of calculating a differential value using an evaluation sound and a target sound.

FIGS. 6A to 6C show examples of a method of analyzing the fundamental period of the target sound at the analysis unit 104. In this example, a case where the evaluation sound is the target sound is shown.

An example of an evaluation sound is shown in FIG. 6A. In this example, the peripheral sound of the user at 9 ms prior to the present point in time is clipped and used as the evaluation sound. The evaluation sound in this example includes a motorcycle sound that is a target sound corresponding to three periods. Now, the evaluation sound S100 is expressed as $$BH(n)\ (n=0,1,\ldots,L), \qquad \text{[Formula 19]}$$

where n is a value of discretized time, and, for this example, L is a value corresponding to 9 ms.

An example of an evaluation sound is shown in FIG. 6B. In this example, a motorcycle sound corresponding to one period is used as the target sound. Now, the target sound S101 is expressed as $$BT(n)\ (n=0,1,\ldots,W), \qquad \text{[Formula 20]}$$

where n is a value of discretized time, and, for this example, W is a value corresponding to 3 ms that is the fundamental period of the target sound S101.

A differential value when the target sound S101 is temporally shifted with respect to the evaluation sound S100 is shown in FIG. 6C. In this example, an Euclidean distance is used as a differential value. The differential value may be expressed as $$E(m) = \sum_{n=0}^{n=W} \sqrt{(BH(m+n) - BT(n))^2} \qquad \text{[Formula 21]}$$

$$(m = 0, 1, \ldots, L - W),$$

where m is a value of discretized time which corresponds to the point in time of the start of the evaluation sound S100 for which a differential value is determined. The differential value is a summation of the differences between the evaluation sound and the target sound for a time width W. In this example, since the evaluation sound is the target sound, the iterative time interval between the differential values is 3 ms, which matches the fundamental period S105 of the target sound.

At this point, the threshold value S104 is introduced. This threshold value S104 will be expressed as 0. In this example, the threshold value S104 has been stored in the analysis unit 104 prior to shipment of the vehicle detection system 100, and in consideration of the fluctuation width of the fundamental waveform pattern of the target sound, is set to a value that is slightly greater than the maximum value of a variation due to the fluctuation of the minimum value of the differential values.

An example of an analysis method of the fundamental period of an evaluation sound is shown in FIG. 6C. In this case, an iterative time interval of a differential value represented by Formula 21 that is equal to or lower than the threshold value 0 is determined. In this example, since the evaluation sound is a target sound, the minimum value of the differential values will be a value that is extremely close to zero. Therefore, the iterative time interval between the differential values that is equal to or lower than the threshold value 0 matches the iterative time interval of differential values when a threshold value is not considered. In this example, the fundamental period of the evaluation sound S100 is 3 ms.

Next, since the fundamental period of the evaluation sound is 3 ms and is therefore in the range of 2.9-3.2 ms that is the fundamental period S105 of the target sound, the analysis unit 104 judges that the target sound S101 exists in the evaluation sound S100, and outputs the detection signal S102 to the alarm sound output unit 105 (step 203). The alarm sound output unit 105 presents the alarm sound S103 to the user at a timing where the detection signal S102 is inputted.

Figures 7A, 7B, 7C:
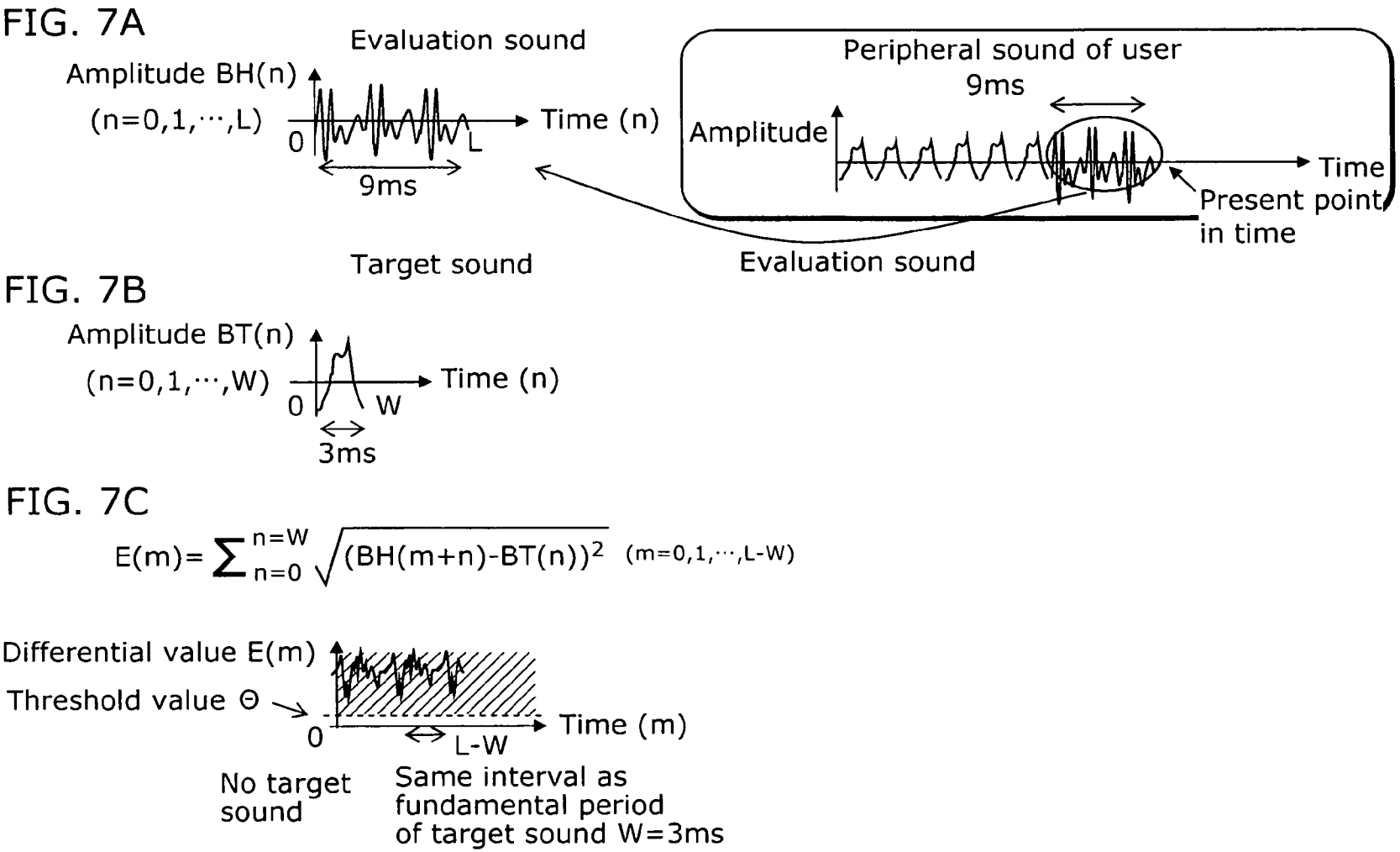
FIG. 7A is a diagram showing another example of a method of calculating a differential value using an evaluation sound and a target sound.
FIG. 7B is a diagram showing another example of a method of calculating a differential value using an evaluation sound and a target sound.
FIG. 7C is a diagram showing another example of a method of calculating a differential value using an evaluation sound and a target sound.

In addition, FIGS. 7A to 7C show examples of a case where the evaluation sound S100 has the same fundamental period as the target sound S101 but is a sound that differs from the target sound S101 in the analysis unit 104.

FIG. 7A shows an example of the evaluation sound S100 that differs from the motorcycle sound. This example similarly clips the peripheral sound of the user at 9 ms prior to the present point in time and uses the clipped sound as the evaluation sound S100. In this example, the evaluation sound S100 includes a sound that differs from a target sound and which corresponds to three periods. The fundamental period of the sound is the same as the target sound S101, and is W=3 ms.

An example of the evaluation sound S101 is shown in FIG. 7B. For this example, in the same manner as in FIG. 6B, the motorcycle sound corresponding to one period is used as the target sound S101 having a fundamental period of 3 ms.

A differential value when the target sound S101 is temporally shifted with respect to the evaluation sound S100 is shown in FIG. 7C. In this example, an Euclidean distance is used as a differential value in the same manner as FIG. 6C. In this case, since the evaluation sound S100 has the same fundamental period as the target sound S101, the iterative time interval between the differential values matches the fundamental period of the target sound S101, and is 3 ms.

At this point, the threshold value S104 is introduced. In this example, similarly, the threshold value S104 has been stored in the analysis unit 104 prior to shipment of the vehicle detection system 100, and in consideration of the fluctuation width of the fundamental waveform pattern of the target sound, is set to a value that is slightly greater than the maximum value of a variation due to the fluctuation of the minimum value of the differential values. This value is the same as the value in the examples shown in FIGS. 6A to 6C. At this point, an iterative time interval of a differential value represented by Formula 21 that is equal to or lower than the threshold value Θ is determined. In this example, since the evaluation sound differs from the target sound, the minimum value of the differential values will be a large value that is distanced from zero. As a result, an iterative time interval does not exist for a differential value that is equal to or lower than the threshold value Θ.

In such a case, since either a fundamental period of the evaluation sound S100 does not exist, or even if a fundamental period of the evaluation sound S100 does exist, the fundamental period is not in the range of range 2.9-3.2 ms that is the fundamental period S105 of the target sound S101, the analysis unit 104 judges that the target sound S101 does not exist in the evaluation sound S100, and does not output the detection signal S102 to the alarm sound output unit 105 (step 203). As a result, since the detection signal S102 is not inputted, the alarm sound output unit 105 does not present the alarm sound S103 to the user.

When the evaluation sound S100 has a fundamental period that differs from that of the target sound S101, the fundamental period S105 of the target sound S101 does not appear in the fundamental period of the evaluation sound S100. Therefore, the analysis unit 104 judges that the target sound S101 does not exist in the evaluation sound S100, and the alarm sound S103 is not presented to the user.

Finally, the operations of the above-described steps 201 to 203 are repeated until the vehicle detection system 100 is brought to a stop (step 204).

As described above, according to the first embodiment of the present invention, a differential value between an evaluation sound and a target sound is calculated, and judgment is made on whether or not the target sound exists in the evaluation sound based on the period of an iterative interval and the fundamental period of the target sound for a differential value that is equal to or lower than the predetermined threshold value. As a result, analysis may now be performed on whether or not a target sound exists in an evaluation sound while distinguishing between a "sound that has the same fundamental period as the target sound but differs from the target sound" and the "target sound".

Figure 8A:
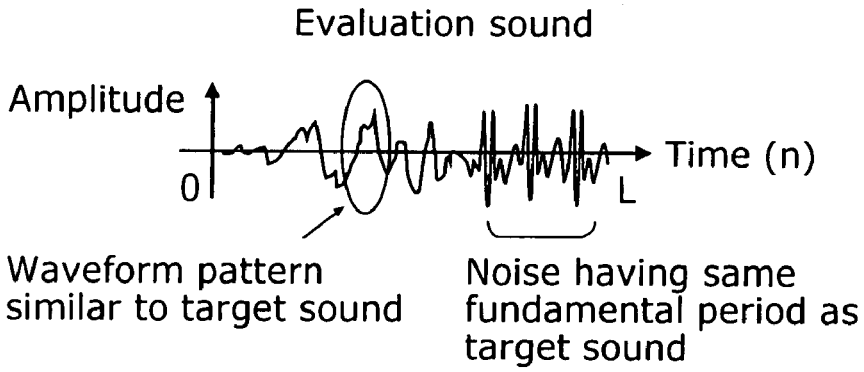
FIG. 8A is a diagram showing an example of a method using pattern matching with a target sound.
Figure 8B:
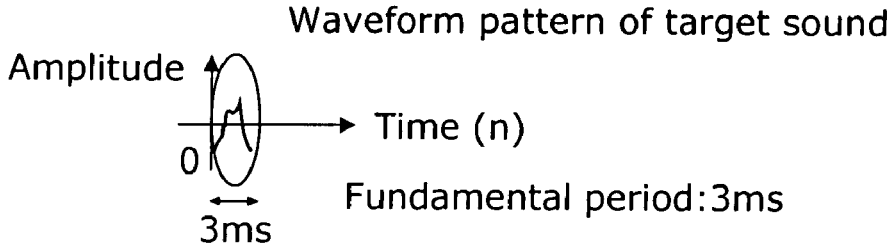
FIG. 8B is a diagram showing an example of a method using pattern matching with a target sound.
Figure 8C:
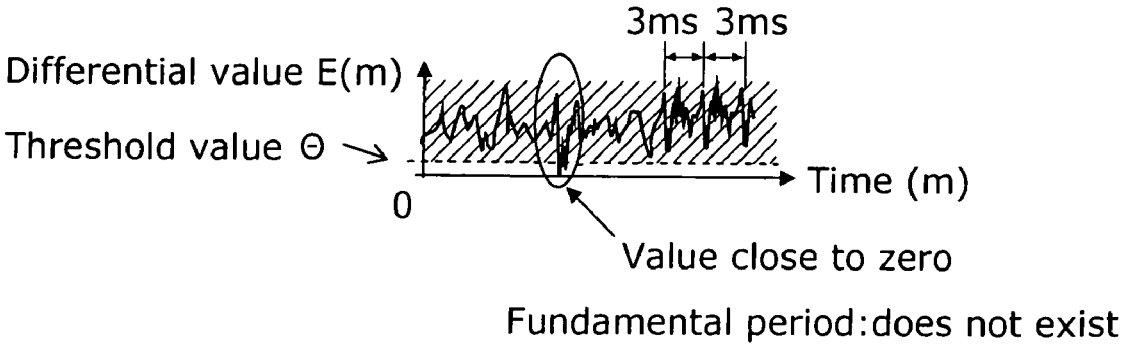
FIG. 8C is a diagram showing an example of a method using pattern matching with a target sound.

A case will now be considered where, instead of the analysis unit 104, the existence of a target sound is judged solely by differential values between an evaluation sound and a target sound without analyzing the period of an iterative time interval. In other words, the target sound is judged to exist when the differential value is either zero or approaches zero. A method of judging the existence of a target sound solely by differential values is shown in FIGS. 8A to 8C. FIG. 8A depicts an evaluation sound while FIG. 8B depicts a target sound. A waveform similar to the target sound exists in the first temporal half of the evaluation sound shown in FIG. 8A. A noise having the same fundamental period as the target sound, i.e. 3 ms, exists in the second temporal half. Note that the evaluation sound does not actually include the target sound. FIG. 8C shows differential values determined in the same manner as in the first embodiment. As already described in the above embodiment, a portion equal to or lower than the threshold value does not exist in the second temporal half. In other words, it is shown that the target sound does not exist in the second temporal half. On the other hand, a waveform pattern similar to the target sound exists in the evaluation sound in the first temporal half. Thus, there exists a portion of the differential values that is close to zero. In other words, a portion equal to or lower than the threshold value exists. With a method that judges that the target sound exists in the evaluation sound when the differential value between the waveform pattern of the evaluation sound and the waveform pattern of the target sound is equal to or lower than the threshold value, there is a possibility that the target sound will be erroneously judged to exist in the present evaluation sound. Conversely, since the first embodiment judges whether or not the period of a time interval between differential values that are equal to or lower than the threshold value is approximately equal to the fundamental period of the target sound in addition to a case where the differential value between the waveform pattern of the evaluation sound and the waveform pattern of the target sound is equal to or lower than the threshold value, a judgment that the target sound does not exist will be made even in the case shown in FIG. 8C. Therefore, by judging whether or not the period of a time interval between differential values that are equal to or lower than the threshold value is approximately equal to the fundamental period of the target sound, the existence of a target sound may be analyzed accurately without erroneously judging the existence of the target sound even when an evaluation sound contains a sudden noise or the like having a waveform pattern resembling that of the target sound, and the existence of the target sound may be detected even in ambient noise.

First Variation of the First Embodiment

Figure 9:
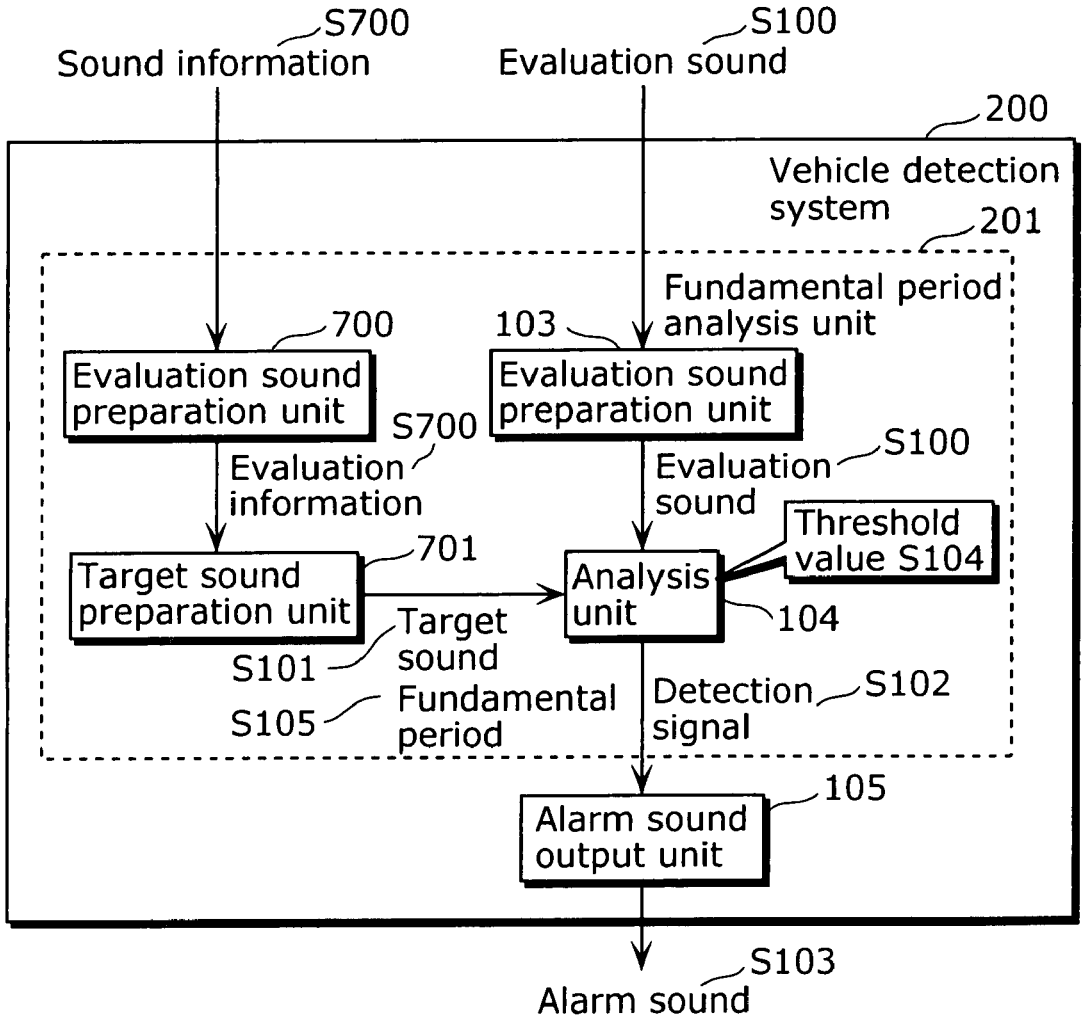
FIG. 9 is a block diagram showing an overall configuration of a target sound analysis apparatus according to a first variation of the first embodiment.

A first variation of the first embodiment will now be described. FIG. 9 is a block diagram showing an overall configuration of a target sound analysis apparatus according to the first variation of the first embodiment of the present invention. In this case, a sound information setting unit 700 has been added to the vehicle detection system 100 shown in FIG. 2. This variation enables the user to set the target sound S101.

The vehicle detection system 200 includes a fundamental period analysis unit 201 and the alarm sound output unit 105. The fundamental period analysis unit 201 includes a sound information setting unit 700, a target sound preparation unit 701, the evaluation sound preparation unit 103 and the analysis unit 104.

The analysis unit 104 stores a threshold value S104. The sound information setting unit 700 sets sound information S700 regarding the target sound, and outputs the sound information S700 to the target sound preparation unit 701. The target sound preparation unit 701 prepares the target sound S101 based on sound information S700 and at the same time prepares the fundamental period S105 of the target sound S101, and outputs the target sound S101 and the fundamental period S105 to the analysis unit 104. The evaluation sound preparation unit 103 inputs the evaluation sound S100, and outputs the same to the analysis unit 104. The analysis unit 104 sequentially calculates the differential values of the evaluation sound S100 and the target sound S101 at corresponding points in time, by temporally shifting the target sound S101 with respect to the evaluation sound S100. The analysis unit 104 analyzes whether or not the target sound S101 exists in the evaluation sound S100 based on the period of an iterative time interval of a differential value equal to or lower than the threshold value S104 and the fundamental period S105 of the target sound S101. The analysis unit 104 outputs a detection signal S102 to the alarm sound output unit 105 when the target sound S101 exists in the evaluation sound S100. The alarm sound output unit 105 presents the alarm sound S103 to the user when the detection signal S102 is inputted.

Next, operations of the vehicle detection system 200 configured as above will be described.

Figure 10:
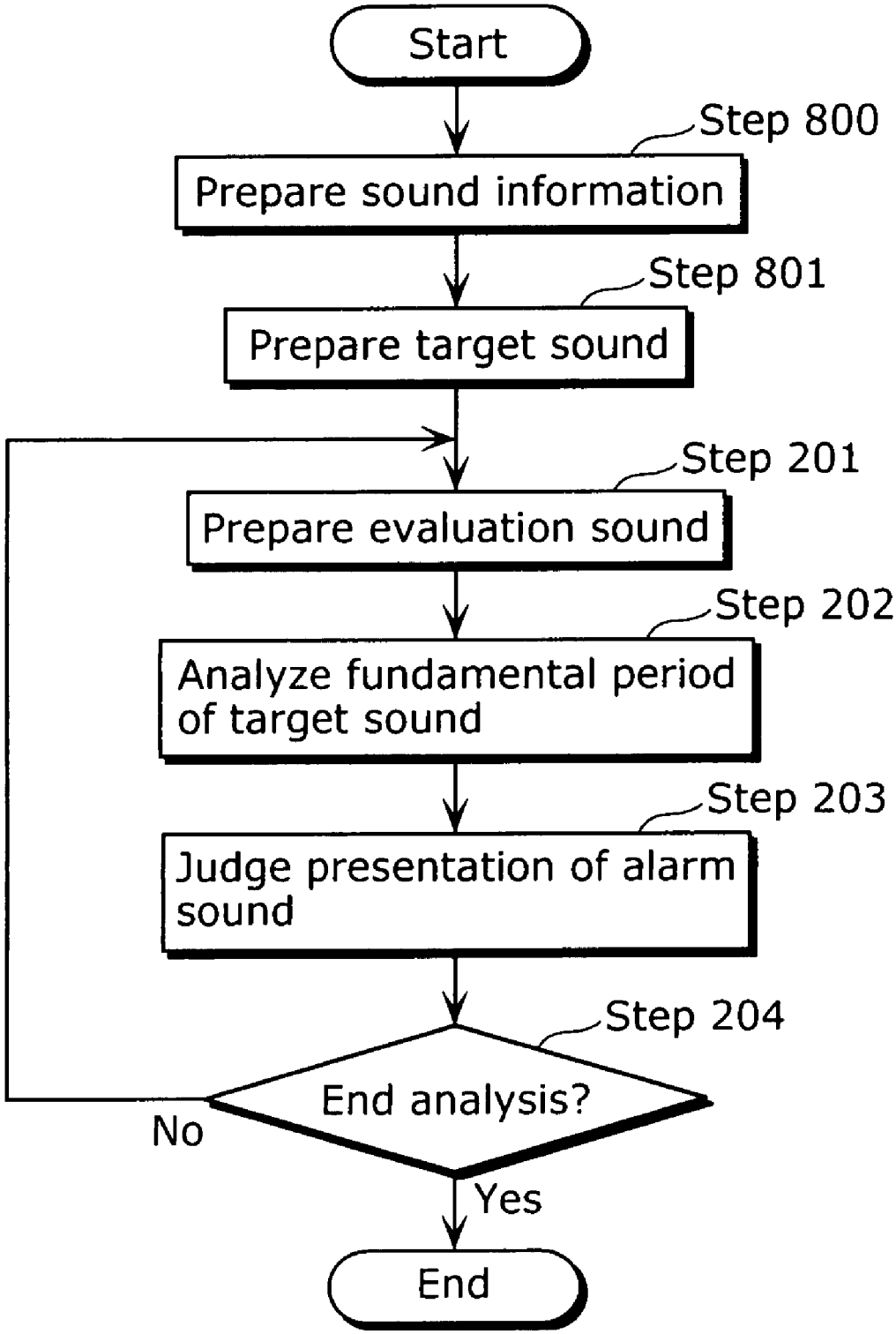
FIG. 10 is a flowchart showing another operational procedure of a vehicle detection system.

FIG. 10 is another flowchart showing an operational procedure of the vehicle detection system 200.

In this example, the threshold value S104 is stored in the analysis unit 104 prior to the shipment of the vehicle detection system 200. The threshold value S104 in this example is set to 0.2, which is a value that is slightly greater than zero.

First, the sound information setting unit 700 uses a microphone to retrieve a motorcycle sound that is sound information S700, and outputs the motorcycle sound to the target sound preparation unit 701 (step 800).

Next, the target sound preparation unit 701 prepares the target sound S101 by clipping a portion of the motorcycle sound that is sound information 5700 (step 801). At the same time, the fundamental period of the motorcycle sound is determined and set as the fundamental period S105. In this example, since the motorcycle sound is the only target sound and no other sounds having the same fundamental period as the motorcycle sound are included, the fundamental period of the motorcycle sound is determined using the method according to the first conventional technique.

Activation of the vehicle detection system 200 causes the evaluation sound preparation unit 103 to start retrieving peripheral sounds of the user, which is an evaluation sound 5100, using a microphone (step 201).

Next, analysis is performed on whether or not the fundamental period of the motorcycle sound that is the target sound S101 prepared by the target sound preparation unit 102 is included in the evaluation sound S100 which includes peripheral sounds of the user (step 202).

Next, judgment is made on whether or not an alarm sound should be presented. When the target sound exists, an alarm sound is outputted (step 203).

Since the steps 201, 202 and 203 are the same as in the first embodiment, descriptions thereof will be omitted.

Finally, the operations of the above-described steps 201 to 203 are repeated until the vehicle detection system 200 is brought to a stop (step 204).

As described above, since the target sound preparation unit 701 sets a target sound inputted by the sound information setting unit as the target sound to be prepared, the target sound preparation unit 701 is no longer required to prepare in advance a plurality of sounds to be used as target sound candidates, and reduction of storage capacity may be achieved.

Alternatively, in step 800, an evaluation sound S100 including the motorcycle sound may be inputted as sound information S700, and in step 801, a target sound S101 may be prepared by clipping the portion of the motorcycle sound from the sound information S700. In this case, the target sound S101 may be prepared even when sounds other than the target sound exist.

Another Example

Another example of the sound information setting unit 700 and the target sound preparation unit 701 will now be described.

FIG. 10 is another flowchart showing an operational procedure of the vehicle detection system 200.

In this example, prior to the shipment of the vehicle detection system 200, a motorcycle sound, an engine sound of an automobile and a siren sound are stored as target sound candidates in the target sound preparation unit 701. In addition, a fundamental period corresponding to each target sound candidate is stored in the target sound preparation unit 701. Furthermore, the threshold value S104 is stored in the analysis unit 104.

Figure 11:
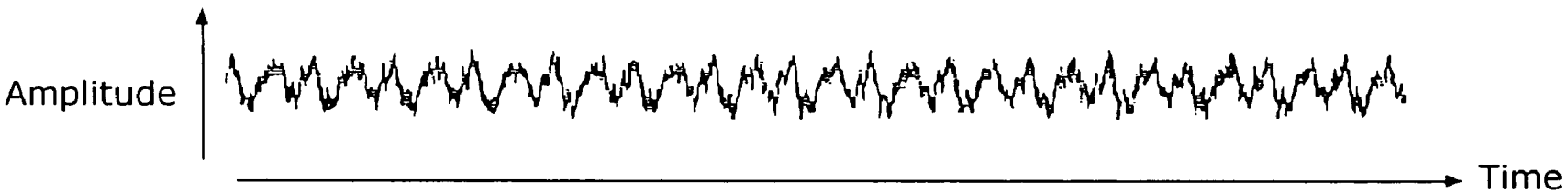
FIG. 11 is a diagram showing an example of an engine sound of an automobile.
Figure 12:
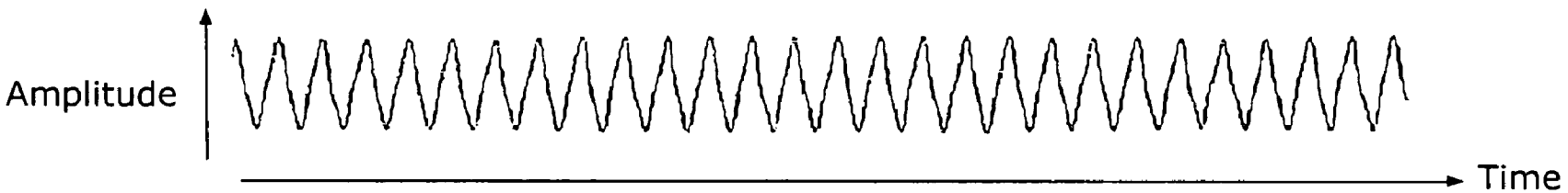
FIG. 12 is a diagram showing an example of a siren sound.

An example of an engine sound of an automobile is shown in FIG. 11. In addition, an example of a siren sound of an emergency vehicle is shown in FIG. 12. These diagrams show that the engine sound of an automobile and the siren sound are periodic sounds.

Figure 13:
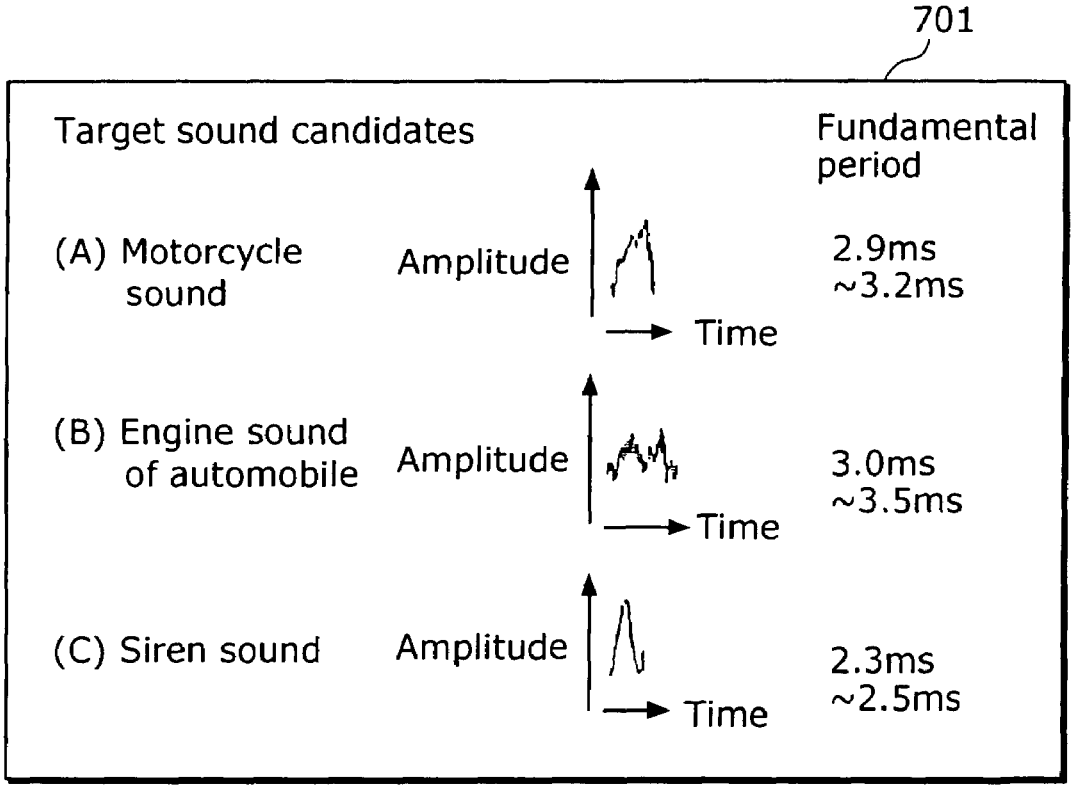
FIG. 13 is a diagram showing an example of a target sound preparation unit.

Examples of target sound candidates are shown in FIG. 13. In this example, the target sound preparation unit 701 stores three types of target sounds, namely, a "motorcycle sound", an "engine sound of an automobile" and a "siren sound", as target sound candidates. A fundamental period corresponding to each target sound candidate is also stored.

Figure 14B:
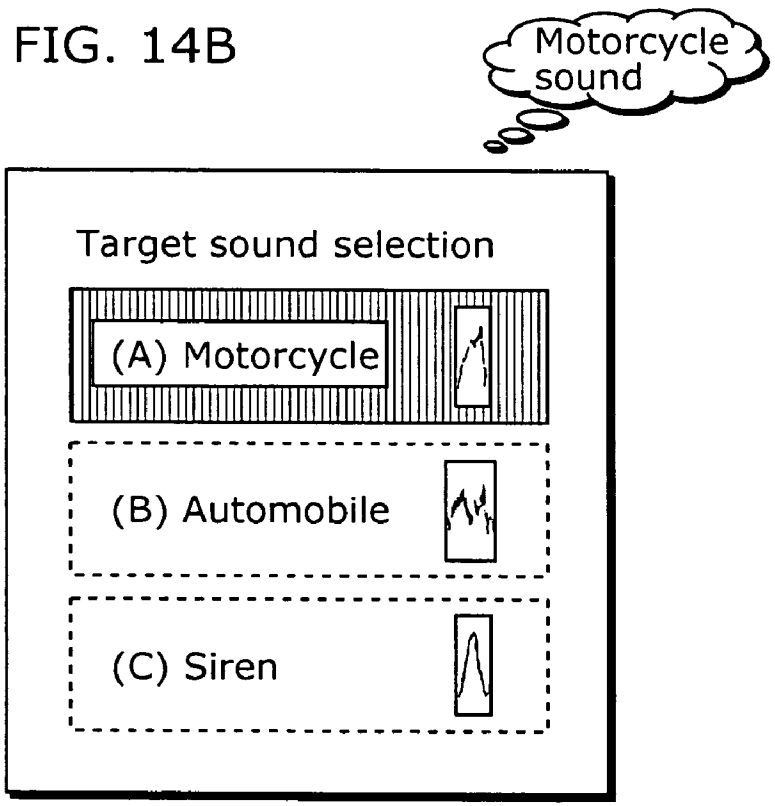
FIG. 14B is a diagram showing an example of target sound selection using a touch display.
Figure 14A:
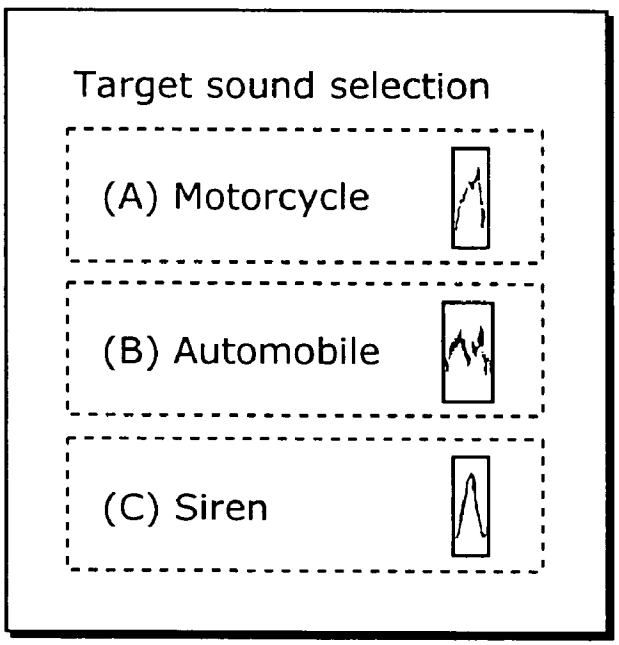
FIG. 14A is a diagram showing an example of target sound selection using a touch display.

First, the sound information setting unit 700 presents the target sound candidates to the user. FIGS. 14A and 14B show an example of a presentation method of target sound candidates. In this example, names (motorcycle, automobile, siren) and waveform patterns of the target sounds are presented on a touch display such as shown in FIG. 14A. The user creates a selection signal that is sound information S700 by using the touch display to select a target sound. In this example, as shown in FIG. 14B, the motorcycle sound has been selected and the periphery of "motorcycle" is highlighted on the display. At this point, the sound of the selected motorcycle sound is outputted from a speaker. This enables the user to verify the selected target sound (step 800).

Next, the target sound preparation unit 701 sets a target sound corresponding to the selection signal that is the sound information S700 as the target sound S101 (step 801). In addition, the fundamental period of the target sound corresponding to the selection signal is set as the fundamental period S105. In this example, the target sound S101 is the motorcycle sound and the fundamental period S105 is 2.9-3.2 ms, which is the fundamental period of the motorcycle sound.

Activation of the vehicle detection system 100 causes the evaluation sound preparation unit 103 to start retrieving peripheral sounds of the user, which is the evaluation sound S100, using a microphone (step 201).

Next, analysis is performed on whether or not the fundamental period of the motorcycle sound that is the target sound S101 prepared by the target sound preparation unit 102 is included in the evaluation sound S100 which includes peripheral sounds of the user (step 202).

Next, judgment is made on whether or not an alarm sound should be presented. When a target sound exists, an alarm sound is outputted (step 203).

Since the steps 201, 202 and 203 are the same as in the first embodiment, descriptions thereof will be omitted.

Finally, the operations of the above-described steps 201 to 203 are repeated until the vehicle detection system 200 is brought to a stop (step 204).

As described above, since a target sound may be prepared using target sound candidates stored in the target sound preparation unit 701, there is no need to input a target sound. As a result, a target sound may be analyzed even when a target sound cannot be inputted. For instance, when the existence of a motorcycle sound in ambient noise is analyzed, while it will be impossible to pick up a motorcycle sound in a quiet environment in ambient noise, the existence of the motorcycle sound may be analyzed by using the motorcycle sound in a quiet environment stored in the target sound preparation unit 701. In addition, since the time required for inputting a target sound may be omitted, real time processing may be achieved.

As described above, according to the first variation of the first embodiment of the present invention, since the target sound preparation unit 701 prepares a target sound based on sound information set by the sound information setting unit 700, the target sound to be prepared by the target sound preparation unit 701 may be controlled. As a result, a user is now capable of setting a target sound using the sound information setting unit 700.

Second Variation of the First Embodiment

Figure 15:
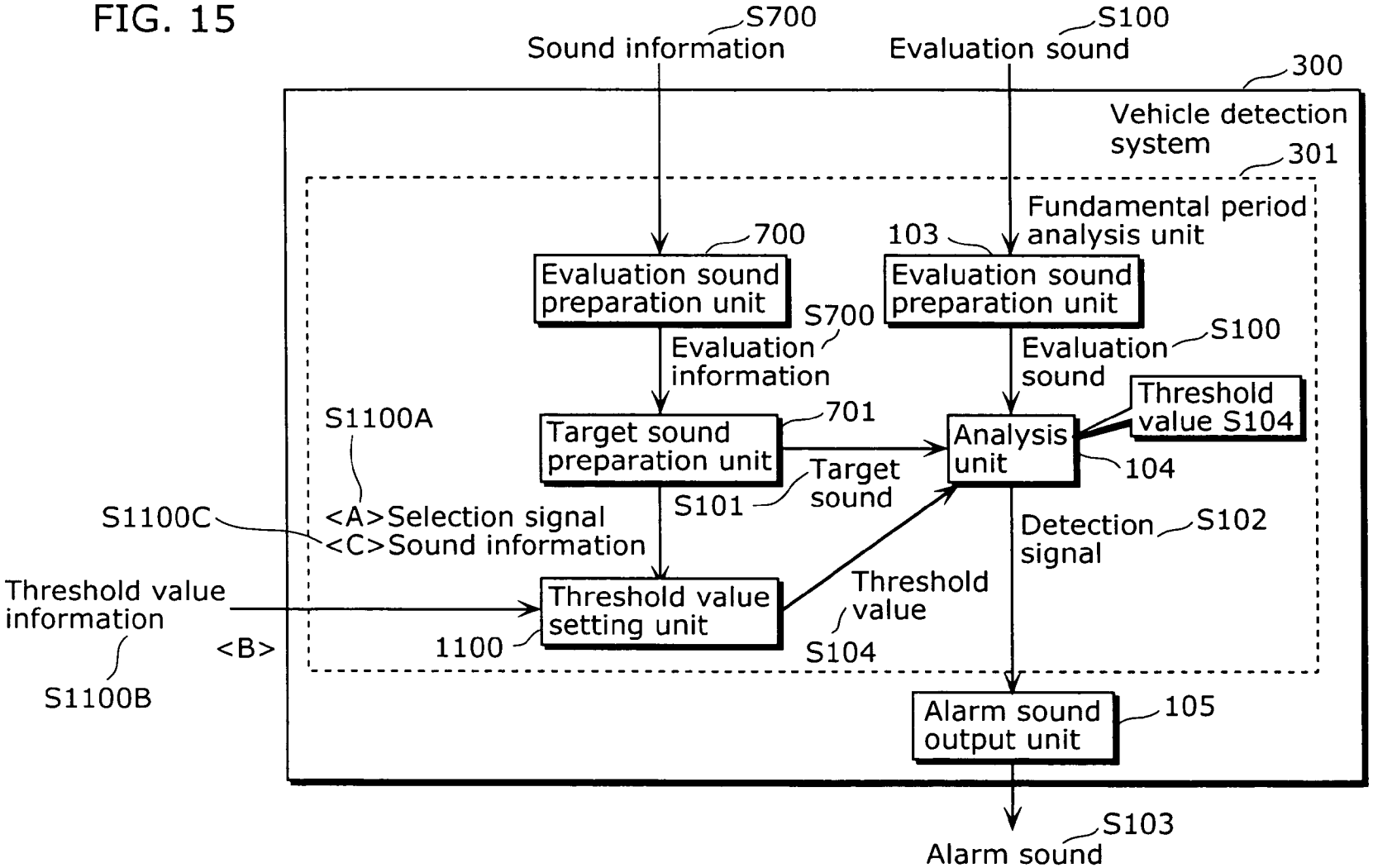
FIG. 15 is a block diagram showing an overall configuration of a target sound analysis apparatus according to a second variation of the first embodiment.

A second variation of the first embodiment will now be described. FIG. 15 is a block diagram showing an overall configuration of a target sound analysis apparatus according to the second variation of the first embodiment of the present invention. In this case, a threshold value setting unit 1100 has been added to the vehicle detection system 200 shown in FIG. 9. The threshold value setting unit 1100 is an example of a threshold value setting unit operable to sequentially calculate differential values of the evaluation sound and the target sound for corresponding points in time, by temporally shifting a target sound with respect to a plurality of evaluation sounds, calculate a minimum value among the differential values, and set a predetermined threshold value based on a maximum value of the plurality of minimum values corresponding to the plurality of evaluation sounds.

A vehicle detection system 300 includes a fundamental period analysis unit 301 and the alarm sound output unit 105.

The fundamental period analysis unit 301 includes a threshold value setting unit 1100, the sound information setting unit 700, the target sound preparation unit 701, the evaluation sound preparation unit 103 and the analysis unit 104.

A method will now be described in which the threshold value setting unit 1100 sets a threshold value based on a target sound prepared by the target sound preparation unit 701. In this example, the threshold value setting unit 1100 uses a "selection signal S1100A" shown in FIG. 15 to set the threshold value S104. Note that "threshold value information 1100B" and "sound information S1100C" shown in FIG. 15 are not used.

In this example, prior to the shipment of the vehicle detection system, a "motorcycle sound", an "engine sound of an automobile" and a "siren sound" are stored as target sound candidates in the target sound preparation unit 701. In addition, a fundamental period corresponding to each target sound candidate is stored in the target sound preparation unit 701. Furthermore, a threshold value corresponding to each target sound candidate stored in the target sound preparation unit 701 is stored in the threshold value setting unit 1100. In this case, a "threshold value of the motorcycle sound", a "threshold value of the engine sound of an automobile" and a "threshold value of the siren sound" are stored. These threshold values are respectively set for each target sound candidate to a value that is slightly greater than the maximum value of a variation due to the fluctuation of the minimum value of differential values in consideration of the fluctuation width of the fundamental waveform pattern of the target sound candidate.

Figure 16A:
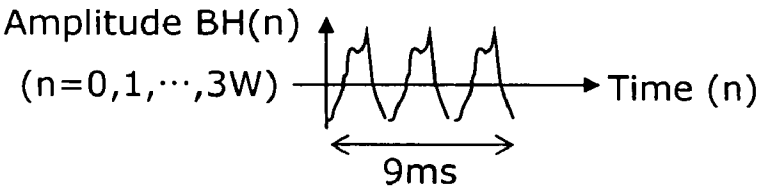
FIG. 16A is a diagram showing an example of a method of setting threshold values.
Figure 16B:
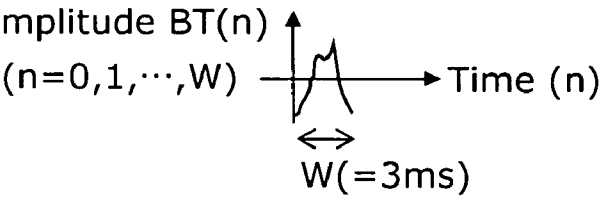
FIG. 16B is a diagram showing an example of a method of setting threshold values.
Figure 16C:
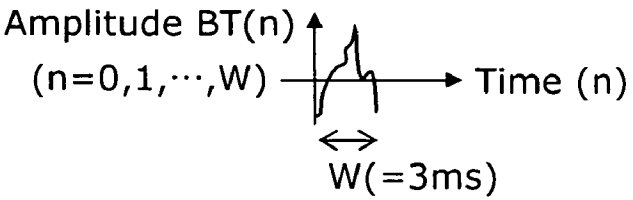
FIG. 16C is a diagram showing an example of a method of setting threshold values.
Figure 16D:
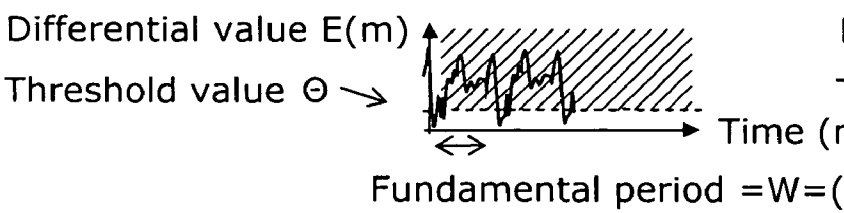
FIG. 16D is a diagram showing an example of a method of setting threshold values.
Figure 16E:
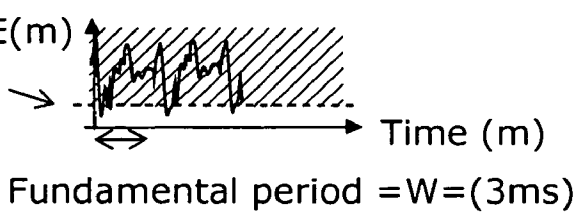
FIG. 16E is a diagram showing an example of a method of setting threshold values.

A threshold value setting method is shown in FIGS. 16A to 16E. FIG. 16A shows a fundamental waveform pattern of a motorcycle sound A corresponding to three periods. FIG. 16B shows a fundamental waveform pattern of a motorcycle sound B. FIG. 16C shows a fundamental waveform pattern of a motorcycle sound C. Fluctuations due to the influence of driving conditions have occurred in the fundamental waveform patterns of the motorcycle sounds A, B and C. FIG. 16D shows differential values between the motorcycle sound A (corresponding to an evaluation sound) and the motorcycle sound B (corresponding to a target sound) determined in the same manner as in the first embodiment. In addition, FIG. 16E shows differential values between the motorcycle sound A (corresponding to the evaluation sound) and the motorcycle sound C (corresponding to a target sound) determined in the same manner as in the first embodiment. From FIGS. 16D and 16E, since the shapes of the waveform patterns differ slightly between the motorcycle sound A and the motorcycle sound B as well as between the motorcycle sound A and the motorcycle sound C, the minimum values of the differential values will take values that are slightly greater than zero. Here, since the motorcycle sound B and the motorcycle sound C are both motorcycle sounds that are the target sound, a value that is slightly greater than whichever is the greater of the minimum value of the differential values of the motorcycle sound A and the motorcycle sound B and the minimum value of the differential values of the motorcycle sound A and the motorcycle sound C is set as a threshold value Θ. In this example, the minimum value of the differential values of the motorcycle sound A and the motorcycle sound C is greater than the minimum value of the differential values of the motorcycle sound A and the motorcycle sound B. Therefore, the threshold value is set to a value that is slightly greater than the minimum value of the differential values of the motorcycle sound A and the motorcycle sound C.

The sound information setting unit 700 sets sound information S700 regarding the target sound, and outputs the sound information S700 to the target sound preparation unit 701. The target sound preparation unit 701 prepares the target sound S101 based on the sound information S700 and at the same time prepares the fundamental period S105 of the target sound S101, and outputs the target sound S101 and the fundamental period S105 to the analysis unit 104. The threshold value setting unit 1100 sets the threshold value S104 based on the target sound S101 prepared by the target sound preparation unit 701. The evaluation sound preparation unit 103 inputs the evaluation sound S100, and outputs the same to the analysis unit 104. The analysis unit 104 sequentially calculates the differential values of the evaluation sound S100 and the target sound S101 at corresponding points in time, by temporally shifting the target sound S101 with respect to the evaluation sound S100. The analysis unit 104 analyzes whether or not the target sound S101 exists in the evaluation sound S100 based on the period of an iterative time interval of a differential value equal to or lower than the threshold value S104 and the fundamental period S105 of the target sound S101. The analysis unit 104 outputs a detection signal S102 to the alarm sound output unit 105 when the target sound S101 exists in the evaluation sound S100. The alarm sound output unit 105 presents the alarm sound S103 to the user when the detection signal S102 is inputted.

Next, operations of the vehicle detection system 300 configured as above will be described.

Figure 17:
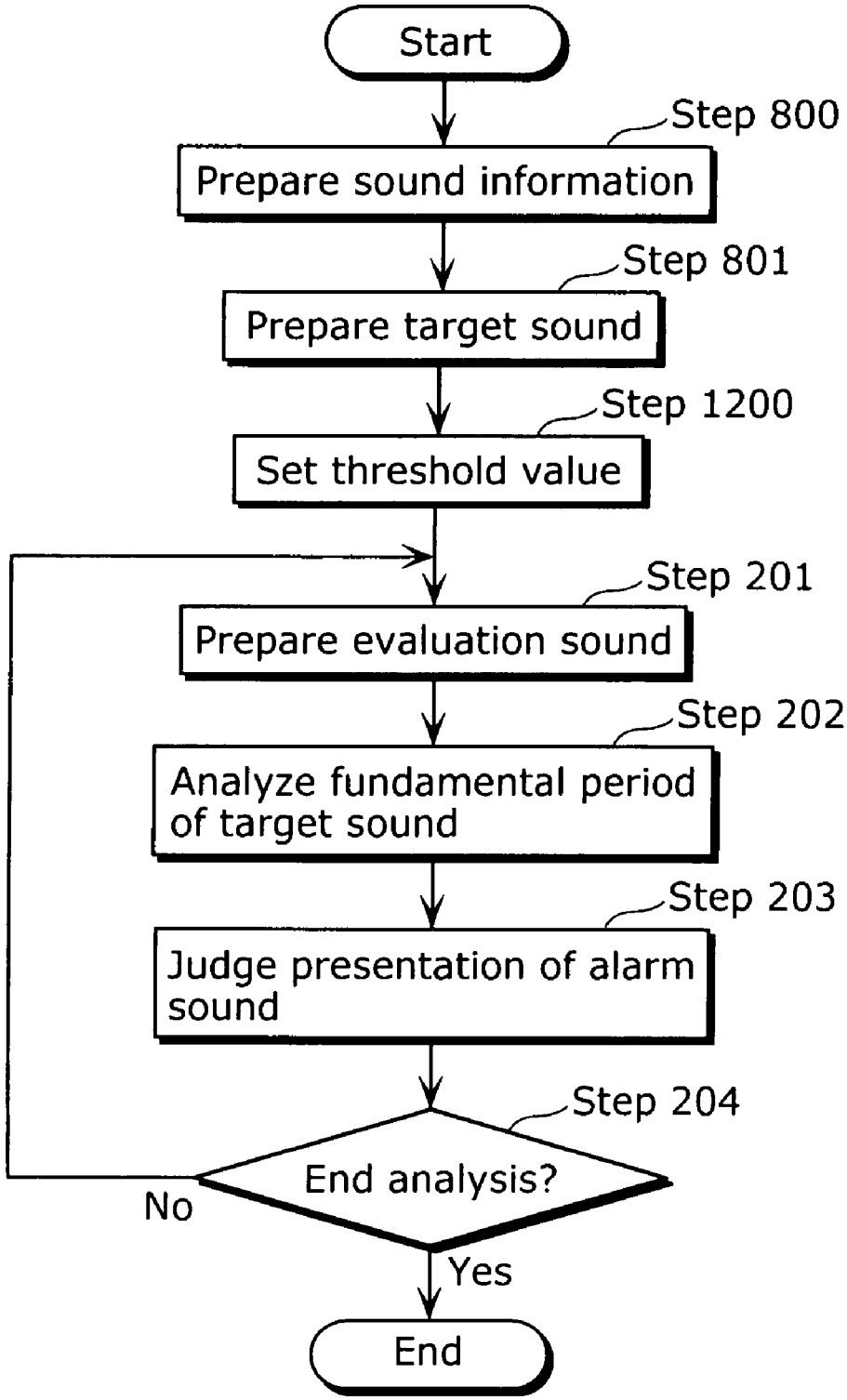
FIG. 17 is a flowchart showing yet another operational procedure of a vehicle detection system.

FIG. 17 is a flowchart showing an operational procedure of the vehicle detection system 300.

In this example, the sound information setting unit 700 presents target sound candidates to the user to have the user select a target sound, and creates a selection signal (step 800). In this example, a motorcycle sound is selected.

Next, the target sound preparation unit 701 sets a target sound corresponding to the selection signal S1100A that is the sound information S700 as the target sound S101 (step 801). In this example, the motorcycle sound is selected as the target sound S101. In addition, the fundamental period of the target sound S101 corresponding to the selection signal S1100A is set as the fundamental period S105. In this example, the fundamental period S105 is 2.9-3.2 ms, which is the fundamental period of the motorcycle sound.

Since the steps 800 and 801 are the same as in the first embodiment, descriptions thereof will be omitted.

Next, the threshold value setting unit 1100 sets a threshold value corresponding to the target sound S101 prepared by the target sound preparation unit 701 from the threshold values stored in the threshold value setting unit 1100 as the threshold value S104. In this example, since the motorcycle sound is selected as the target sound, a threshold value corresponding to the motorcycle sound is set as the threshold value S104 (step 1200).

Activation of the vehicle detection system 300 causes the evaluation sound preparation unit 103 to start retrieving peripheral sounds of the user, which is the evaluation sound S100, using a microphone (step 201).

Next, analysis is performed on whether or not the fundamental period of the motorcycle sound that is the target sound S101 prepared by the target sound preparation unit 102 is included in the evaluation sound S100 which includes peripheral sounds of the user (step 202).

Next, judgment is made on whether or not an alarm sound should be presented. When a target sound exists, an alarm sound is outputted (step 203).

Since the steps 201, 202 and 203 are the same as in the first embodiment, descriptions thereof will be omitted.

Finally, the operations of the above-described steps 201 to 203 are repeated until the vehicle detection system 300 is brought to a stop (step 204).

As described above, since the analysis unit 104 is capable of analyzing a fundamental period using a threshold value corresponding to a target sound, it is now possible to switch among target sounds on which analysis of its existence is performed.

Yet Another Example

A method will now be described in which the user uses the threshold value setting unit 1100 to set a threshold value. In this example, the threshold value setting unit 1100 uses the "threshold value information S1100B" shown in FIG. 15 to set the threshold value S104. Note that the "selection signal A1100A" and the "sound information S1100C" shown in FIG. 15 are not used.

In this example, prior to the shipment of the vehicle detection system 300, a "motorcycle sound", an "engine sound of an automobile" and a "siren sound" are stored as target sound candidates in the target sound preparation unit 701. In addition, a fundamental period corresponding to each target sound candidate is stored in the target sound preparation unit 701. Furthermore, the threshold value S104 is stored in the analysis unit 104. The threshold value is set to a value that is slightly greater than the maximum value of a variation due to the fluctuation of the minimum value of differential values in consideration of the fluctuation width of the fundamental waveform patterns of all sounds in the target sound candidate.

The sound information setting unit 700 sets sound information S700 regarding the target sound, and outputs the sound information S700 to the target sound preparation unit 701. The target sound preparation unit 701 prepares the target sound S101 based on the sound information S700 and at the same time prepares the fundamental period S105 of the target sound S101, and outputs the target sound S101 and the fundamental period S105 to the analysis unit 104. The threshold value setting unit 1100 sets the threshold value S104 based on the threshold value information S1100B inputted by the user. The evaluation sound preparation unit 103 inputs the evaluation sound S100, and outputs the same to the analysis unit 104. The analysis unit 104 sequentially calculates the differential values of the evaluation sound S100 and the target sound S101 at corresponding points in time, by temporally shifting the target sound S101 with respect to the evaluation sound S100. The analysis unit 104 judges whether or not the target sound S101 exists in the evaluation sound S100 based on the period of an iterative time interval of a differential value equal to or lower than the threshold value S104 and the fundamental period S105 of the target sound S101. When the analysis unit judges that the target sound S101 exists, the analysis unit 104 outputs a detection signal S102 to the alarm sound output unit 105. The alarm sound output unit 105 presents the alarm sound S103 to the user when the detection signal S102 is inputted.

Next, operations of the vehicle detection system 300 configured as above will be described.

FIG. 17 is a flowchart showing an operational procedure of the vehicle detection system 300.

First, the sound information setting unit 700 presents target sound candidates to the user to have the user select a target sound, and creates a selection signal (step 800). In this example, a motorcycle sound is selected.

Next, the target sound preparation unit 701 sets a target sound corresponding to the selection signal that is the sound information S700 as the target sound S101 (step 801). In this example, the motorcycle sound is selected as the target sound S101.

Since the steps 800 and 801 are the same as in the other example of the first variation according to the first embodiment, descriptions thereof will be omitted.

The threshold value setting unit 1100 then sets the value of the threshold value that is the threshold value information S1100B inputted by the user as the threshold value S104 (step 1200). As an alternative method, a threshold value stored in the analysis unit 104 may be adjusted in accordance with an increase/decrease in the threshold value that is the threshold value information S1100B inputted by the user, and set as the threshold value S104.

Figure 18B:
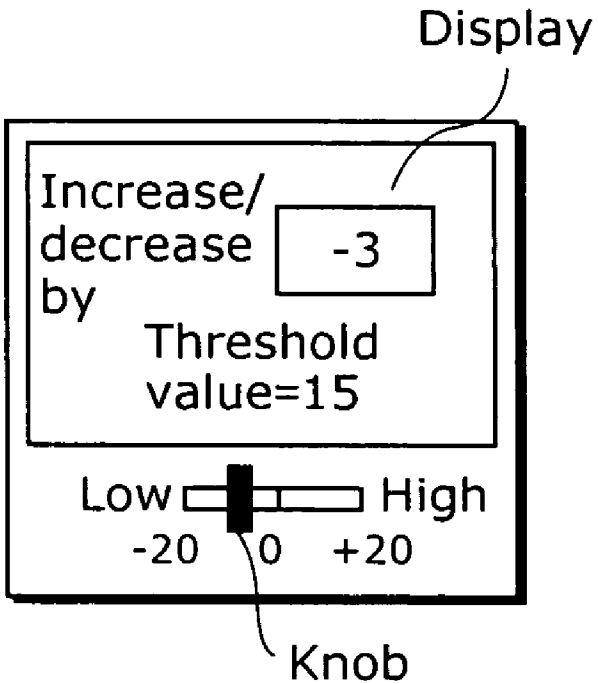
FIG. 18B is a diagram showing an example of a method of inputting threshold values.
Figure 18A:
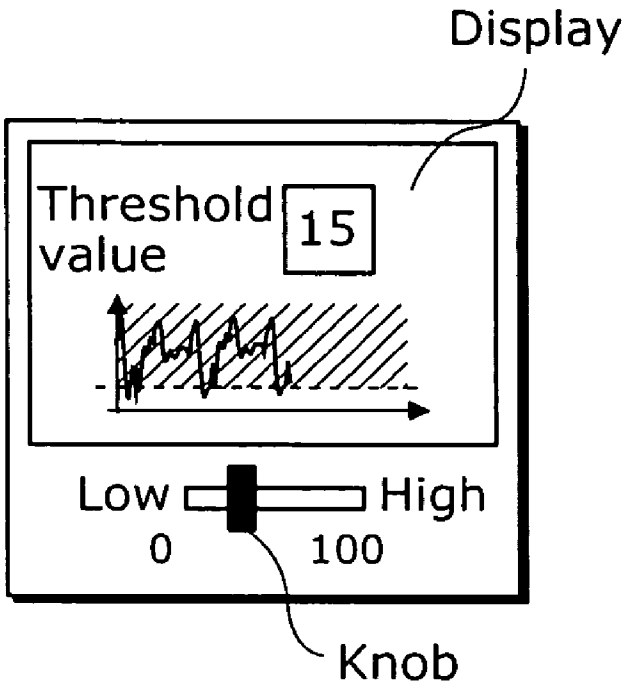
FIG. 18A is a diagram showing an example of a method of inputting threshold values.

FIGS. 18A and 18B show an example of a method in which the user inputs threshold value information. FIG. 18A shows a method in which the user inputs a threshold value. The user inputs a threshold value by operating a knob. At this point, differential values between representative target sounds, as well as the threshold value currently being set are shown on the display. In other words, moving the knob left and right changes the value of the threshold value currently being set and moves the line of the threshold value shown on the screen up and down. This makes it easier for the user to intuitively set the value of a threshold value. FIG. 18B shows a method of inputting an increase/decrease of the threshold value from a stored threshold value. The user inputs an increase/decrease of the threshold value by operating the knob. If a stored threshold value may be represented by $\Theta 0$ and the increase/decrease of the threshold value by $\Delta\Theta$, the threshold value S104 may be expressed as $\Theta 0+\Delta\Theta$. A value displayed on the display allows the user to verify the increase/decrease of the threshold value and the threshold value.

Activation of the vehicle detection system 300 causes the evaluation sound preparation unit 103 to start retrieving peripheral sounds of the user, which is the evaluation sound S100, using a microphone (step 201).

Next, analysis is performed on whether or not the motorcycle sound that is the target sound 5101 prepared by the target sound preparation unit 102 is included in the evaluation sound 5100 which includes peripheral sounds of the user (step 202).

Next, judgment is made on whether or not an alarm sound should be presented. When a target sound exists, an alarm sound is outputted (step 203).

Since the steps 201, 202 and 203 are the same as in the first embodiment, descriptions thereof will be omitted.

Finally, the operations of the above-described steps 201 to 203 are repeated until the vehicle detection system 300 is brought to a stop (step 204).

As described above, a user may now set an appropriate threshold value for a target sound using the threshold value setting unit 1100. As a result, analytical errors may be reduced.

Still Yet Another Example

A method will now be described in which the threshold value setting unit 1100 sets a threshold value based on the fluctuation width of the fundamental waveform pattern of the target sound S101 prepared by the target sound preparation unit 701. In this example, the threshold value setting unit 1100 uses "sound information S1100C" shown in FIG. 15 to set the threshold value S104. Note that the "selection signal 1100A" and the "threshold value information S1100B" shown in FIG. 15 are not used.

The sound information setting unit 700 outputs a sound that includes a target sound that is the sound information S700 regarding the target sound to the target sound preparation unit 701. The target sound preparation unit 701 prepares the target sound S101 based on the sound information S700 and at the same time prepares the fundamental period S105 of the target sound S101, and outputs the target sound S101 and the fundamental period S105 to the analysis unit 104. The threshold value setting unit 1100 sets a threshold value based on the fluctuation width of the fundamental waveform pattern of the target sound S101 prepared by the target sound preparation unit 701. The evaluation sound preparation unit 103 inputs the evaluation sound S100, and outputs the same to the analysis unit 104. The analysis unit 104 sequentially calculates the differential values of the evaluation sound S100 and the target sound S101 at corresponding points in time, by temporally shifting the target sound S101 with respect to the evaluation sound S100. The analysis unit 104 analyzes whether or not the target sound S101 exists in the evaluation sound S100 based on the period of an iterative time interval of a differential value equal to or lower than the threshold value S104 and the fundamental period S105 of the target sound S101. The analysis unit 104 outputs a detection signal S102 to the alarm sound output unit 105 when the target sound S101 exists in the evaluation sound S100. The alarm sound output unit 105 presents the alarm sound S103 to the user when the detection signal S102 is inputted.

Next, operations of the vehicle detection system 300 configured as above will be described.

FIG. 17 is a flowchart showing an operational procedure of the vehicle detection system 300.

First, the sound information setting unit 700 uses a microphone to retrieve a motorcycle sound that is sound information S700, and outputs the motorcycle sound to the target sound preparation unit 701 (step 800).

Next, the target sound preparation unit 701 prepares the target sound S101 by clipping a portion of the motorcycle sound that is the sound information S700 (step 801). At the same time, the fundamental period of the motorcycle sound is determined and set as the fundamental period S105. In this example, since the motorcycle sound is the only target sound and no other sounds having the same fundamental period as the motorcycle sound are included, the fundamental period of the motorcycle sound is determined using the method according to the first conventional technique.

Since the steps 800 and 801 are the same as in the first variation according to the first embodiment, descriptions thereof will be omitted.

Next, for the target sound S101, the threshold value setting unit 1100 inputs the motorcycle sound that is the sound information S700 as the sound information S1100C, and in consideration of the fluctuation width of the fundamental waveform pattern of the motorcycle sound, sets the threshold value S104 as a value that is slightly greater than the maximum value of a variation due to the fluctuation of the minimum value of the differential values (step 1200). In other words, the threshold value S104 is set in consideration of the fluctuation width of the fundamental waveform pattern of the target sound S101. In this example, the threshold value S104 is set using the same method as shown in FIGS. 16A to 16E.

Activation of the vehicle detection system 300 causes the evaluation sound preparation unit 103 to start retrieving peripheral sounds of the user, which is the evaluation sound S100, using a microphone (step 201).

Next, analysis is performed on whether or not the fundamental period of the motorcycle sound that is the target sound S101 stored in the target sound preparation unit 102 is included in the evaluation sound S100 which includes peripheral sounds of the user (step 202).

Next, judgment is made on whether or not an alarm sound should be presented. When a target sound exists, an alarm sound is outputted (step 203).

Since the steps 201, 202 and 203 are the same as in the first embodiment, descriptions thereof will be omitted.

Finally, the operations of the above-described steps 201 to 203 are repeated until the vehicle detection system 300 is brought to a stop (step 204).

As described above, since the threshold value setting unit 1100 is capable of automatically determining a threshold value that is appropriate for a target sound, there is no need to prepare a threshold value in advance. As a result, when target sounds to be analyzed are added, the user will not be required to set threshold values for the added target sounds, and improved usability may be achieved.

As described above, according to the second variation of the first embodiment of the present invention, it is now possible to control the threshold value to be used by the analysis unit 104 using the threshold value setting unit 1100. Therefore, appropriate threshold values may be set for a plurality of target sounds and an analysis on whether or not a target sound exists may be respectively performed for the plurality of target sounds. In addition, analytical errors on whether or not a target sound exists may be reduced by appropriately controlling the threshold values.

Another method of analyzing the existence of a target sound by the analysis unit will be supplemented below. In this example, a method will be described in which the existence of a target sound is analyzed by clipping a portion of an evaluation sound and using the clipped portion as the target sound, and determining a fundamental period of the evaluation sound. In this case, the fundamental period of the target sound has not been stored in the fundamental period analysis unit.

Figure 19A:
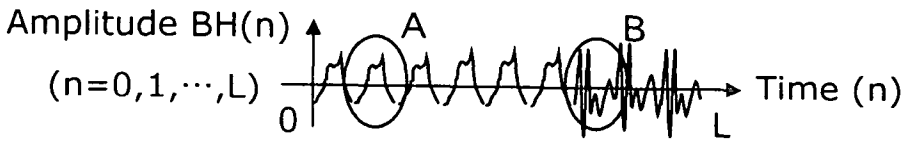
FIG. 19A is a diagram showing an example of a method of analyzing a fundamental period.
Figure 19B:
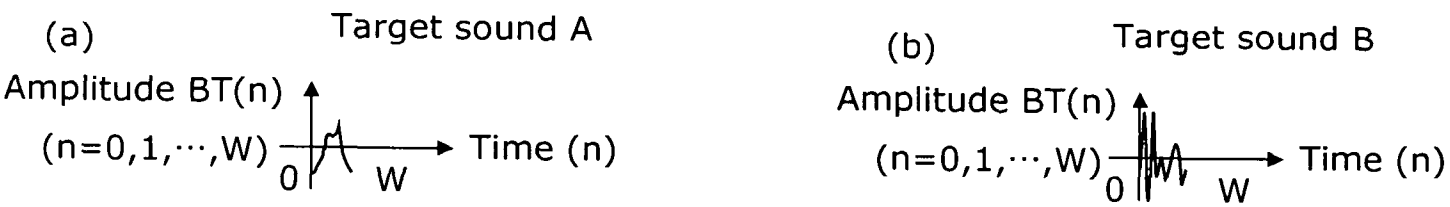
FIG. 19B is a diagram showing an example of a method of analyzing a fundamental period.
Figure 19C:
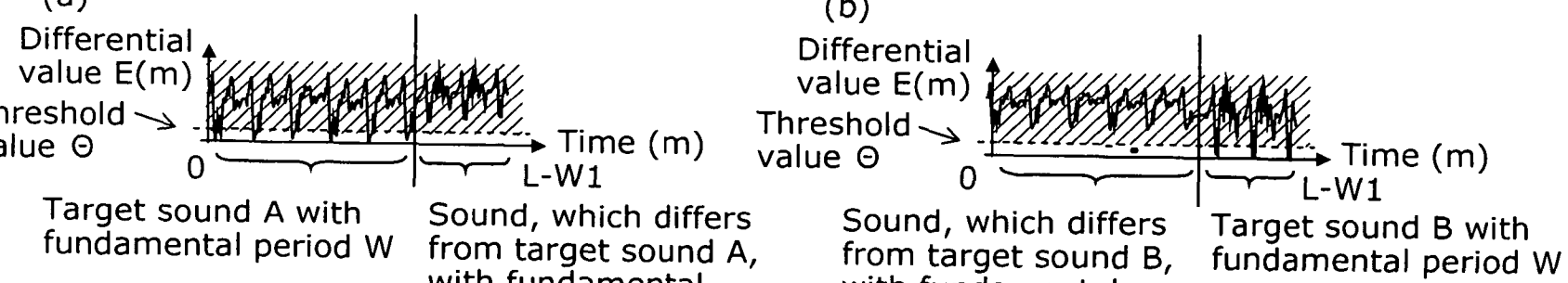
FIG. 19C is a diagram showing an example of a method of analyzing a fundamental period.

A fundamental period analysis method according to this example is shown in FIG. 19A to 19C. FIG. 19A shows an evaluation sound which includes two types of sounds having the same fundamental period. FIG. 19B shows an example of a target sound clipped from the evaluation sound. FIG. 19B(a) shows a target sound A created by clipping a portion denoted as A in FIG. 19A, while FIG. 19B(b) shows a target sound B created by clipping a portion denoted as B in FIG. 19A. The target sounds are waveform patterns respectively corresponding to one period of sounds of different types.

Differential values between the evaluation sound and the target sound A are determined in the same manner as in the first embodiment. In addition, differential value between the evaluation sound and the target sound B are determined in the same manner as in the first embodiment. The determined differential values are shown in FIG. 19C. FIG. 19C(a) represents differential values when the target sound A is used. In addition, FIG. 19C(b) represents differential value when the target sound B is used. From FIG. 19C(a), since a fundamental period appears only during a time interval in which the target sound A is included, it may be analyzed that the target sound A exists during that time interval and that the fundamental period of the target sound A is W. Similarly, from FIG. 19C(b), since a fundamental period appears only during a time interval in which the target sound B is included, it may be analyzed that the target sound B exists during that time interval and that the fundamental period of the target sound B is W. By combining these two results, it is revealed that the evaluation sound includes two types of sounds and that the fundamental periods of these sounds are W. The point in time at which the two types of sounds switch over also revealed.

Second Embodiment

Figure 20:
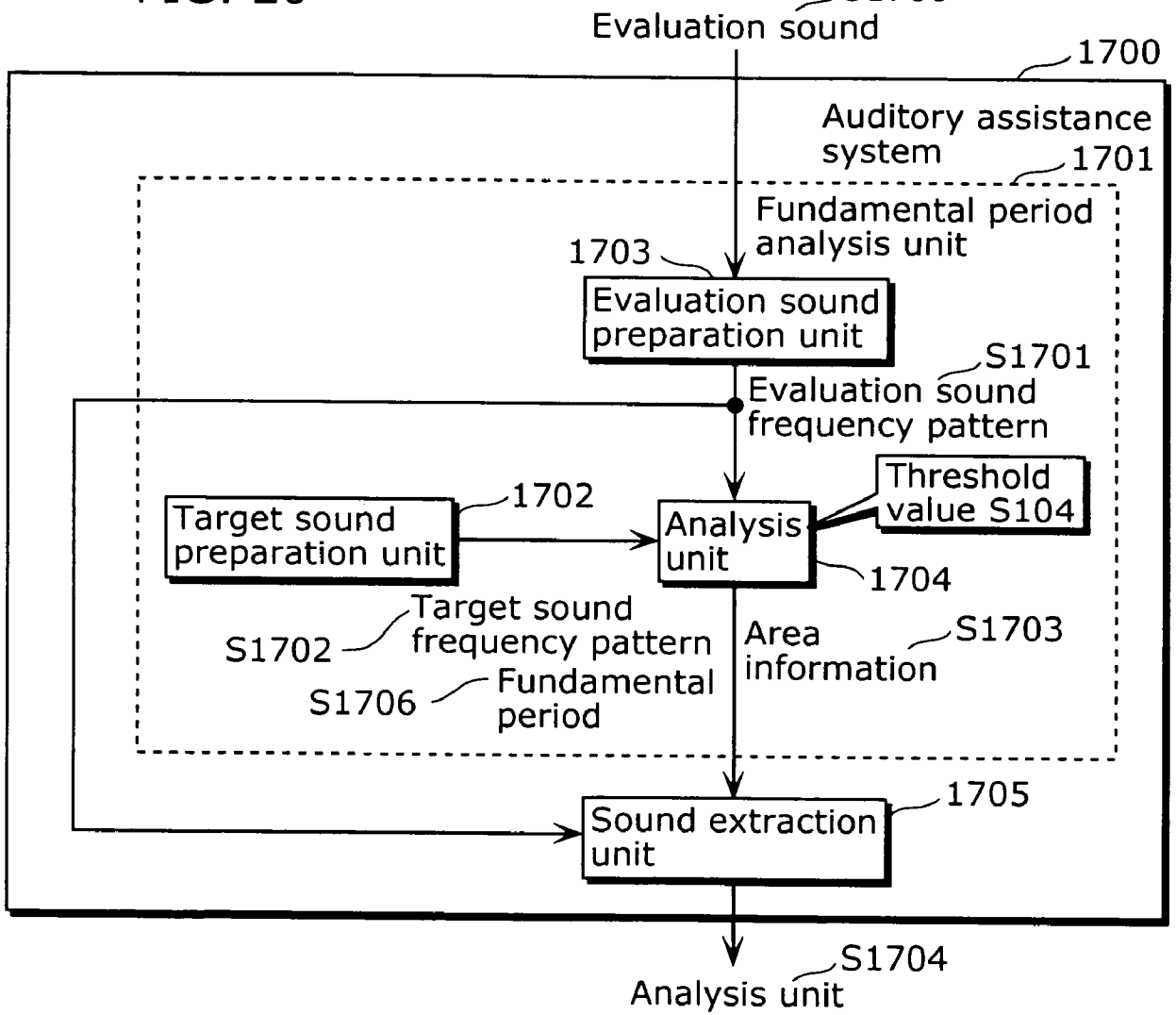
FIG. 20 is a block diagram showing an overall configuration of a target sound analysis apparatus according to a second embodiment.

FIG. 20 is a block diagram showing an overall configuration of a target sound analysis apparatus according to a second embodiment of the present invention. In this case, an example is shown in which the target sound analysis apparatus is incorporated into an auditory assistance system. The present embodiment will be described using, as an example, a case where a voice of a specific speaker is extracted from a mixed sound in which three speakers are simultaneously speaking by analyzing fundamental periods of voice. For this example, a method will be described in which a fundamental period of a target sound is analyzed on a per-frequency band basis in order to judge the existence of the target sound.

Figure 21A:
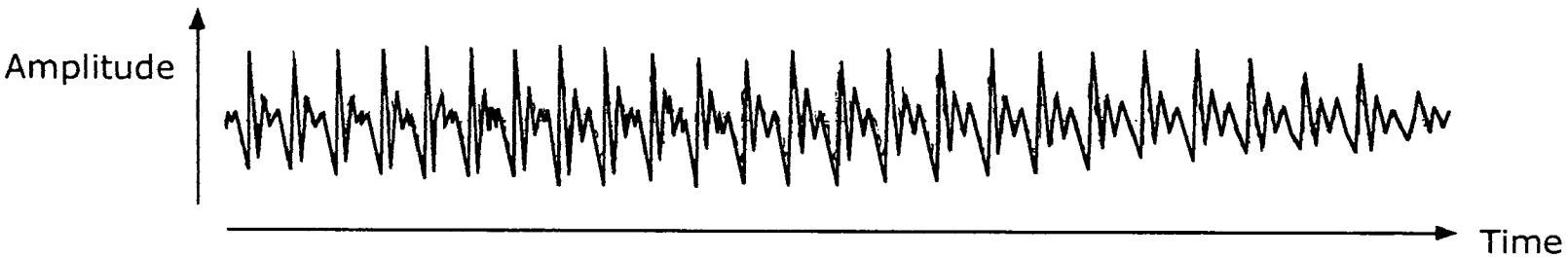
FIG. 21A is a diagram showing an example of voices of speaker A.
Figure 21B:
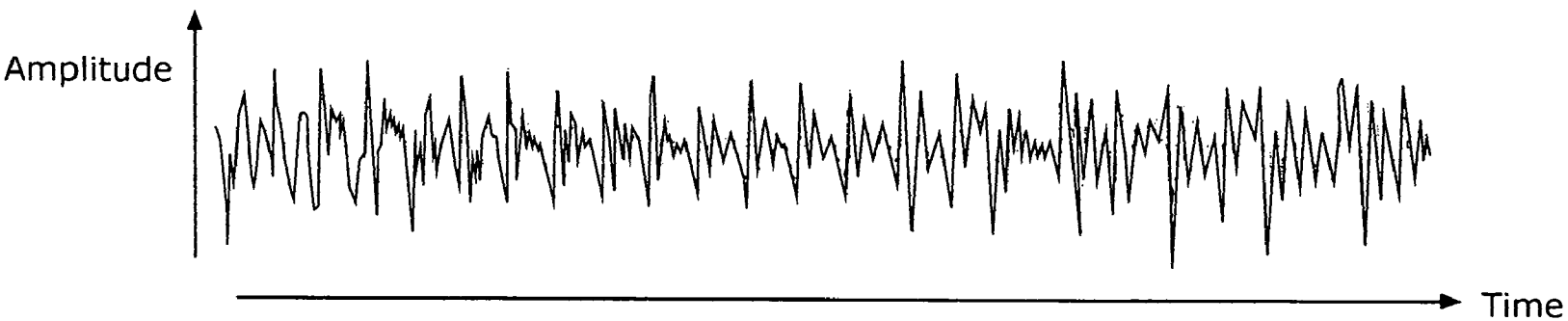
FIG. 21B is a diagram showing an example of a mixed sound of the voices of three speakers including speaker A.

FIGS. 21A and 21B respectively show a waveform pattern of a voice of a speaker A and a waveform pattern of a mixed sound in which voices of three speakers including the speaker A are mixed. From, FIG. 21A, it is found that the voice of the speaker A is a periodic sound. In addition, the voices of the speakers other than the speaker A are also periodic sounds. In this example, a case will be described in which the voice of the speaker A shown in FIG. 21A is extracted from the mixed sound in which voices of three speakers shown in FIG. 21B and only the voice of the speaker A is presented to a user.

An auditory assistance system 1700 includes a fundamental period analysis unit 1701 and a sound extraction unit 1705. The fundamental period analysis unit 1701 includes a target sound preparation unit 1702, an evaluation sound preparation unit 1703 and the analysis unit 104.

The target sound preparation unit 1702 stores a target sound frequency pattern S1702 for each frequency band obtained through frequency analysis of the target sound, and a fundamental period S1706 of the target sound. The analysis unit 1704 stores a threshold value S1705. The target sound preparation unit 1702 outputs the target sound frequency pattern S1702 and the fundamental period S1706 to the analysis unit 1704. The evaluation sound preparation unit 1703 inputs an evaluation sound S1700, and performs frequency analysis on the evaluation sound S1700 to output an evaluation sound frequency pattern S1701 for each frequency band to the analysis unit 1704. For each frequency band, the analysis unit 1704 sequentially calculates the differential values of the evaluation sound frequency pattern S1701 and the target sound frequency pattern S1702 at corresponding points in time, by temporally shifting the target sound frequency pattern S1702 with respect to the evaluation sound frequency pattern S1701. Based on the period of an iterative time interval of a differential value equal to or lower than the threshold value S1705 and the fundamental period S1706 of the target sound, the analysis unit 1704 outputs area information S1703 that is information regarding a time-frequency area in which the target sound exists in the evaluation sound S1700 to the sound extraction unit 1705. The sound extraction unit 1705 extracts a target sound using the area information S1703 and the evaluation sound frequency pattern S1701, and presents the target sound to the user.

The target sound preparation unit 1702 is an example of a target sound preparation unit that prepares a target sound frequency pattern obtained by performing frequency analysis on a target sound.

The evaluation sound preparation unit 1703 is an example of an evaluation sound preparation unit that prepares an evaluation sound frequency pattern obtained by performing frequency analysis on an evaluation sound.

The analysis unit 1704 is an example of an analysis unit that sequentially calculates differential values of the evaluation sound frequency pattern and the target sound frequency pattern at corresponding points in time, by temporally shifting the target sound frequency pattern with respect to the evaluation sound frequency pattern, calculates an iterative interval between the points in time where the differential value is equal to or lower than a predetermined threshold value, and judges whether or not the target sound exists in the evaluation sound based on a period of the iterative interval and the fundamental period of the target sound.

Next, operations of the auditory assistance system 1700 configured as above will be described.

Figure 22:
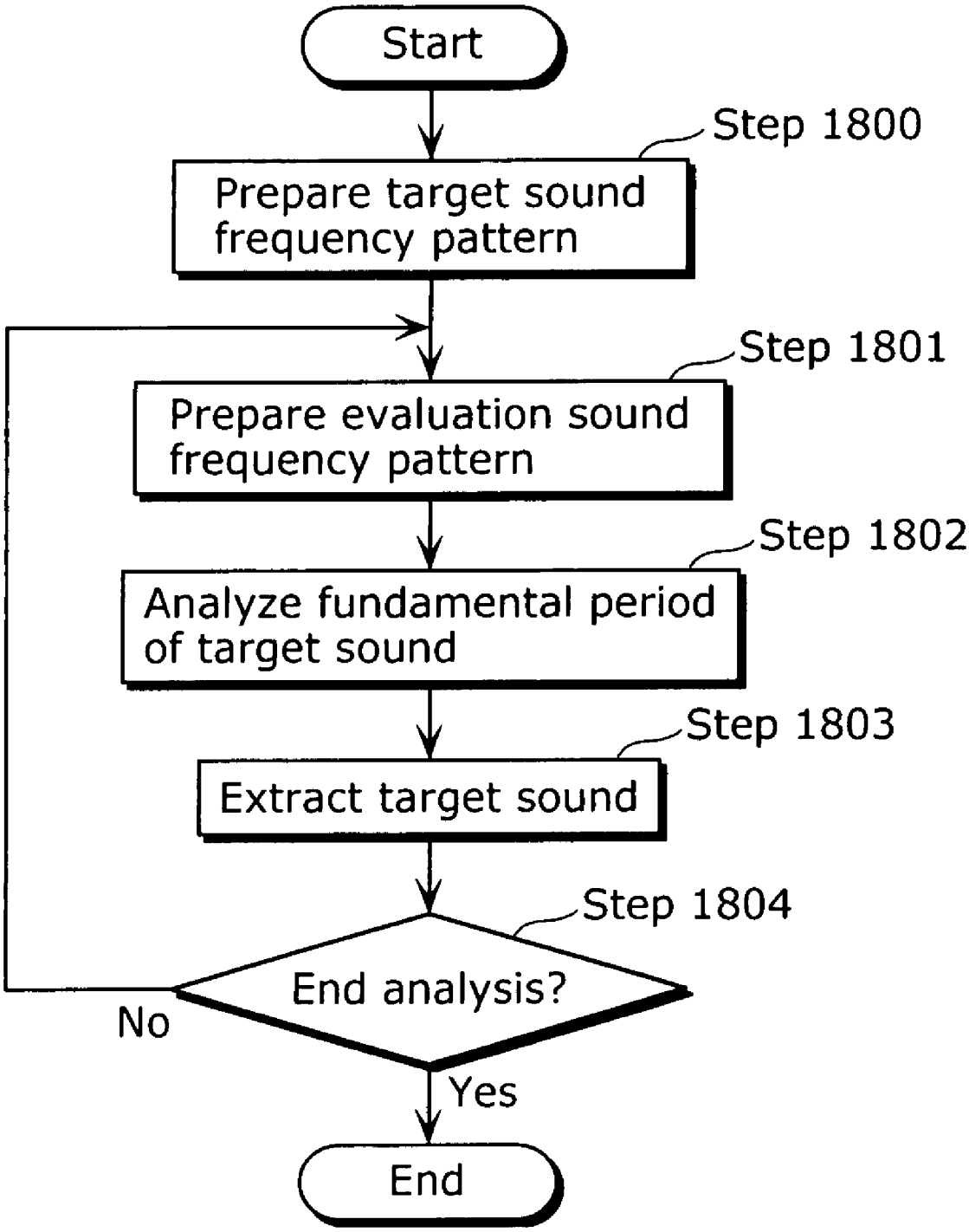
FIG. 22 is a flowchart showing an operational procedure of an auditory assistance system.

FIG. 22 is a flowchart showing an operational procedure of the auditory assistance system 1700.

In this example, prior to the shipment of the auditory assistance system, a frequency pattern for each frequency band obtained by performing frequency analysis on the voice of the speaker A is stored as the target sound frequency pattern S1702 in the target sound preparation unit 1702 (step 1800), and the fundamental period S1706 of the voice of the speaker A that is the target sound is also stored. Furthermore, the threshold value S1705 is stored for each frequency band in the analysis unit 1704. In this example, the fundamental period S1706 of the voice of the speaker A that is the target sound is 3-12 ms. In addition, the target sound frequency pattern used herein may be obtained by performing discrete Fourier transform on the target sound according to the first embodiment. Note that, for this example, the target sound is not a motorcycle but the voice of the speaker A instead.

Figure 23:
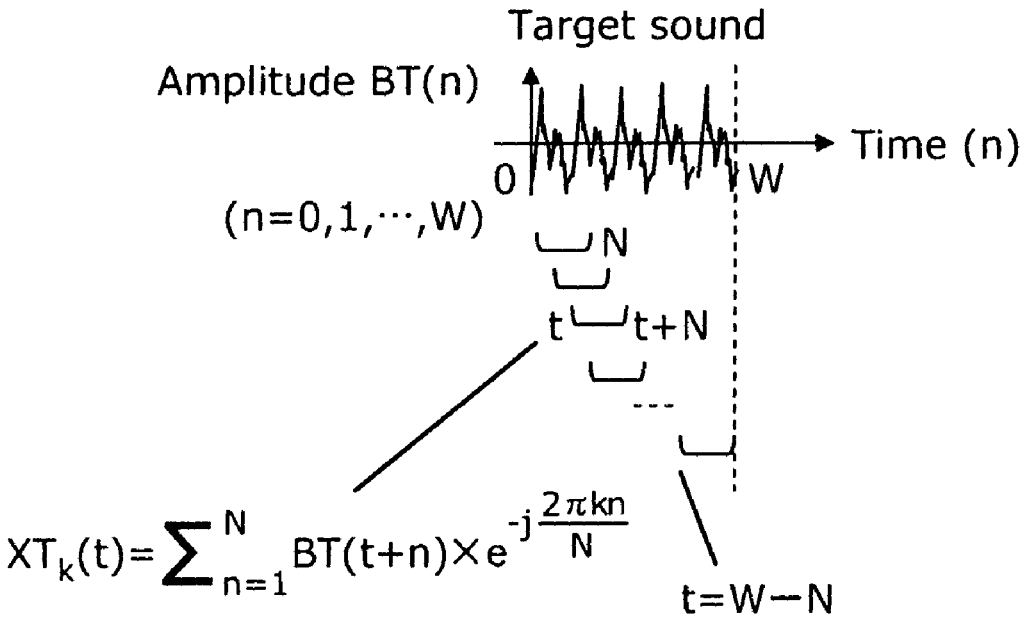
FIG. 23 is a diagram showing an example of a method of creating a frequency pattern.

FIG. 23 shows a conceptual diagram of a method of obtaining the target sound frequency pattern S1702. The target sound frequency pattern S1702 at a given point in time may be expressed as $$XT_k = \sum_{n=1}^{N} BT(t+n) \times e^{-j\frac{2\pi kn}{N}} \quad \text{[Formula 22]}$$

-continued $$(k = 1, 2, \ldots, N),$$

where N is a window length of Fourier transform which is set shorter than the length W of the target sound, and k represents an index at the frequency band to be analyzed. Here, $$BT(n)\ (n=0,1,\ldots,N) \quad \text{[Formula 23]}$$

represents the target sound, while $$e^{-j\frac{2\pi kn}{N}} = \cos\left(\frac{2\pi kn}{N}\right) - j\sin\left(\frac{2\pi kn}{N}\right) \quad \text{[Formula 24]}$$

represents an analysis waveform pattern.

In addition, the target sound frequency pattern S1702 may be expressed as $$XT_k(t) = \sum_{n=1}^{N} BT(t+n) \times e^{-j\frac{2\pi kn}{N}} \quad \text{[Formula 25]}$$

$$(k = 1, 2, \ldots, N)(t = 0, 1, \ldots, W-N),$$

where t represents the point in time of the start of the target sound to be analyzed. The target sound frequency pattern represents a temporal structure at the frequency of the target sound. In this example, target sound frequency patterns are calculated by shifting t by 1 point.

First, activation of the auditory assistance system 1700 causes the evaluation sound preparation unit 1703 to start retrieving the mixed sound of the three speakers, which is the peripheral sound of the user, which is the evaluation sound S1700, using a microphone. In this example, the evaluation sounds are retrieved in 30 ms intervals which include several fundamental periods of the voice of the speaker A. In other words, the fundamental period of the speaker A will be analyzed while segmenting the mixed sound every 30 ms and inputting the segments. Frequency analysis is then performed on the evaluation sound S1700 to create an evaluation sound frequency pattern S1701 for each frequency band (step 1801). The method of creating evaluation sound frequency patterns is the same as the method of creating target sound frequency patterns, only that the target sound is replaced by the evaluation sound S1700. Let an evaluation sound frequency pattern at a given point in time be expressed as $$XH_k = \sum_{n=1}^{N} BH(t+n) \times e^{-j\frac{2\pi kn}{N}} \quad \text{[Formula 26]}$$

$$(k = 1, 2, \ldots, N),$$

where N is a window length of Fourier transform which is set shorter than the length L of the evaluation sound S1700, and k represents an index at the frequency band to be analyzed. Here, $$BH(n)\ (n=1,2,\ldots,N) \quad \text{[Formula 27]}$$

represents evaluation sound.

In addition, the evaluation sound frequency pattern S1701 may be expressed as $$XH_k = \sum_{n=1}^{N} BH(t+n) \times e^{-j\frac{2\pi kn}{N}} \quad \text{[Formula 28]}$$

$$(k = 1, 2, \ldots, N)(t = 0, 1, \ldots, L-N).$$

Next, analysis is performed on whether or not the fundamental period of the voice of the speaker A that is the target sound stored in the target sound preparation unit 1702 is included in the evaluation sound S1700 which includes a mixed sound of the voices of the three speakers (step 1802). More specifically, for each frequency band, the analysis unit 1704 sequentially calculates the differential values of the evaluation sound frequency pattern S1701 and the target sound frequency pattern S1702 at corresponding points in time, by temporally shifting the target sound frequency pattern S1702 with respect to the evaluation sound frequency pattern S1701. The analysis unit 1704 analyzes the fundamental period of the target sound based on the iterative time interval between differential values that are equal to or lower than the threshold value S1705. Using the fundamental period S1706, the analysis unit 1704 then outputs area information S1703 that is information regarding a time-frequency area in which the target sound exists in the evaluation sound S1700 to the sound extraction unit 1705.

FIGS. 24A to 24C show examples of a method of analyzing the fundamental period of the target sound by the analysis unit 1704. In this example, a case is shown where an evaluation sound frequency pattern at a frequency band k is the target sound (target sound frequency pattern). In this case, differential values are determined for each frequency band.

FIG. 24A shows an example of an evaluation sound frequency pattern at the frequency band k. This example clips the frequency pattern of the mixed sound at 30 ms prior to the present point in time and uses the clipped sound as the evaluation sound frequency pattern XHk(t). The evaluation sound frequency pattern in this example includes a voice of the speaker A that is a target sound corresponding to five periods.

FIG. 24B shows an example of a target sound frequency pattern at the frequency band k. In this example, a frequency pattern of a voice of the speaker A corresponding to two periods is used as the target sound frequency pattern XTk(t).

FIG. 24C shows a differential value when the target sound frequency pattern S1702 is temporally shifted with respect to the evaluation sound frequency pattern S1701 at the frequency band k. In this example, an Euclidean distance is used as a differential value. Here, the differential value is expressed as $$E_k(m) = \sum_{t=0}^{t=W-N} \sqrt{(XH_k(m+t) - XT_k(t))^2} \quad \text{[Formula 29]}$$

$$(k = 1, 2, \ldots, N)(m = 0, 1, \ldots, L-W-N),$$

where m is a value of discretized time which corresponds to the point in time of the start of the evaluation sound frequency pattern S1701 for which a differential value will be determined. The differential value is a summation of the differences between the evaluation sound frequency pattern and the target sound frequency pattern for a time width (W−N). In this example, since the evaluation sound frequency pattern is the target sound frequency pattern, the iterative time interval between the differential values matches the fundamental period S1706 of the target sound (3-12 ms). In this example, the iterative time interval between the differential values is 6 ms.

At this point, the threshold value S1705 is introduced. Let the threshold value S1705 at the frequency band k be expressed as Θk. In this example, the threshold value S1705 has been stored in the analysis unit 1704 prior to shipment of the auditory assistance system, and in consideration of the fluctuation width of the fundamental waveform patterns of the target sound frequency pattern, the threshold value S1705 is set to a value that is slightly greater than the maximum value of a variation due to the fluctuation of the minimum value of the differential values.

FIG. 24C shows an analysis method of a fundamental period of a target sound at the frequency band k. In this example, an iterative time interval of a differential value represented by Formula 29 which is equal to or lower than the threshold value Θk is determined. In this example, since the evaluation sound frequency pattern is a target sound frequency pattern, the minimum value of the differential values will be a value that is extremely close to zero. Therefore, the iterative time interval between the differential values that is equal to or lower than the threshold value Θk matches the iterative time interval of a differential value when a threshold value is not considered. As a result, the fundamental period of the evaluation sound frequency pattern S1701 is determined as 6 ms.

Next, since the fundamental period of the evaluation sound frequency pattern is 6 ms and is within the range of 3-12 ms that is the fundamental period S1706 of the target sound, the target sound is judged to exist in the evaluation sound frequency pattern S1701, and area information S1703 to the effect that "the target sound exists in frequency band k" is created.

Figures 25A, 25B, 25C:
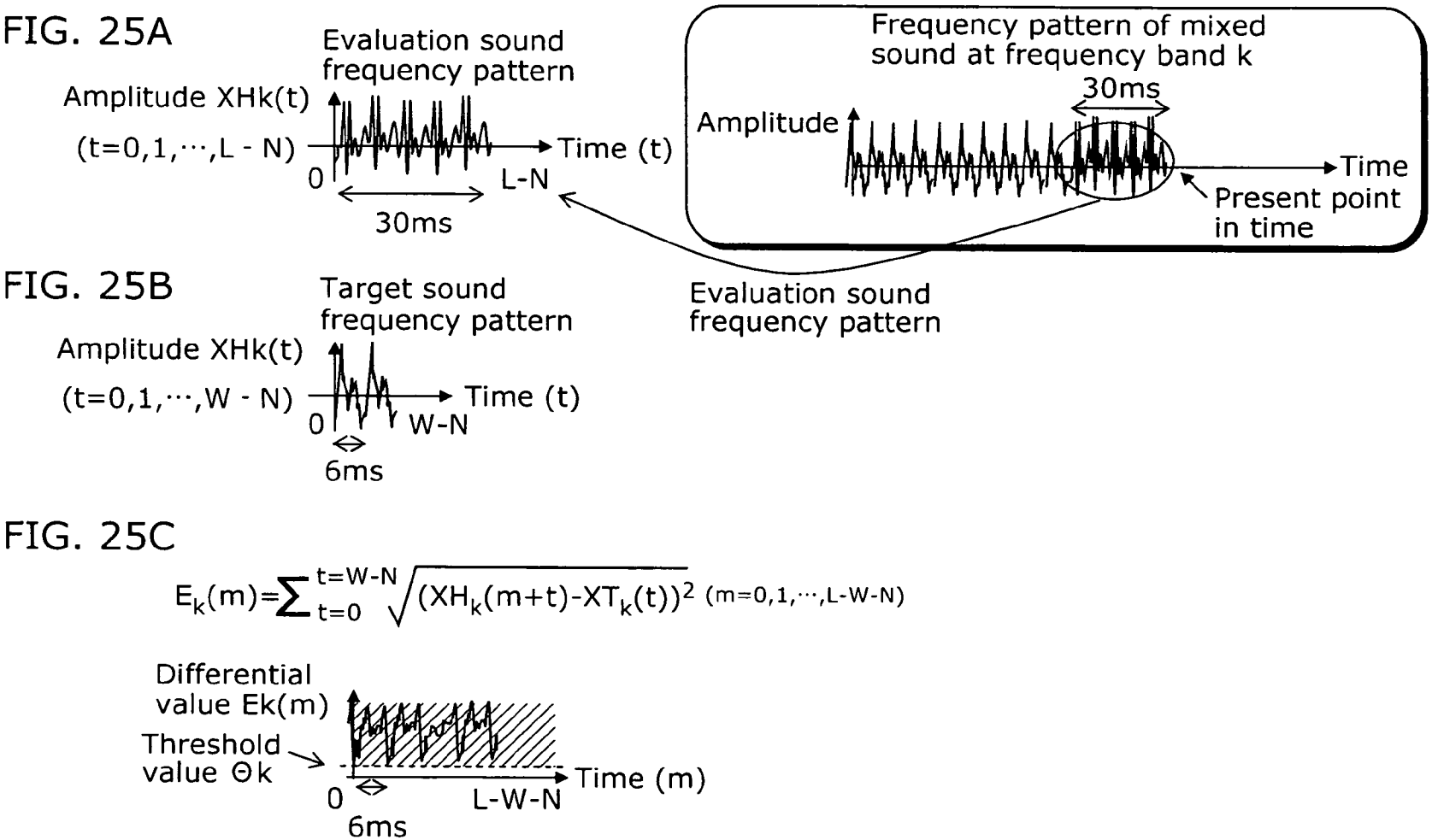
FIG. 25A is a diagram showing another example of a method of calculating a differential value using an evaluation sound frequency pattern and a target sound frequency pattern.
FIG. 25B is a diagram showing another example of a method of calculating a differential value using an evaluation sound frequency pattern and a target sound frequency pattern.
FIG. 25C is a diagram showing another example of a method of calculating a differential value using an evaluation sound frequency pattern and a target sound frequency pattern.

In addition, with respect to the analysis unit 1704, FIGS. 25A to 25C show examples of a case where the evaluation sound frequency pattern is a frequency pattern of a sound that differs from the target sound (target sound frequency pattern) but has the same fundamental period as the target sound.

FIG. 25A shows an example of an evaluation sound frequency pattern at the frequency band k. This example similarly clips the frequency pattern of the mixed sound at 30 ms prior to the present point in time and uses the clipped sound as the evaluation sound frequency pattern XHk(t). In this example, the evaluation sound frequency pattern includes a voice of a speaker B corresponding to five periods that differs from a target sound. The fundamental period thereof is the same as the target sound and is 6 ms.

FIG. 25B shows an example of a target sound frequency pattern at the frequency band k. For this example, in the same manner as in FIG. 24B, the frequency pattern of a voice of the speaker A corresponding to two periods is used as the target sound frequency pattern XTk(t), and the fundamental period thereof is 6 ms.

FIG. 25C shows a differential value when the target sound frequency pattern S1702 is temporally shifted with respect to the evaluation sound frequency pattern S1701 at the frequency band k. An Euclidean distance is also used in this example as a differential value in the same manner as FIG. 24C. In this example, since the evaluation sound frequency pattern is a sound that has the same fundamental period as the target sound (target sound frequency pattern), the iterative time interval between the differential values matches the fundamental period of the target sound and is 6 ms.

At this point, the threshold value S1705 is introduced. In this example, the threshold value S1705 has similarly been stored in the analysis unit 1704 prior to shipment of the auditory assistance system, and in consideration of the fluctuation width of the fundamental waveform pattern of the target sound frequency pattern, the threshold value S1705 is set to a value that is slightly greater than the maximum value of a variation due to the fluctuation of the minimum value of the differential values. This value is the same as the value in the example shown in FIG. 24C.

FIG. 25C shows an analysis method of a fundamental period of a target sound at the frequency band k. In this example, an iterative time interval of a differential value represented by Formula 29 that is equal to or lower than the threshold value Θk is determined. In this example, since the evaluation sound frequency pattern is a sound that differs from the target sound (target sound frequency pattern), the minimum value of the differential values will be a large value that is distanced from zero. As a result, an iterative time interval does not exist for a differential value that is equal to or lower than the threshold value Θk.

Next, since a fundamental period of the evaluation sound frequency pattern does not exist and therefore is not within the range of 3-12 ms that is the fundamental period S1706 of the target sound, it is judged that the target sound does not exist in the evaluation sound frequency pattern S1701, and area information S1703 to the effect that "the target sound does not exist in frequency band k" is created.

When the evaluation sound frequency pattern at the frequency band k is a sound that has a different fundamental period from the target sound, the fundamental period S1706 of the target sound does not appear in the fundamental period of the evaluation sound frequency pattern S1701 at the frequency band k. Thus, the analysis unit 1704 judges that the target sound does not exist in the evaluation sound frequency pattern S1701, and area information S1703 to the effect that "the target sound does not exist in frequency band k" is created.

The above-described processing is performed for all frequency bands k (k=1, 2, . . . , N) to create finalized area information S1703.

Next, the sound extraction unit 1705 extracts a target sound using the area information S1703 and the evaluation sound frequency pattern S1701, and presents the target sound to the user (step 1803).

In this example, the frequency pattern of the time-frequency area of the evaluation sound frequency pattern S1701 described in the area information S1703 as "the target sound does not exist in frequency band k" is replaced with a zero value, while a frequency pattern of the extracted sound is created using the evaluation sound frequency pattern S1701 from the frequency pattern of the time-frequency area described as "the target sound exists in frequency band k". The extracted sound S1704 is then created by performing an inverse Fourier transform on the frequency pattern of the extracted sound, and presented to the user through a speaker.

Finally, the operations of the above-described steps 1801 to 1803 are repeated until the auditory assistance system 1700 is brought to a stop (step 1804).

As described above, since the second embodiment of the present invention calculates differential values between an evaluation sound frequency pattern and a target sound frequency pattern and analyzes a fundamental period based on an iterative interval between differential values that are equal to or lower than a predetermined threshold value, analysis of a fundamental period may be performed while distinguishing between a sound that differs from a target sound but has the same fundamental period as the target sound and the target sound. In this case, since an evaluation sound frequency pattern and a target sound frequency pattern resulting from respective frequency analyses of the evaluation sound and a target sound are used, it is now possible to analyze fundamental periods on a per-frequency band basis. For instance, mixed sound separation may be achieved by extracting the frequency pattern of a target sound from the frequency pattern of the mixed sound for each frequency band. As a result, it is now possible to judge whether or not an evaluation sound contains the target sound.

Variation of the Second Embodiment

Figure 26:
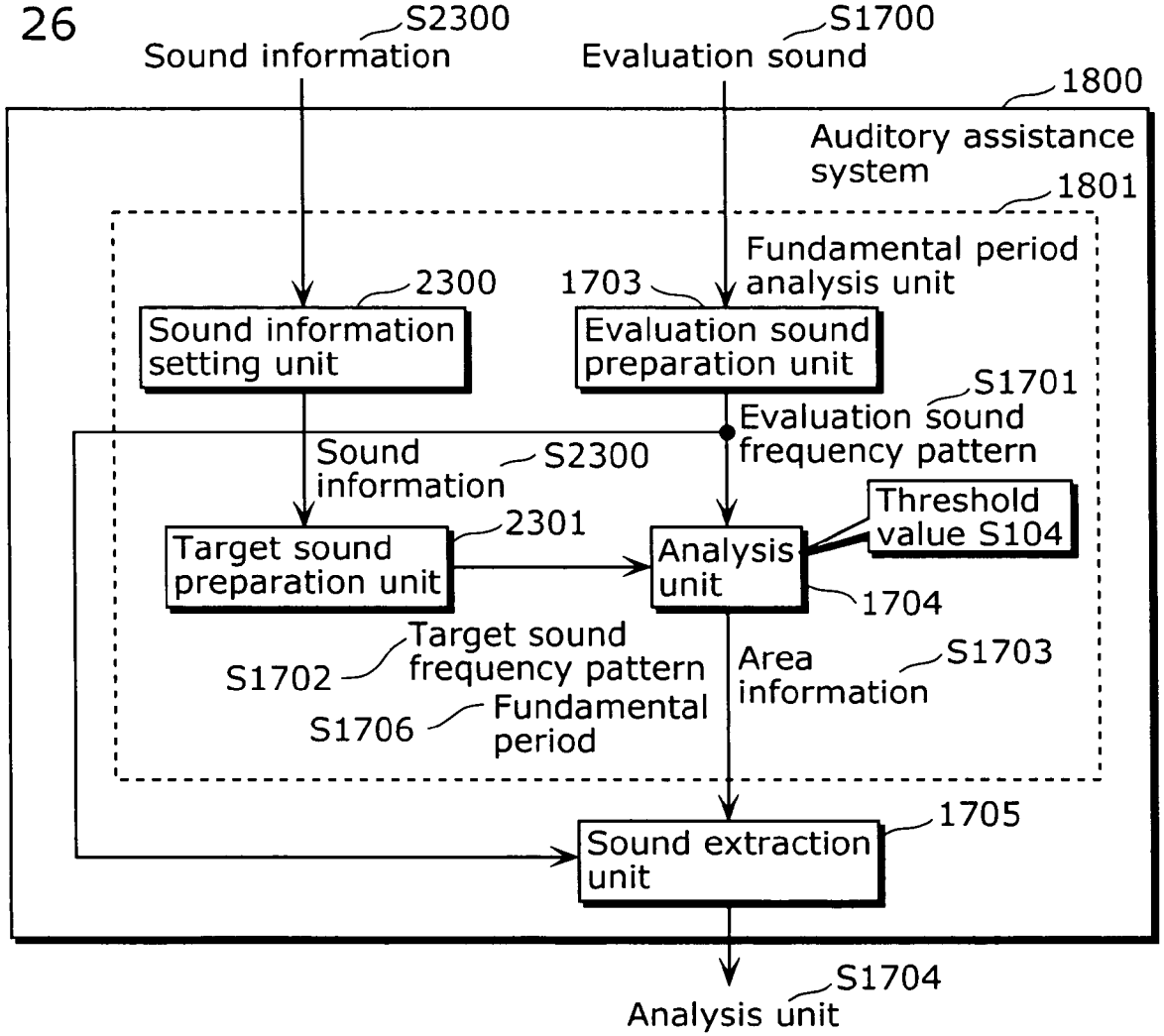
FIG. 26 is a block diagram showing an overall configuration of a target sound analysis apparatus according to a variation of the second embodiment.

A variation of the second embodiment will now be described. FIG. 26 is a block diagram showing an overall configuration of a target sound analysis apparatus according to a variation of the second embodiment of the present invention. In this case, a sound information setting unit 2300 has been added to the auditory assistance system 1700 shown in FIG. 20.

An auditory assistance system 1800 includes a fundamental period analysis unit 1801 and the sound extraction unit 1705. The fundamental period analysis unit 1801 includes the sound information setting unit 2300, the target sound preparation unit 2301, the evaluation sound preparation unit 1703 and the analysis unit 1704.

The analysis unit 1704 stores a threshold value S1705. The sound information setting unit 2300 sets sound information S2300 regarding the target sound, and outputs the sound information S2300 to the target sound preparation unit 2301. The target sound preparation unit 2301 prepares a target sound frequency pattern S1702 based on the sound information S2300 and at the same time prepares the fundamental period S1706 of the target sound, and outputs the target sound frequency pattern S1702 and the fundamental period S1706 to the analysis unit 1704. The evaluation sound preparation unit 1703 inputs an evaluation sound S1700, and performs frequency analysis on the evaluation sound S1700 to output an evaluation sound frequency pattern S1701 for each frequency band to the analysis unit 1704. For each frequency band, the analysis unit 1704 sequentially calculates the differential values of the evaluation sound frequency pattern S1701 and the target sound frequency pattern S1702 at corresponding points in time, by temporally shifting the target sound frequency pattern S1702 with respect to the evaluation sound frequency pattern S1701. Based on the period of an iterative time interval of a differential value equal to or lower than the threshold value S1705 and the fundamental period S1706 of the target sound, the analysis unit 1704 outputs area information S1703 that is information regarding a time-frequency area in which the target sound exists in the evaluation sound S1700 to the sound extraction unit 1705. The sound extraction unit 1705 extracts a target sound using the area information S1703 and the evaluation sound frequency pattern S1701, and presents the target sound to the user.

Next, operations of the auditory assistance system 1800 configured as above will be described.

Figure 27:
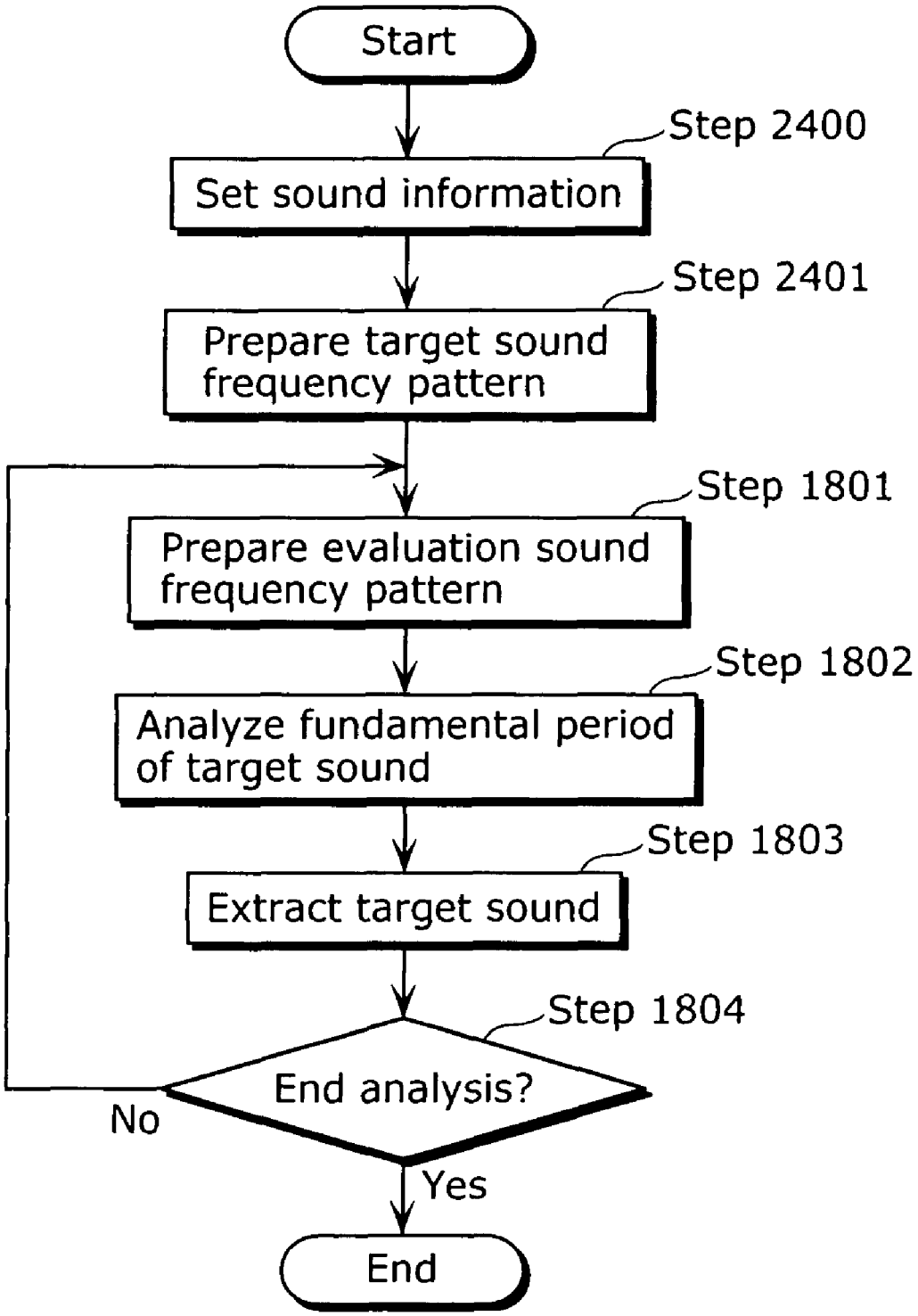
FIG. 27 is a flowchart showing another operational procedure of an auditory assistance system.

FIG. 27 is a flowchart showing an operational procedure of the auditory assistance system 1800.

In this example, the threshold value S1705 is stored in the analysis unit 1704 prior to the shipment of the auditory assistance system 1800. For all frequency bands in this example, the threshold value S1705 is set to 0.5, which is a value that is slightly greater than zero.

First, the sound information setting unit 2300 uses a microphone to retrieve a voice of the speaker A that is sound information S2300, and outputs the voice of the speaker A to the target sound preparation unit 2301 (step 2400).

Next, the target sound preparation unit 2301 prepares a target sound frequency pattern S1702 by clipping a portion of the voice of the speaker A that is sound information S2300 and performing frequency analysis of the clipped portion (step 2401). In this example, the target sound frequency pattern is created by discrete Fourier transform in the same manner as in the second embodiment. At the same time, the fundamental period of the voice of the speaker A is determined and set as the fundamental period S1706. In this example, since the voice of the speaker A is the only target sound and no other sounds having the same fundamental period as the voice of the speaker A are included, the fundamental period of the voice of the speaker A is determined using the method according to the first conventional technique.

Activation of the auditory assistance system 1800 causes the evaluation sound preparation unit 1703 to start retrieving the mixed sound of the three speakers, which is the peripheral sound of the user, which is the evaluation sound S1700, using a microphone. Frequency analysis is then performed on the evaluation sound S1700 to create an evaluation sound frequency pattern S1701 for each frequency band (step 1801).

Analysis is performed on whether or not the fundamental period of the voice of the speaker A that is the target sound frequency pattern S1702 prepared by the target sound preparation unit 2301 is included in the evaluation sound frequency pattern S1701 which includes the mixed sound of the voices of the three speakers to create area information 1703 (step 1802).

Next, the sound extraction unit 1705 extracts a target sound using the area information S1703 and the evaluation sound frequency pattern S1701, and presents the target sound to the user (step 1803).

Since the steps 1801, 1802 and 1803 are the same as in the second embodiment, descriptions thereof will be omitted.

Finally, the operations of the above-described steps 1801 to 1803 are repeated until the auditory assistance system 1800 is brought to a stop (step 1804).

As described above, since the target sound preparation unit 2301 uses a target sound inputted by the sound information setting unit 2300 as the target sound to be prepared, the target sound preparation unit 2301 is no longer required to prepare in advance a plurality of sounds to be used as target sound candidates, and a reduction of storage capacity may be achieved.

Another Example

Another example of the sound information setting unit 2300 and the target sound preparation unit 2301 will now be described.

FIG. 27 is another flowchart showing an operational procedure of the auditory assistance system 1800.

In this example, prior to shipment of the auditory assistance system 1800, a frequency pattern of the voice of the speaker A, a frequency pattern of the voice of the speaker B and a frequency pattern of the voice of the speaker C have been stored as target sound frequency pattern candidates in the target sound preparation unit 2301. In addition, a fundamental period corresponding to each target sound (target sound frequency pattern) candidate is stored in the target sound preparation unit 2301. Furthermore, the threshold value S1705 is stored for each frequency band in the analysis unit 1704.

First, the sound information setting unit 2300 presents the target sound candidates to the user. In this case, the voice of the speaker A is selected, and a selection signal to the effect of "voices of speaker A" is created (step 2400).

Next, the target sound preparation unit 2301 sets a target sound frequency pattern corresponding to the selection signal that is the sound information S2300 as the target sound frequency pattern S1702 (step 2401). In this example, the frequency pattern of the voice of the speaker A is the target sound frequency pattern S1702. In addition, the fundamental period of the target sound corresponding to the selection signal is set as the fundamental period S1706. In this case, the fundamental period S1706 is 3-12 ms, which is the fundamental period of the voice of the speaker A.

Activation of the auditory assistance system 1800 causes the evaluation sound preparation unit 1703 to start retrieving the mixed sound of the three speakers, which is the peripheral sound of the user, which is the evaluation sound S1700, using a microphone. Frequency analysis is then performed on the evaluation sound S1700 to create an evaluation sound frequency pattern S1701 for each frequency band (step 1801).

Analysis is performed on whether or not the fundamental period of the voice of the speaker A that is the target sound frequency pattern S1702 prepared by the target sound preparation unit 2301 is included in the evaluation sound frequency pattern S1701 which includes the mixed sound of the voices of the three speakers to create area information 1703 (step 1802).

Next, the sound extraction unit 1705 extracts a target sound using the area information S1703 and the evaluation sound frequency pattern S1701, and presents the target sound to the user (step 1803).

Since the steps 1801, 1802 and 1803 are the same as in the second embodiment, descriptions thereof will be omitted.

Finally, the operations of the above-described steps 1801 to 1803 are repeated until the auditory assistance system 1800 is brought to a stop (step 1804).

As described above, since a target sound frequency pattern may now be prepared using target sound frequency pattern candidates stored in the target sound preparation unit 2301, there is no need to input a target sound, and perform frequency analysis thereon to create a target sound frequency pattern. As a result, the presence or absence of a target sound may be analyzed even when a target sound cannot be inputted. For instance, when analyzing the fundamental period of the voice of the speaker A in ambient noise, while it will be impossible to pick up the voice of the speaker A in a quiet environment in ambient noise, the presence or absence of the voice of the speaker A may be analyzed by using a target sound frequency pattern created by performing frequency analysis on the voice of the speaker A in a quiet environment stored in the target sound preparation unit 2301. In addition, since the time required for inputting a target sound or performing frequency analysis on the inputted sound may be omitted, real time processing may be achieved.

Incidentally, in the same manner as in the second variation of the first embodiment, a threshold value setting unit may be added in order to control the threshold value to be used by the analysis unit 1704. As a result, an appropriate threshold value with respect to a plurality of target sounds may be set and fundamental periods may be analyzed with respect to a plurality of target sounds. In addition, analytical errors on fundamental periods may be reduced by appropriately controlling the threshold values. Furthermore, while a threshold value has been set for each target sound in the second variation of the first embodiment, a threshold value may now be set for each frequency band. As a result, analytical errors may be further reduced.

Yet Another Example

Preferably, the target sound preparation unit 2301 prepares a target sound frequency pattern that includes at least one of an amplitude spectrum and a phase spectrum calculated from a cross correlation between the target sound and an aperiodic analysis waveform pattern which includes a predetermined frequency component, and the evaluation sound preparation unit 1703 prepares an evaluation sound frequency pattern that includes at least one of an amplitude spectrum and a phase spectrum calculated from a cross correlation between the evaluation sound and the analysis waveform pattern which includes a predetermined frequency component.

Figure 28:
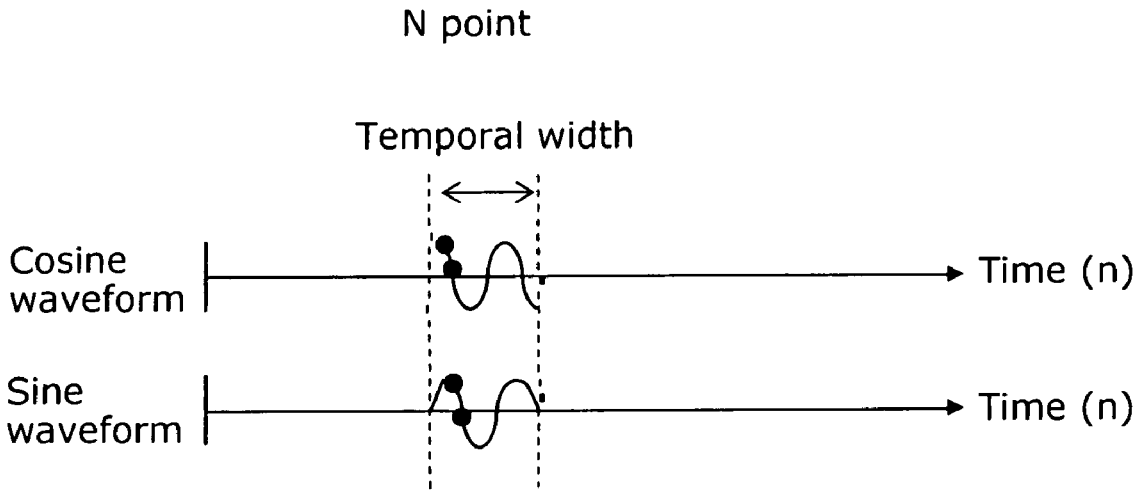
FIG. 28 is a diagram showing an example of an aperiodic analysis waveform pattern.

FIG. 28 shows an example of an aperiodic analysis waveform pattern. In this example, a cosine waveform pattern and a sine waveform pattern corresponding to 1.5 periods are set as analysis waveform patterns. More specifically, a frequency pattern is determined by setting the range of n that takes the summation of the right-hand sides of Formulas 22 and 26 according to the second embodiment such that, for each frequency band k to be analyzed, the cosine waveform pattern and the sine waveform pattern represented by Formula 24 correspond to 1.5 periods. In other words, a frequency pattern is determined by adjusting, for each frequency band k, the value N that is the summation of the right-hand sides of Formulas 25 and 28 to equal 1.5 periods.

As a result, since a fundamental period of the target sound is analyzed using a target sound frequency pattern and an evaluation sound frequency pattern created using an aperiodic analysis waveform pattern, periodic characteristics of the target sound and the evaluation sound appear. Thus, a fundamental period of the target sound may be analyzed. For instance, since the fundamental period of the target sound appears even in a target sound frequency pattern of a frequency band that is higher than the fundamental period of the target sound, the fundamental period may be analyzed even when noise is superimposed on a frequency band that corresponds to the fundamental period of the target sound. In addition, since the fundamental period of the target sound will appear in target sound frequency patterns across all frequency bands, fundamental periods may be analyzed on a per-frequency band basis. As a result, it is now possible to judge whether or not an evaluation sound contains the target sound.

Still Yet Another Example

Preferably, the target sound preparation unit 2301 prepares a target sound frequency pattern that includes at least one of an amplitude spectrum and a phase spectrum calculated from respective cross correlations between the target sound and a plurality of local analysis waveform patterns that form a portion of an analysis waveform pattern which includes a predetermined frequency component and that has predetermined temporal resolution. The evaluation sound preparation unit 1701 prepares an evaluation sound frequency pattern that includes at least one of an amplitude spectrum and a phase spectrum calculated from respective cross correlations between the target sound and the plurality of local analysis waveform patterns. The analysis unit 1704 respectively uses the target sound frequency pattern prepared using the plurality of local analysis waveform patterns and the evaluation sound frequency pattern prepared using the plurality of local analysis waveform patterns as a single group of data in order to analyze the fundamental period of the target sound, and judges the existence of the target sound.

Figure 29:
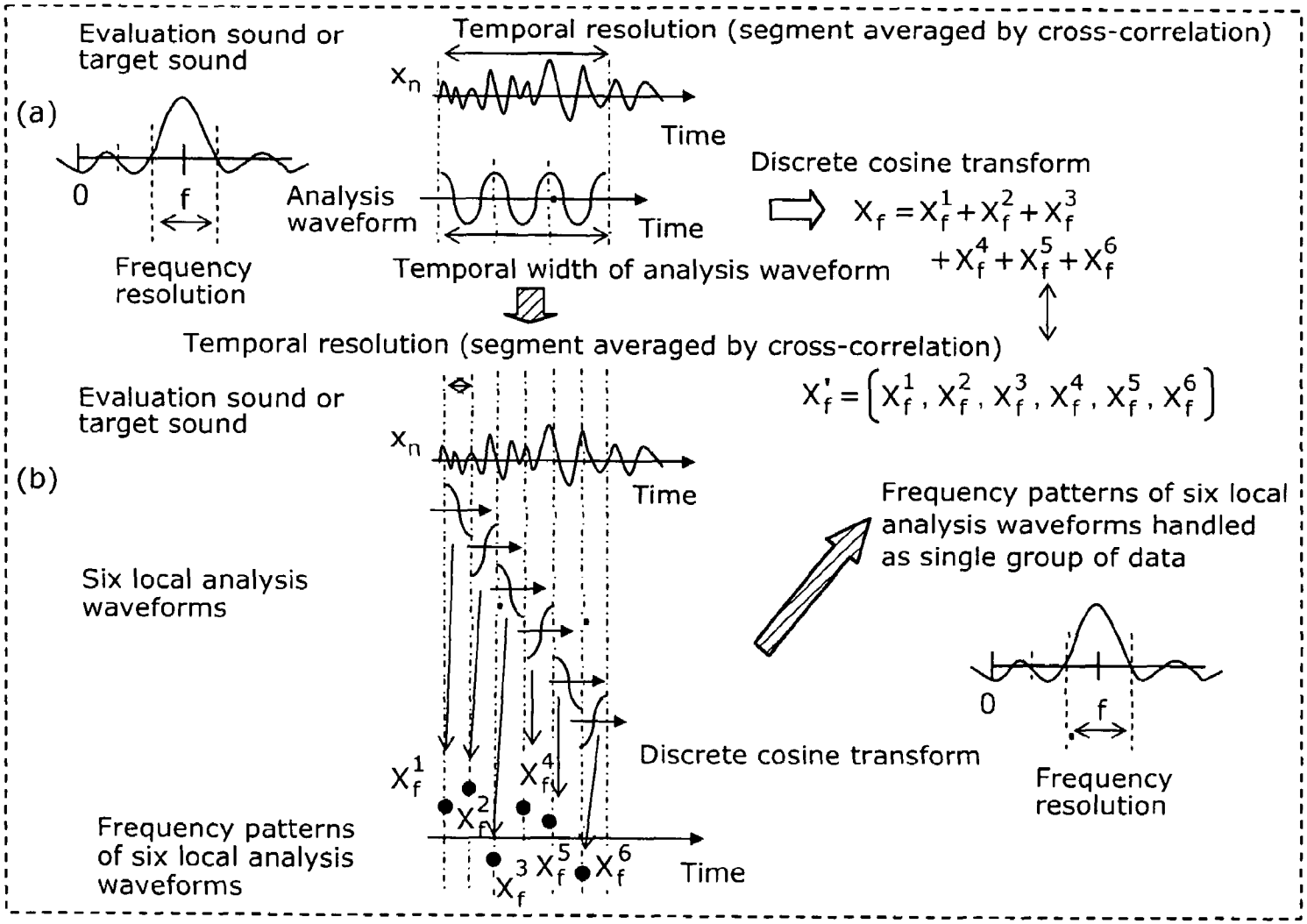
FIG. 29 is a diagram showing a relationship between an analysis waveform pattern and local analysis waveform patterns.

FIG. 29 shows an example of a method of creating a target sound frequency pattern and an evaluation sound frequency pattern.

FIG. 29(*a*) shows an analysis waveform pattern which includes by a cosine waveform pattern corresponding to three periods. When a frequency pattern is created by convoluting the analysis waveform pattern onto an evaluation sound or a target sound, since a single value is determined using a cosine waveform pattern corresponding to three periods, the temporal resolution will equal the length of the cosine waveform pattern corresponding to three periods.

On the other hand, as shown in FIG. 29(*b*), the temporal resolution is increased by preparing a plurality of local analysis waveform patterns that are included in a portion of an analysis waveform pattern and which have a predetermined temporal resolution, and determining a single value for each local waveform pattern. In this example, the temporal resolution will be equal to the length of a cosine waveform pattern corresponding to 0.5 periods. Thus, changes in temporal frequency structures will appear by increasing temporal resolution, and shapes of fundamental periods will become clearer.

A description will now be given on the handling of frequency information contained in the frequency pattern determined using the cosine waveform pattern corresponding to three periods which is made possible by using frequency patterns prepared using a plurality of local analysis waveform patterns as a single group of data.

In this example, frequency patterns are created using discrete cosine transform.

If a frequency pattern of an analysis waveform pattern which includes a cosine waveform pattern corresponding to three periods may be expressed as $$X_f = \sum_{n=Start}^{End\ of\ 3rd\ period} x_n c_k \cos\frac{(2n-1)\pi k_f}{2N}, \quad \text{[Formula 30]}$$

then frequency patterns of the local analysis waveform patterns may be expressed as $$X_f^1 = \sum_{n=Start}^{End\ of\ 0.5th\ period} x_n c_k \cos\frac{(2n-1)\pi k_f}{2N}, \quad \text{[Formula 31]}$$

$$X_f^2 = \sum_{n=End\ of\ 0.5th\ period}^{End\ of\ 1st\ period} x_n c_k \cos\frac{(2n-1)\pi k_f}{2N}, \quad \text{[Formula 32]}$$

$$X_f^3 = \sum_{n=End\ of\ 1st\ period}^{End\ of\ 1.5th\ period} x_n c_k \cos\frac{(2n-1)\pi k_f}{2N}, \quad \text{[Formula 33]}$$

$$X_f^4 = \sum_{n=End\ of\ 1.5th\ period}^{End\ of\ 2nd\ period} x_n c_k \cos\frac{(2n-1)\pi k_f}{2N}, \quad \text{[Formula 34]}$$

$$X_f^5 = \sum_{n=End\ of\ 2nd\ period}^{End\ of\ 2.5th\ period} x_n c_k \cos\frac{(2n-1)\pi k_f}{2N}, \quad \text{[Formula 35]}$$

and $$X_f^6 = \sum_{n=End\ of\ 2.5th\ period}^{End\ of\ 3rd\ period} x_n c_k \cos\frac{(2n-1)\pi k_f}{2N}, \quad \text{[Formula 36]}$$

where

-continued $$c_k = 1(k=0),\ c_k = \sqrt{2}\ (k = 2, \ldots, N) \quad \text{[Formula 37]}$$

and N represents a number of samples of the window length of the discrete cosine transform. An evaluation sound or a target sound is represented as $$x_n. \quad \text{[Formula 38]}$$

Here, the relationship between the frequency pattern of the analysis waveform pattern and the frequency patterns of the local analysis waveform patterns may be expressed as $$X_f = X_f^1 + X_f^2 + X_f^3 + X_f^4 + X_f^5 + X_f^6. \quad \text{[Formula 39]}$$

Since the frequency pattern of the analysis waveform pattern may be created by using frequency patterns prepared using six local analysis waveform patterns as a single group of data, frequency patterns of local analysis waveform patterns may be handled in the same way as the frequency pattern of the analysis waveform pattern by using the frequency patterns of local analysis waveform patterns as a single group of data.

As described above, it is now clear that frequency patterns of the six local analysis waveform patterns handled as a single group of data contains, in addition to frequency information held by the frequency pattern of the analysis waveform pattern, information regarding changes in temporal frequency structure.

Figure 30:
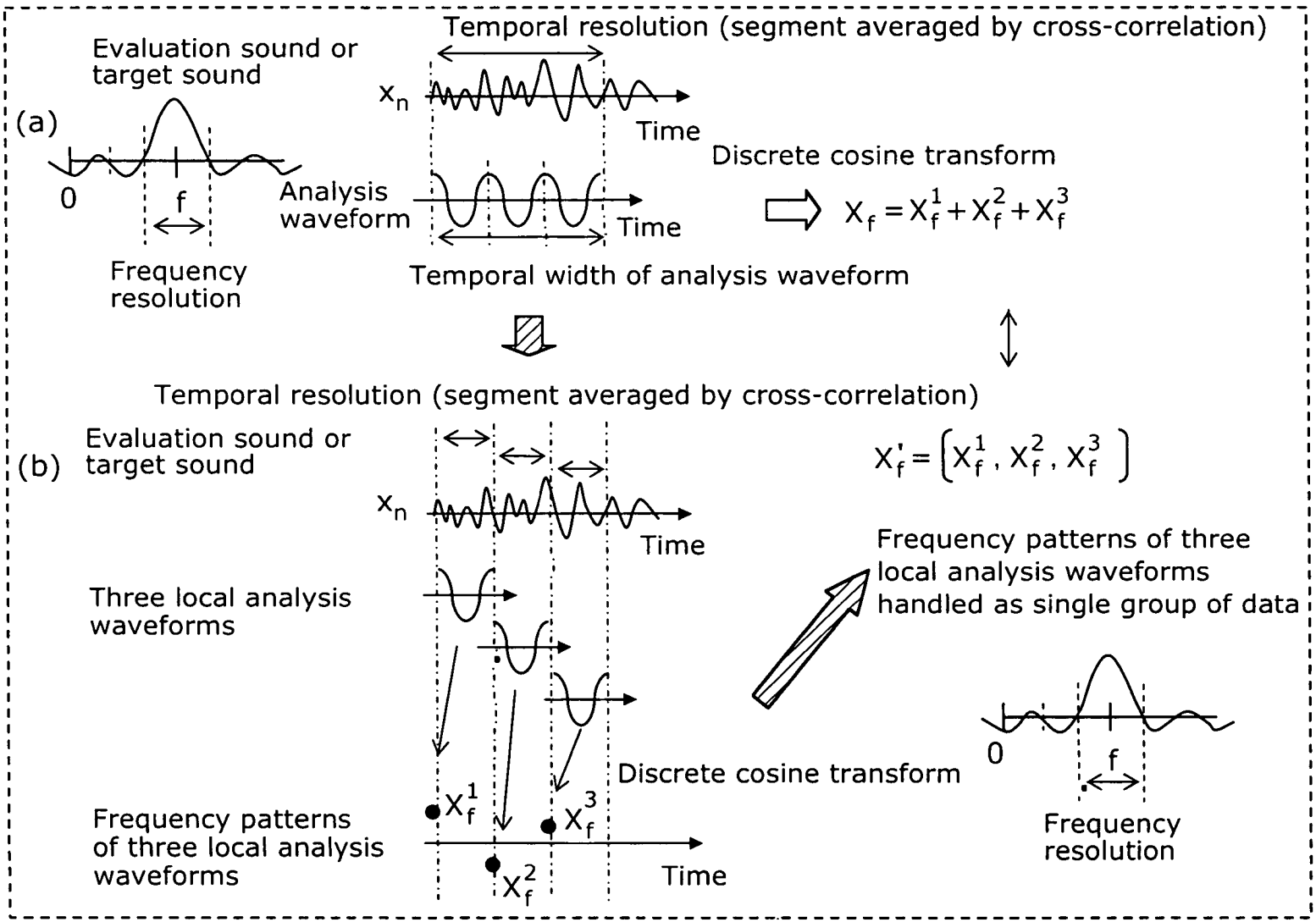
FIG. 30 is a diagram showing another relationship between an analysis waveform pattern and local analysis waveform patterns.

FIG. 30 shows another example of a method of creating frequency patterns.

Similar to FIG. 29(*a*), FIG. 30(*a*) shows an analysis waveform pattern which includes a cosine waveform pattern corresponding to three periods. When a frequency pattern is created by convoluting the analysis waveform pattern onto an evaluation sound or a target sound, since a single value is determined using a cosine waveform pattern corresponding to three periods, the temporal resolution will equal the length of the cosine waveform pattern corresponding to three periods.

On the other hand, as shown in FIG. 30(*b*), the temporal resolution may be increased by preparing a plurality of local analysis waveform patterns that are included in a portion of an analysis waveform pattern and which have a predetermined temporal resolution, and determining a single value for each local waveform pattern. In this example, the temporal resolution will equal the length of a cosine waveform pattern corresponding to 1 period.

In this example, since the frequency pattern of the analysis waveform pattern may also be expressed as a sum of three frequency patterns, frequency patterns prepared using three local analysis waveform patterns may be handled in the same way as the frequency pattern determined from the cosine waveform pattern corresponding to three periods by using the frequency patterns prepared using the three local analysis waveform patterns as a single group of data.

Figure 31:
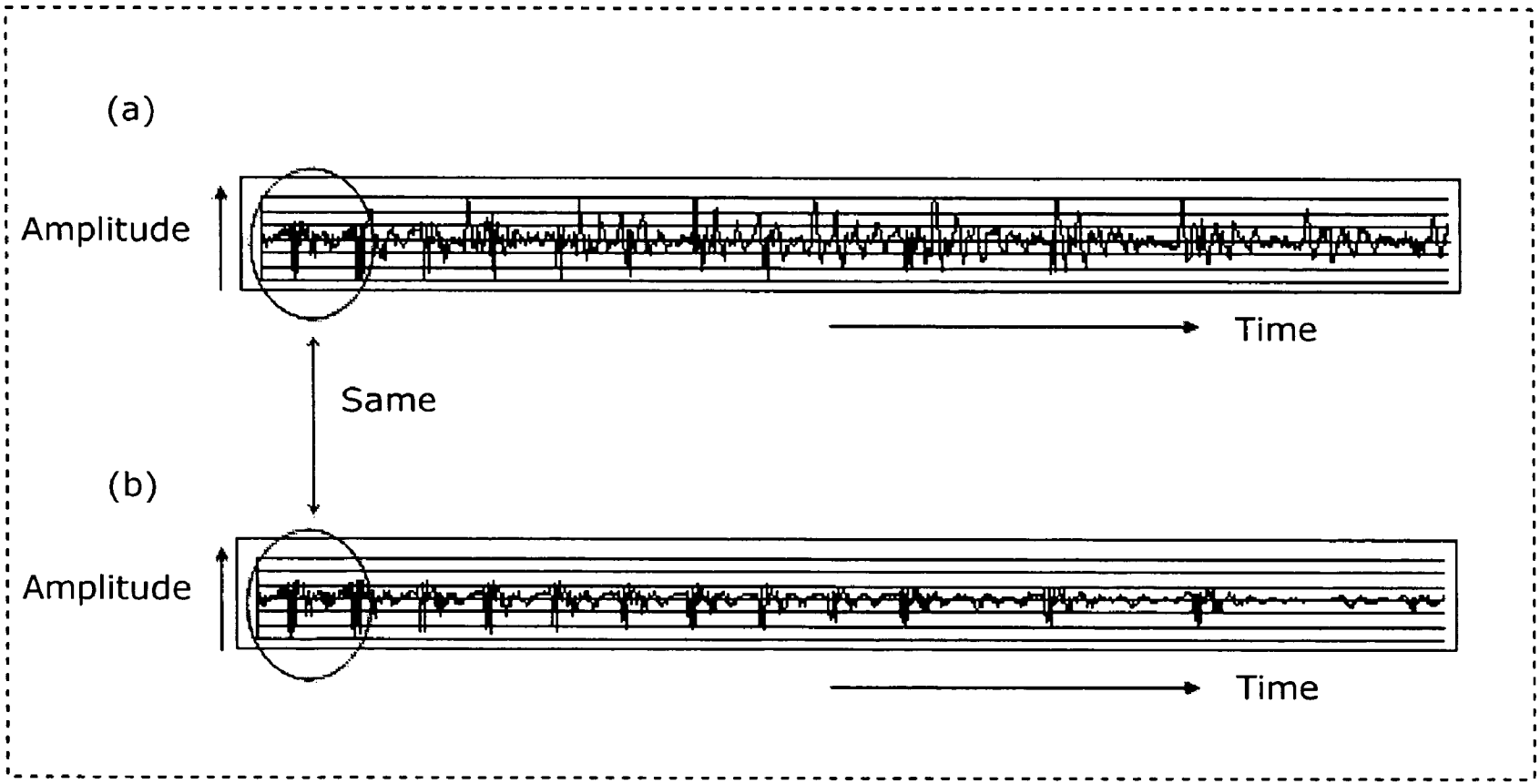
FIG. 31 is a diagram showing an example of an evaluation sound frequency pattern and a target sound frequency pattern.

FIG. 31(*a*) shows a frequency pattern at 2 KHz of a mixed sound of the voices of three speakers analyzed using the local analysis waveform patterns shown in FIG. 30. FIG. 31(*b*) shows a frequency pattern at 2 KHz of a voice of the speaker A analyzed using the local analysis waveform patterns shown in FIG. 30. In this example, it is shown that the fundamental period at the frequency pattern of the voice of the speaker A clearly appears in the frequency pattern of the mixed sound.

Figure 32:
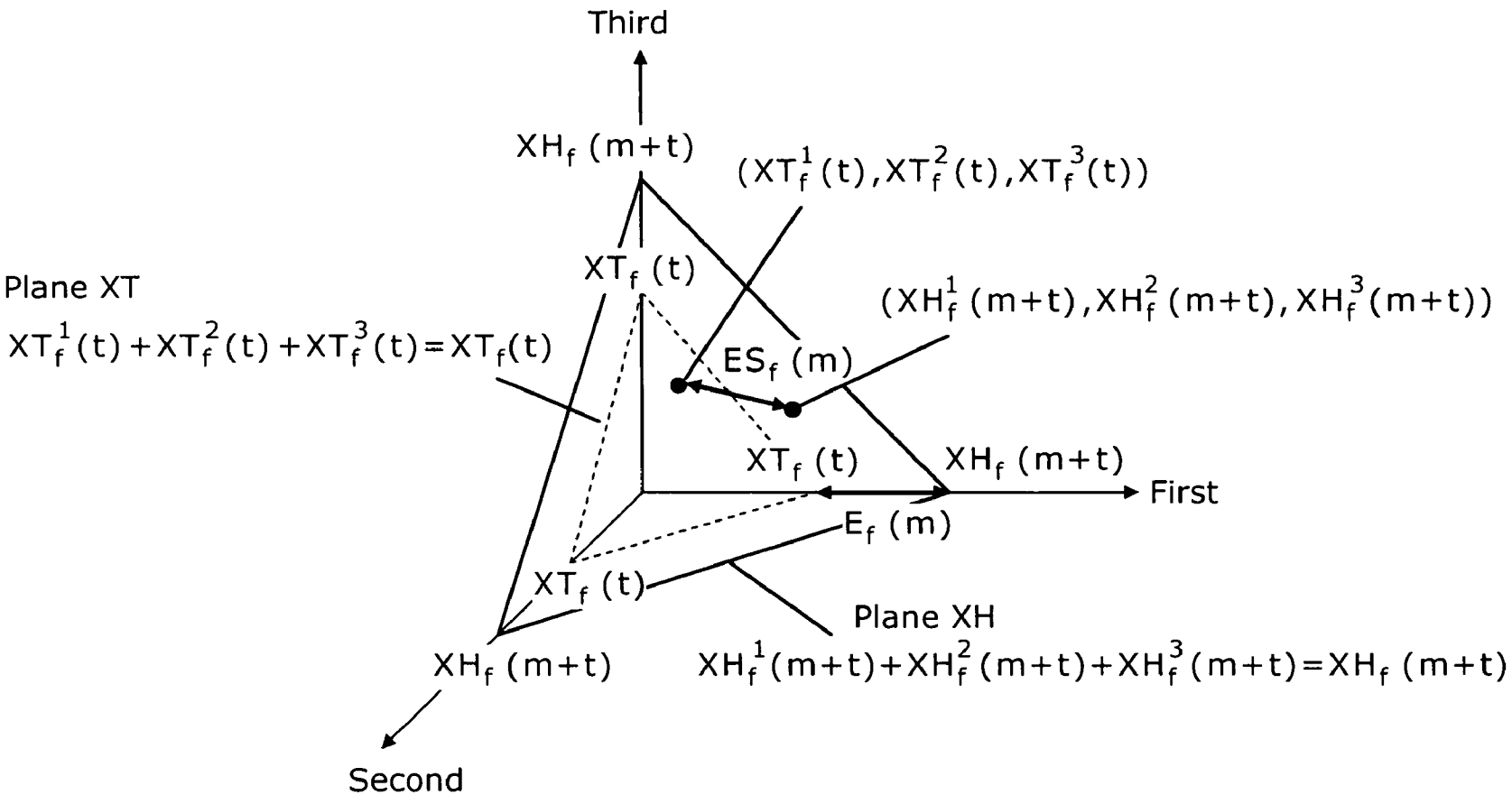
FIG. 32 is a diagram showing another relationship between an analysis waveform pattern and a local analysis waveform pattern.

FIG. 32 shows a relationship between the frequency pattern of the analysis waveform pattern and the frequency patterns of the local analysis waveform patterns of the example shown in FIG. 30. In this example, a target sound is represented by BT(n) while an evaluation sound is represented by BH(n). If the frequency pattern of the analysis waveform pattern of the target sound is expressed as $$XT_f(t) = \sum_{n=Start}^{End\ of\ 3rd\ period} BT(t+n) \times c_k \cos\frac{(2n-1)\pi k_f}{2N} \quad (t = 0, 1, \ldots, W-N), \qquad \text{[Formula 40]}$$

then frequency patterns of the local analysis waveform patterns of the target sound may be expressed by $$XT_f^1(t) = \sum_{n=Start}^{End\ of\ 1st\ period} BT(t+n) \times c_k \cos\frac{(2n-1)\pi k_f}{2N} \quad (t = 0, 1, \ldots, W-N), \qquad \text{[Formula 41]}$$

$$XT_f^2(t) = \sum_{n=End\ of\ 1st\ period}^{End\ of\ 2nd\ period} BT(t+n) \times c_k \cos\frac{(2n-1)\pi k_f}{2N} \quad (t = 0, 1, \ldots, W-N), \qquad \text{[Formula 42]}$$

and $$XT_f^3(t) = \sum_{n=End\ of\ 2nd\ period}^{End\ of\ 3rd\ period} BT(t+n) \times c_k \cos\frac{(2n-1)\pi k_f}{2N} \quad (t = 0, 1, \ldots, W-N), \qquad \text{[Formula 43]}$$

where W is the same as in the second embodiment, N represents the number of samples of the window length of the discrete cosine transform, and Ck represents Formula 37. In addition, if the frequency pattern of the analysis waveform pattern of the evaluation sound is expressed as $$XH_f(t) = \sum_{n=Start}^{End\ of\ 3rd\ period} BH(t+n) \times c_k \cos\frac{(2n-1)\pi k_f}{2N} \quad (t = 0, 1, \ldots, L-N), \qquad \text{[Formula 44]}$$

then frequency patterns of the local analysis waveform patterns of the evaluation sound may be expressed by $$XH_f^1(t) = \sum_{n=Start}^{End\ of\ 1st\ period} BH(t+n) \times c_k \cos\frac{(2n-1)\pi k_f}{2N} \quad (t = 0, 1, \ldots, L-N), \qquad \text{[Formula [45]}$$

$$XH_f^2(t) = \sum_{n=End\ of\ 1st\ period}^{End\ of\ 2nd\ period} BH(t+n) \times c_k \cos\frac{(2n-1)\pi k_f}{2N} \quad (t = 0, 1, \ldots, L-N) \qquad \text{[Formula 46]}$$

and $$XH_f^3(t) = \sum_{n=End\ of\ 2nd\ period}^{End\ of\ 3rd\ period} BH(t+n) \times c_k \cos\frac{(2n-1)\pi k_f}{2N} \quad (t = 0, 1, \ldots, L-N), \qquad \text{[Formula 47]}$$

where W is the same as in the second embodiment, N represents the number of samples of the window length of the discrete cosine transform, and Ck represents Formula 37.

In this example, for a frequency band f, a differential value when the target sound frequency pattern is temporally shifted with respect to the evaluation sound frequency pattern is expressed by an Euclidean distance. The differential value at the frequency pattern of the analysis waveform pattern may be expressed as $$E_f(m) = \sum_{t=0}^{t=W-N} \sqrt{(XH_f(m+t) - XT_f(t))^2} \quad (m = 0, 1, \ldots, L-W-N). \qquad \text{[Formula 48]}$$

Then, the differential value at the frequency patterns of the local analysis waveform patterns may be expressed as $$ES_f(m) = \sum_{t=0}^{t=W-N} \sqrt{\sum_{i=1}^{i=3} (XH_f^i(m+t) - XT_f^i(t))^2} \quad (m = 0, 1, \ldots, L-W-N). \qquad \text{[Formula 49]}$$

Considering now the distance between the frequency pattern XH and the frequency pattern XT using FIG. 32, the distance at the frequency pattern of the analysis waveform pattern is the distance between a segment XHf of a plane XH and a segment XTf of a plane XT, while the distance at the frequency patterns of the local analysis waveform patterns also take into consideration the distances of planar coordinates on the two planes XH and XT. In other words, detailed temporal patterns at the frequency patterns are also taken into consideration.

Thus, since a target sound frequency pattern prepared using a plurality of local analysis waveform patterns and an evaluation sound frequency pattern prepared using a plurality of local analysis waveform patterns are respectively used as a single group of data in order to analyze a fundamental period, changes in temporal frequency structures in frequency information according to the frequency resolution of the analysis waveform patterns may be accommodated, and a fundamental period may be analyzed by seemingly arranging the frequency resolution to be increased.

Third Embodiment

Figure 33:
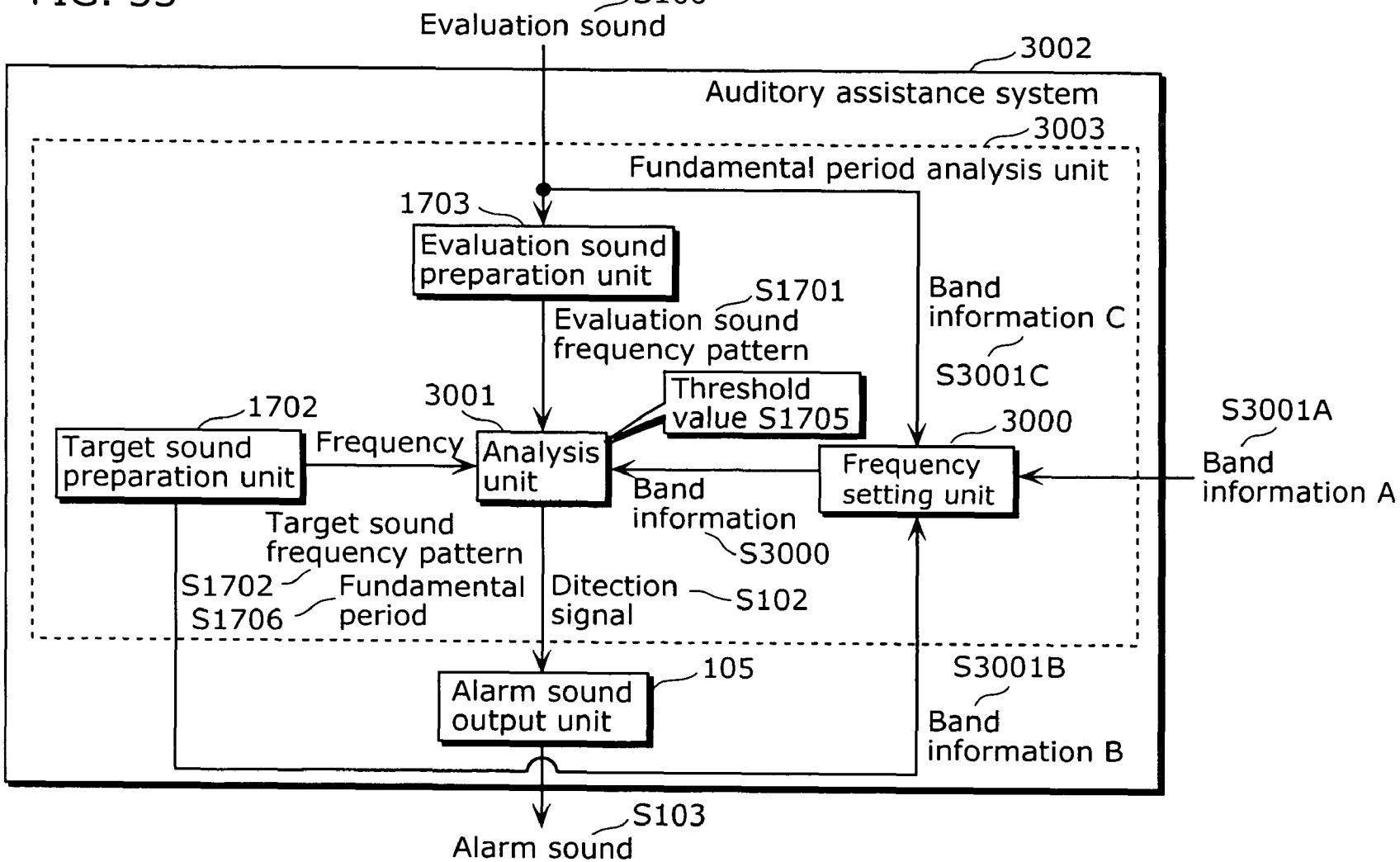
FIG. 33 is a block diagram showing an overall configuration of a target sound analysis apparatus according to a third embodiment.

FIG. 33 is a block diagram showing an overall configuration of a target sound analysis apparatus according to a third embodiment of the present invention. In this case, an example is shown in which the target sound analysis apparatus is incorporated into a vehicle detection system. The present embodiment will be explained using as an example a case where a user is notified of an approaching motorcycle by judging the existence of a motorcycle sound in the proximity of the user through analysis of a fundamental period of the motorcycle sound. In this example, a fundamental period analysis unit 3003 is used in place of the fundamental period analysis unit 101 shown in FIG. 2. A frequency setting unit 3000 has been added to the fundamental period analysis unit 3003 in addition to the configuration of the fundamental period analysis unit 1701 shown in FIG. 20. The frequency setting unit 3000 is an example of a frequency setting unit that sets the frequency bands of a target sound frequency pattern and an evaluation sound frequency pattern used by the analysis unit.

The vehicle detection system 3002 includes the fundamental period analysis unit 3003 and the alarm sound output unit 105. The fundamental period analysis unit 3003 includes the target sound preparation unit 1702, the evaluation sound preparation unit 1703, a frequency setting unit 3000 and an analysis unit 3001.

In this example, the frequency setting unit 3000 uses "band information AS3001A" shown in FIG. 33 to set band information S3000. Note that "band information BS3001B" and "band information CS3001C" shown in FIG. 33 are not used.

The target sound preparation unit 1702 stores a target sound frequency pattern S1702 for each frequency band obtained through frequency analysis of the target sound, and a fundamental period S1706 of the target sound. The analysis unit 3001 stores a threshold value S1705. The target sound preparation unit 1702 outputs the target sound frequency pattern S1702 and the fundamental period S1706 to the analysis unit 3001. The evaluation sound preparation unit 1703 inputs an evaluation sound S100, and performs frequency analysis on the evaluation sound S100 to output an evaluation sound frequency pattern S1701 for each frequency band to the analysis unit 3001. The frequency setting unit 3000 inputs band information AS3001A to create band information S3000, and outputs the same to the analysis unit 3001. For a frequency band based on the band information S3000, the analysis unit 3001 sequentially calculates the differential values of the evaluation sound frequency pattern S1701 and the target sound frequency pattern S1702 at corresponding points in time, by temporally shifting the target sound frequency pattern S1702 with respect to the evaluation sound frequency pattern S1701. The analysis unit 3001 judges whether or not the target sound exists in the evaluation sound S100 based on the period of an iterative time interval of a differential value equal to or lower than the threshold value S1705 and the fundamental period S1706 of the target sound. When the target sound exists, the analysis unit 3001 outputs a detection signal S102 to the alarm sound output unit 105. The alarm sound output unit 105 presents the alarm sound S103 to the user when the detection signal S102 is inputted.

Next, operations of the vehicle detection system 3002 configured as above will be described.

Figure 34:
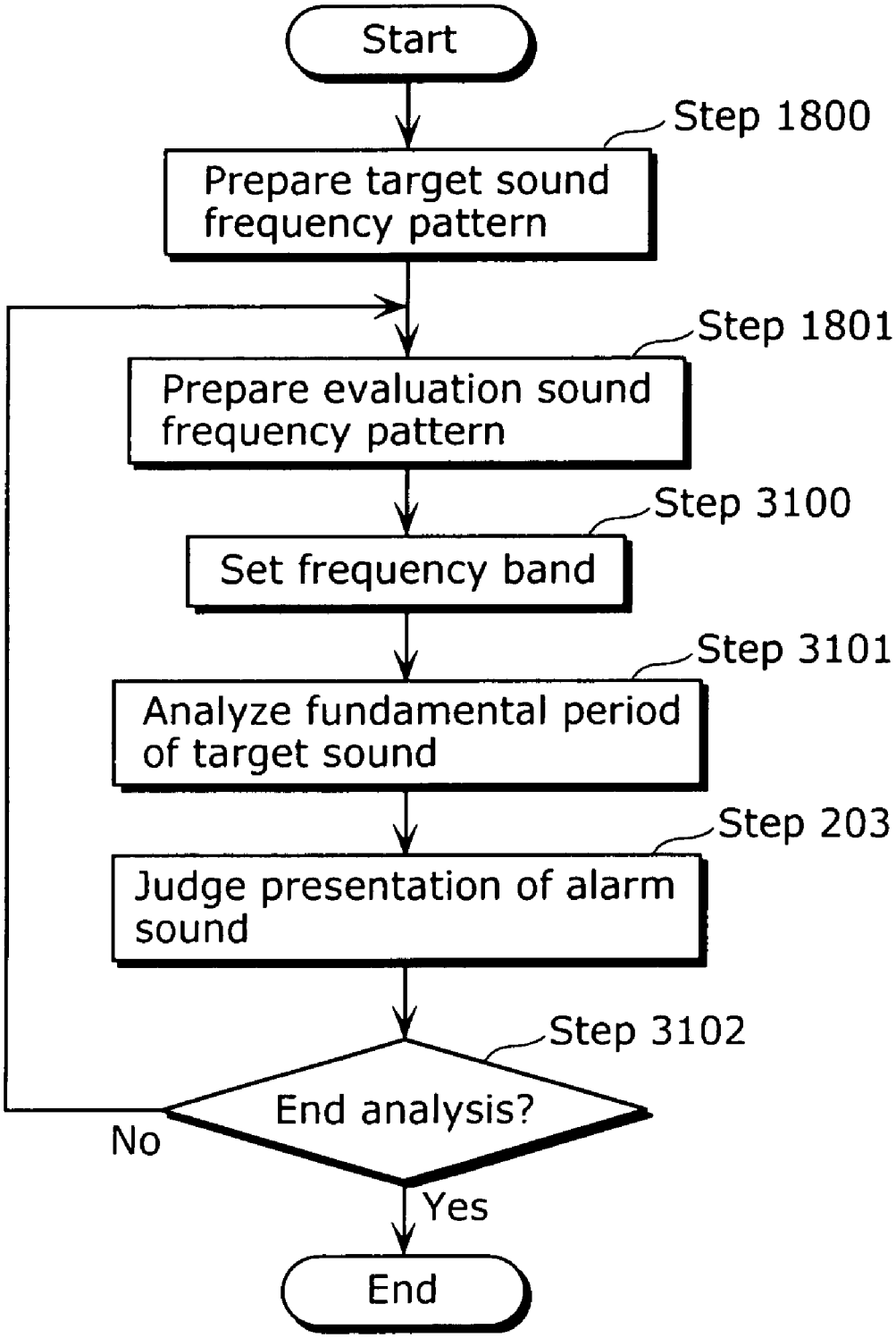
FIG. 34 is a flowchart showing an operational procedure of a vehicle detection system.
Figure 35A:
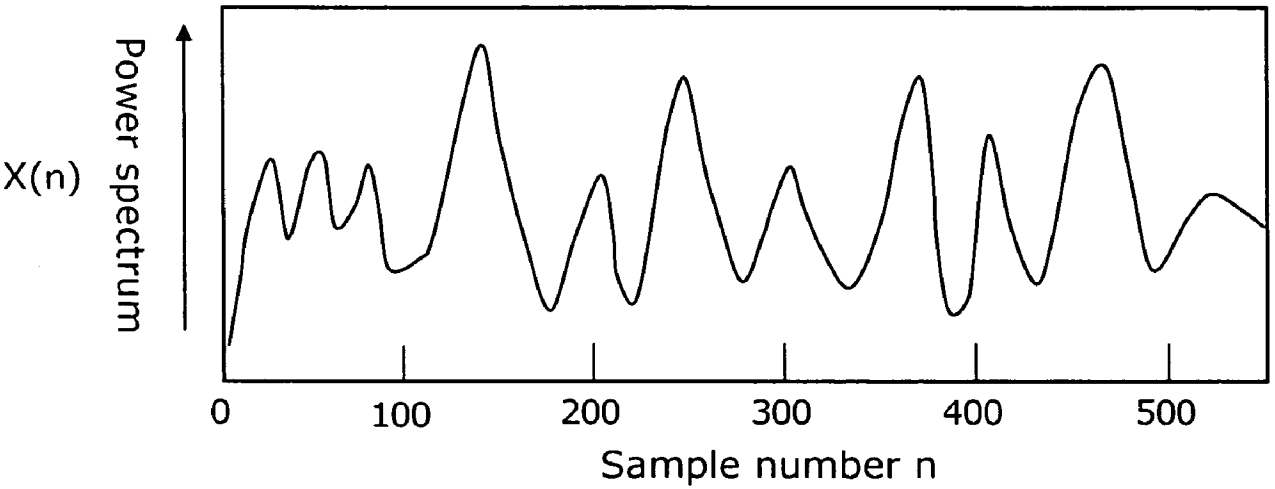
FIG. 35A is a diagram explaining a method of conventional art of analyzing a fundamental period using autocorrelation using a time-frequency structure.
Figure 35B:
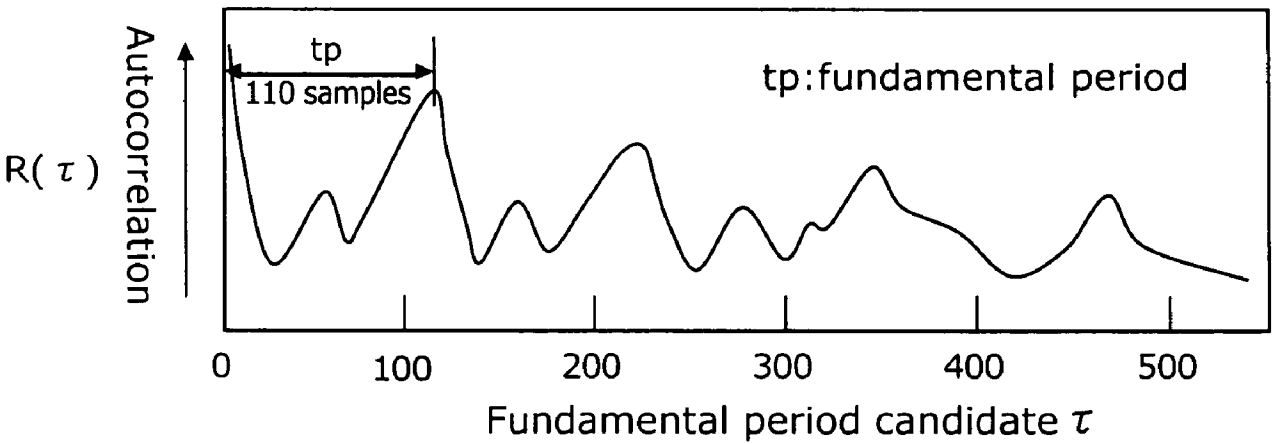
FIG. 35B is a diagram explaining a method of conventional art of analyzing a fundamental period using autocorrelation using a time-frequency structure.
Figure 36:
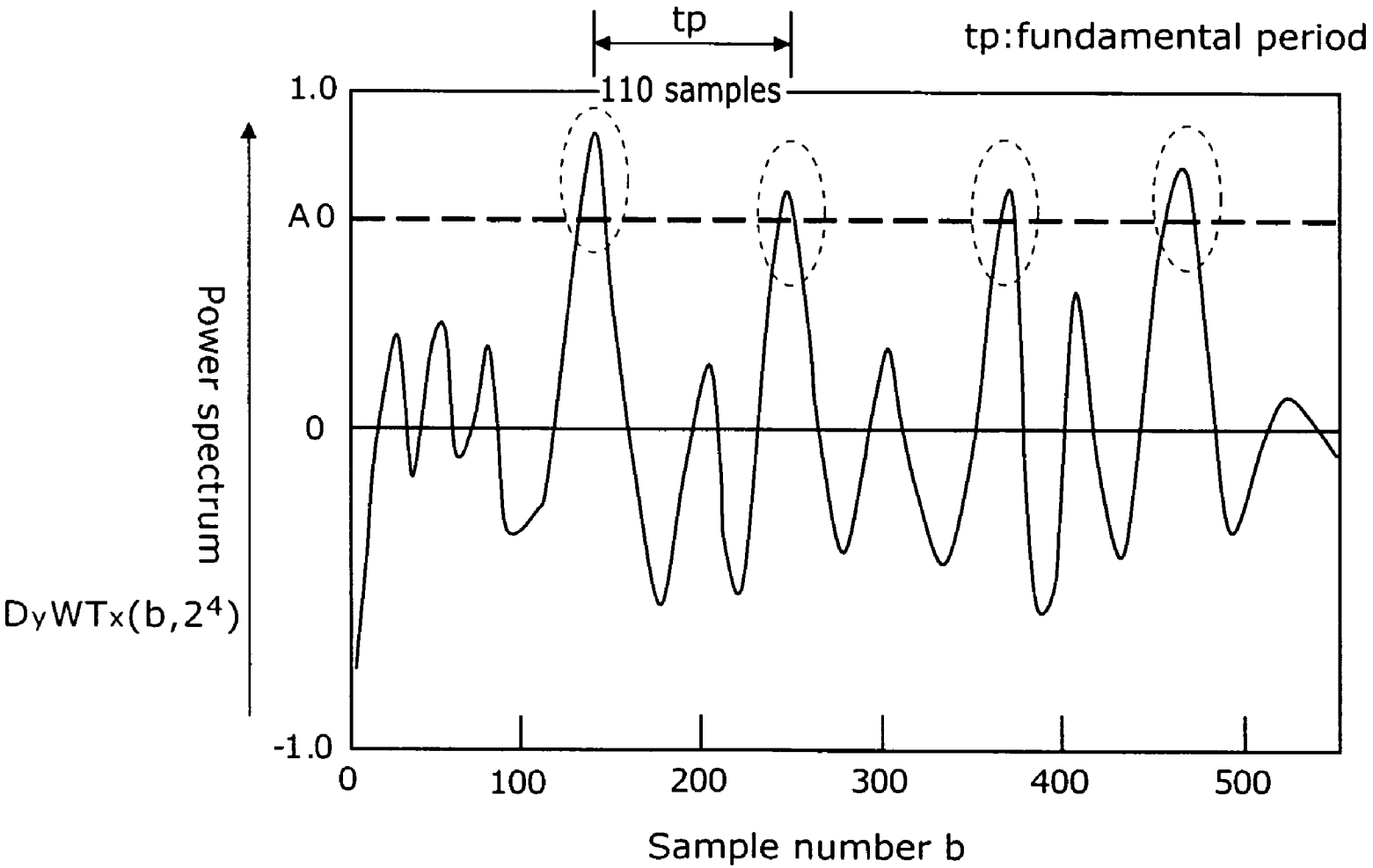
FIG. 36 is a diagram explaining a method of conventional art of analyzing a fundamental period according to a time interval of a peak whereat an amplitude value of a time-frequency structure equals or exceeds a predetermined threshold value.
Figure 37A:
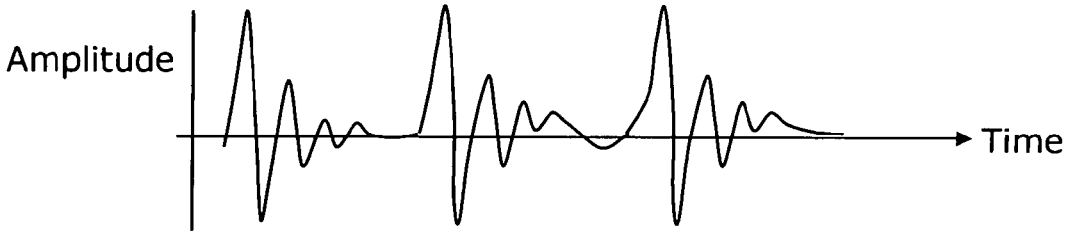
FIG. 37A is a diagram explaining a method of conventional art of analyzing a fundamental period using cross-correlation of residual waveform patterns.
Figure 37B:
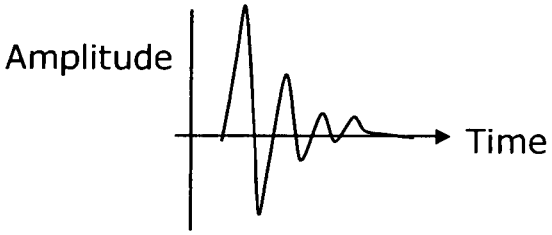
FIG. 37B is a diagram explaining a method of conventional art of analyzing a fundamental period using cross-correlation of residual waveform patterns.
Figure 37C:
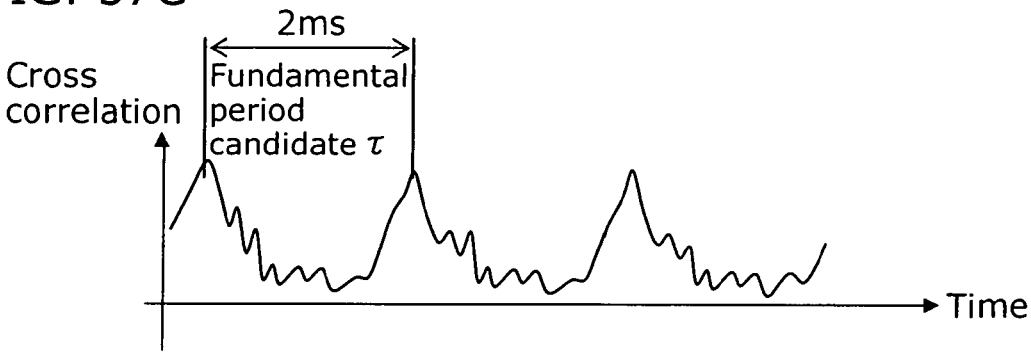
FIG. 37C is a diagram explaining a method of conventional art of analyzing a fundamental period using cross-correlation of residual waveform patterns.

FIG. 34 is a flowchart showing an operational procedure of the vehicle detection system 3002.

In this example, prior to the shipment of the vehicle detection system 1702, a frequency pattern for each frequency band obtained by performing frequency analysis on the motorcycle sound is stored as the target sound frequency pattern S1702 in the target sound preparation unit 102 (step 1800), and the fundamental period S1706 of the motorcycle sound that is the target sound is also stored. Furthermore, the threshold value S1705 is stored for each frequency band in the analysis unit 3001.

Activation of the vehicle detection system 3002 causes the evaluation sound preparation unit 1703 to start retrieving peripheral sounds of the user, which is an evaluation sound S100, using a microphone. Frequency analysis is then performed on the evaluation sound S100 to create an evaluation sound frequency pattern S1701 for each frequency band (step 1801).

Next, the user uses the frequency setting unit 3000 to input a frequency band on which fundamental period analysis is to be performed. In this example, the frequency bands of 200 Hz and 500 Hz, at which the power of the motorcycle that is the target sound is high, are inputted. Thus, "200 Hz, 500 Hz" that is the band information S3000 is inputted to the analysis unit 3001 (step 3100). When noise has been added to 200 Hz in consideration of the noise included in the evaluation sound S100, only 500 Hz may be set as the frequency band on which fundamental period analysis is to be performed.

Next, analysis is performed on whether or not the fundamental period of the motorcycle sound that is the target sound stored in the target sound preparation unit 1702 is included in the evaluation sound S100 (step 3101). In this example, since the band information S3000 is "200 Hz and 500 Hz", the fundamental period of the target sound is analyzed in the same manner as in the second embodiment for a frequency pattern at 200 Hz and a frequency pattern at 500 Hz. Next, from the analysis results for 200 Hz and 500 Hz, when the target sound is judged to exist in even one of the frequency bands, a detection signal S102 to the effect that "the target sound exists" is outputted to the alarm sound output unit 105. Meanwhile, when it is judged that the target sound does not exist in both frequency bands, the detection signal S102 is not outputted to the alarm sound output unit 105.

Next, when the detection signal S102 is inputted, the alarm sound output unit 105 presents the alarm sound S103 to the user (step 203).

Since the steps 1800, 1801 and 203 are the same as in the first and second embodiments, descriptions thereof will be omitted.

Finally, the operations of the above-described steps 1801, 3100, 3101 and 203 are repeated until the vehicle detection system 3002 is brought to a stop (step 3102).

As described above, frequency bands of target sound frequency patterns and evaluation sound frequency patterns used by the analysis unit 3001 may be controlled using the frequency setting unit 3000. As a result, it is now possible to change a frequency band to be analyzed or the bandwidth of a frequency band to be analyzed. For instance, when analyzing an evaluation sound in which the target sound and noise are mixed, the fundamental period of the evaluation sound may be analyzed by selecting a frequency band that is free of noise, and in turn, the existence of the target sound may be judged.

Another Example

Another example at the frequency setting unit will now be described.

In this example, the frequency setting unit 3000 uses "band information BS3001B" and "band information CS3001C" shown in FIG. 33 to set band information S3000. The "band information AS3001A" shown in FIG. 33 will not be used.

The target sound preparation unit 1702 stores a target sound frequency pattern S1702 for each frequency band obtained through frequency analysis of the target sound, and a fundamental period S1706 of the target sound. The analysis unit 3001 stores a threshold value S1705. The target sound preparation unit 1702 outputs the target sound frequency pattern S1702 and the fundamental period S1706 to the analysis unit 3001. The evaluation sound preparation unit 1703 inputs an evaluation sound S100, and performs frequency analysis on the evaluation sound S100 to output an evaluation sound frequency pattern S1701 for each frequency band to the analysis unit 3001. The frequency setting unit 3000 inputs the band information CS3001C that is the evaluation sound S100 and the band information BS3001B from the target sound preparation unit 1702 to create band information S3000, and outputs the same to the analysis unit 3001. For a frequency band based on the band information S3000, the analysis unit 3001 sequentially calculates the differential values of the evaluation sound frequency pattern S1701 and the target sound frequency pattern S1702 at corresponding points in time, by temporally shifting the target sound frequency pattern S1702 with respect to the evaluation sound frequency pattern S1701. The analysis unit 3001 judges whether or not the target sound exists in the evaluation sound S100 based on the period of an iterative time interval of a differential value equal to or lower than the threshold value S1705 and the fundamental period S1706 of the target sound. When the target sound exists, the analysis unit 3001 outputs a detection signal S102 to the alarm sound output unit 105. The alarm sound output unit 105 presents the alarm sound S103 to the user when the detection signal S102 is inputted.

Next, operations of the vehicle detection system 3002 configured as above will be described.

FIG. 34 is a flowchart showing an operational procedure of the vehicle detection system 3002.

In this example, prior to the shipment of the vehicle detection system 1702, a frequency pattern for each frequency band obtained by performing frequency analysis on the motorcycle sound is stored as the target sound frequency pattern S1702 in the target sound preparation unit 1702 (step 1800), and the fundamental period S1706 of the motorcycle sound that is the target sound is also stored. Furthermore, the threshold value S1705 is stored for each frequency band in the analysis unit 3001.

Activation of the vehicle detection system 3002 causes the evaluation sound preparation unit 1703 to start retrieving peripheral sounds of the user, which is the evaluation sound S100, using a microphone. Frequency analysis is then performed on the evaluation sound S100 to create an evaluation sound frequency pattern S1701 for each frequency band (step 1801).

Next, the frequency setting unit 3000 selects a frequency band in which the power of the target sound that is the band information BS3001B is high from the target sound. In this case, 200 Hz and 500 Hz are selected. In addition, a frequency band in which the power of the noise included in the evaluation sound S100 that is the band information CS3001C is high is selected from the evaluation sound S100. In this case, 200 Hz is selected. Then, a frequency band having a higher power than these frequency bands and which does not contain noise is set as the band information S3000. In this example, the band information S3000 is "500 Hz".

Next, analysis is performed on whether or not the fundamental period of the motorcycle sound that is the target sound stored in the target sound preparation unit 1702 is included in the evaluation sound S100 (step 3101). In this example, since the band information S3000 is "500 Hz", the fundamental period of the target sound is analyzed in the same manner as in the second embodiment for a frequency pattern at 500 Hz. When the target sound is judged to exist from the analysis result for 500 Hz, a detection signal S102 to the effect that "the target sound exists" is outputted to the alarm sound output unit 105.

When the detection signal S102 is inputted, the alarm sound output unit 105 presents the alarm sound S103 to the user (step 203).

Since the steps 1800, 1801 and 203 are the same as in the first and second embodiments, descriptions thereof will be omitted.

As described above, since the frequency setting unit 3000 is capable of automatically determining a frequency band that is appropriate for a target sound, there is no need to prepare a frequency band in advance, and greater usability is achieved.

INDUSTRIAL APPLICABILITY

The target sound analysis apparatus according to the present invention is deployable to a wide range of products incorporating the functions of mixed sound separation, sound discrimination and voice synthesis, such as vehicle detection systems, hearing aids, mobile phones and television conference systems.

What is claimed is:

1. A target sound analysis apparatus that analyzes whether or not an evaluation sound contains a target sound, said target sound analysis apparatus comprising:

a target sound preparation unit operable to prepare the target sound that is an analysis waveform to be used for analyzing a fundamental period;

an evaluation sound preparation unit operable to prepare the evaluation sound that is a to-be-analyzed waveform in which a fundamental period is to be analyzed; and an analysis unit operable to (i) sequentially calculate differential values between the evaluation sound and the target sound at corresponding points in time, by temporally shifting the target sound with respect to the evaluation sound, (ii) calculate an iterative interval between the points in time where the differential value is equal to or lower than a predetermined threshold value, and (iii) judge whether or not the target sound exists in the evaluation sound, based on a period of the iterative interval and the fundamental period of the target sound.

2. The target sound analysis apparatus according to claim 1, wherein said target sound preparation unit is operable to prepare a target sound frequency pattern obtained by performing a frequency analysis on the target sound, said evaluation sound preparation unit is operable to prepare an evaluation sound frequency pattern obtained by performing a frequency analysis on the evaluation sound, and said analysis unit is operable to (i) sequentially calculate differential values between the evaluation sound frequency pattern and the target sound frequency pattern at corresponding points in time, by temporally shifting the target sound frequency pattern with respect to the evaluation sound frequency pattern, (ii) calculate an iterative interval between the points in time where the differential value is equal to or lower than a predetermined threshold value, and (iii) judge whether or not the target sound exists in the evaluation sound, based on a period of the iterative interval and the fundamental period of the target sound.

3. The target sound analysis apparatus according to claim 2, wherein said target sound preparation unit is operable to prepare the target sound frequency pattern that includes at least one of an amplitude spectrum and a phase spectrum, the included spectrum being calculated from a cross correlation between the target sound and an aperiodic analysis waveform consisting of a predetermined frequency component, and said evaluation sound preparation unit is operable to prepare the evaluation sound frequency pattern that includes at least one of an amplitude spectrum and a phase spectrum, the included spectrum being calculated from a cross correlation between the evaluation sound and the aperiodic analysis waveform.

4. The target sound analysis apparatus according to claim 2, wherein said target sound preparation unit is operable to prepare the target sound frequency pattern that includes at least one of an amplitude spectrum and a phase spectrum, the included spectrum being calculated from respective cross correlations between the target sound and a plurality of local analysis waveforms that forms a portion of an analysis waveform consisting of a predetermined frequency component and that has predetermined temporal resolution, said evaluation sound preparation unit is operable to prepare the evaluation sound frequency pattern that includes at least one of an amplitude spectrum and a phase spectrum, the included spectrum being calculated from respective cross correlations between the evaluation sound and the plurality of the local analysis waveforms, and said analysis unit is operable to analyze the fundamental period of the target sound, by using, as a single group of data, the target sound frequency pattern prepared using the plurality of the local analysis waveforms and the evaluation sound frequency pattern prepared using the plurality of the local analysis waveforms, respectively.

5. The target sound analysis apparatus according to claim 2, further comprising a frequency setting unit operable to set each frequency band of the target sound frequency pattern and the evaluation sound frequency pattern which are used by said analysis unit, wherein said analysis unit is operable to analyze the fundamental period of the target sound, by using the target sound frequency pattern and the evaluation sound frequency pattern whose frequency band is set by said frequency setting unit.

6. The target sound analysis apparatus according to claim 1, wherein said analysis unit is operable to judge that the target sound exists in the evaluation sound when the period of the iterative interval is substantially equal to the fundamental period of the target sound, and judge that the target sound does not exist in the evaluation sound when the period of the iterative interval is not substantially equal to the fundamental period of the target sound.

7. The target sound analysis apparatus according to claim 1, further comprising a sound information setting unit operable to set sound information regarding the target sound, wherein said target sound preparation unit is operable to prepare the target sound or the target sound frequency pattern, based on the set sound information.

8. The target sound analysis apparatus according to claim 7, further comprising said sound information setting unit is operable to receive a selection signal for selecting one of the plurality of the candidates for the target sound or one of the plurality of the candidates for the target sound frequency pattern, wherein said target sound preparation unit is operable to store a plurality of candidates for the target sound or a plurality of candidates for the target sound frequency pattern, and said target sound preparation unit is operable to set the candidate for the target sound selected by the selection signal or the candidate of the target sound frequency pattern selected by the selection signal, as to the target sound to be prepared or the target sound frequency pattern to be prepared, respectively.

9. The target sound analysis apparatus according to claim 8, wherein said sound information setting unit is operable to receive input of the target sound and set the inputted target sound as to the sound information, and said target sound preparation unit is operable to either set the inputted target sound as to the target sound to be prepared or prepare the target sound frequency pattern by performing a frequency analysis on the target sound.

10. The target sound analysis apparatus according to claim 1, further comprising a threshold value setting unit operable to (i) sequentially calculate differential values between the evaluation sound and the target sound at corresponding points in time, by temporally shifting the target sound with respect to a plurality of the evaluation sounds, (ii) calculate a minimum value among the differential values, and (iii) set the predetermined threshold value based on a maximum value of the plurality of the minimum values corresponding to the plurality of the evaluation sounds.

11. A target sound analysis method of analyzing whether or not an evaluation sound contains a target sound, said target sound analysis method comprising steps of:

preparing a target sound that is an analysis waveform to be used for analyzing a fundamental period;

preparing an evaluation sound that is a to-be-analyzed waveform in which the fundamental period is to be analyzed; and (i) sequentially calculating differential values between the evaluation sound and the target sound at corresponding points in time, by temporally shifting the target sound with respect to the evaluation sound, (ii) calculating an iterative interval between the points in time where the differential value is equal to or lower than a predetermined threshold value, and (iii) judging whether or not the target sound exists in the evaluation sound, based on a period of the iterative interval and the fundamental period of the target sound.

12. A program that analyzes whether or not an evaluation sound contains a target sound, said program causing a computer to execute steps of:

preparing a target sound that is an analysis waveform to be used for analyzing a fundamental period;

preparing an evaluation sound that is a to-be-analyzed waveform in which the fundamental period is to be analyzed; and (i) sequentially calculating differential values between the evaluation sound and the target sound at corresponding points in time, by temporally shifting the target sound with respect to the evaluation sound, (ii) calculating an iterative interval between the points in time where the differential value is equal to or lower than a predetermined threshold value, and (iii) judging whether or not the target sound exists in the evaluation sound, based on a period of the iterative interval and the fundamental period of the target sound.

* * * * *